US009110403B2

(12) United States Patent
Fujimori et al.

(10) Patent No.: US 9,110,403 B2
(45) Date of Patent: Aug. 18, 2015

(54) TONER-CONTAINER SUPPORT UNIT AND IMAGE-FORMING APPARATUS

(71) Applicants: Akira Fujimori, Yokohama (JP); Hideki Kosugi, Yokohama (JP); Tatsuya Kubo, Kawasaki (JP); Kentaro Nodera, Sagamihara (JP); Shinnosuke Koshizuka, Yamato (JP); Teppei Kikuchi, Yokohama (JP)

(72) Inventors: Akira Fujimori, Yokohama (JP); Hideki Kosugi, Yokohama (JP); Tatsuya Kubo, Kawasaki (JP); Kentaro Nodera, Sagamihara (JP); Shinnosuke Koshizuka, Yamato (JP); Teppei Kikuchi, Yokohama (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/263,094

(22) Filed: Apr. 28, 2014

(65) Prior Publication Data

US 2014/0321885 A1 Oct. 30, 2014

(30) Foreign Application Priority Data

Apr. 30, 2013 (JP) ..... 2013-095231

(51) Int. Cl.
*G03G 15/08* (2006.01)
*G03G 15/00* (2006.01)
*G03G 21/16* (2006.01)

(52) U.S. Cl.
CPC ..... *G03G 15/0875* (2013.01); *G03G 15/0886* (2013.01); *G03G 15/80* (2013.01); *G03G 21/1676* (2013.01)

(58) Field of Classification Search
CPC ..... G03G 15/0863; G03G 15/0865; G03G 15/0872; G03G 15/0875; G03G 15/0877; G03G 15/80
USPC ..... 399/12, 90, 258, 262
See application file for complete search history.

(56) References Cited

U.S. PATENT DOCUMENTS

| | | | | |
|---|---|---|---|---|
| 8,165,504 | B2 * | 4/2012 | Cho | 399/258 |
| 8,655,234 | B2 * | 2/2014 | Hori et al. | 399/258 |
| 8,843,034 | B2 * | 9/2014 | Yamane et al. | 399/262 |
| 2007/0280744 | A1 | 12/2007 | Kubo et al. | |
| 2008/0199205 | A1 | 8/2008 | Kubo et al. | |
| 2008/0199223 | A1 | 8/2008 | Tateyama et al. | |

(Continued)

FOREIGN PATENT DOCUMENTS

| | | |
|---|---|---|
| JP | 2012-018379 | 1/2012 |
| WO | WO 2011/111863 A1 | 9/2011 |

OTHER PUBLICATIONS

The Extended European Search Report issued Oct. 2, 2014, in Application No. / Patent No. 14166635.4-1560.

*Primary Examiner* — William J Royer
(74) *Attorney, Agent, or Firm* — Oblon, McClelland, Maier & Neustadt, L.L.P.

(57) ABSTRACT

A toner-container support unit is provided. The toner-container support unit includes: a toner container housing toner; a container mount including an internal space to accommodate the toner container; a toner-container receiver which is provided on an internal end side of the internal space of the container mount; a positioning hole formed on the back end surface of the toner container; a positioning pin provided in the toner-container receiver; a retracting assembly retracting a back end portion of the toner container to a toner-container receiver side when inserting the toner container into the container mount; and an inclination stopper which prevents the inclination of the toner container when the back end portion of the toner container is retracted by the retracting assembly toward the toner-container receiver.

6 Claims, 30 Drawing Sheets

(56) References Cited

U.S. PATENT DOCUMENTS

| | | | |
|---|---|---|---|
| 2008/0213006 | A1 | 9/2008 | Nakayama et al. |
| 2008/0247786 | A1 | 10/2008 | Nakayama et al. |
| 2009/0067878 | A1 | 3/2009 | Tateyama et al. |
| 2009/0067886 | A1 | 3/2009 | Nodera et al. |
| 2009/0097878 | A1 | 4/2009 | Kubo et al. |
| 2009/0103954 | A1 | 4/2009 | Nakayama et al. |
| 2011/0058857 | A1 | 3/2011 | Hori et al. |
| 2012/0027466 | A1 | 2/2012 | Nakayama et al. |
| 2012/0039627 | A1 | 2/2012 | Kubo et al. |
| 2012/0051797 | A1 | 3/2012 | Suzuki et al. |
| 2012/0163875 | A1 | 6/2012 | Tateyama et al. |
| 2013/0243491 | A1 | 9/2013 | Nodera et al. |
| 2013/0315636 | A1 | 11/2013 | Takayama et al. |
| 2014/0003843 | A1 | 1/2014 | Suzuki et al. |
| 2014/0119780 | A1 | 5/2014 | Hori et al. |

* cited by examiner

TONER-CONTAINER SUPPORT UNIT AND IMAGE-FORMING APPARATUS

CROSS-REFERENCE TO RELATED APPLICATION

The present application is based on and claims priority from Japanese Patent Application No. 2013-95231, filed on Apr. 30, 2013, the disclosure of which is hereby incorporated by reference herein in its entirety.

BACKGROUND

Field of the Invention

The present invention relates to a toner-container support unit in which a toner container housing toner is supported on an image-forming apparatus, and an image-forming apparatus including the toner-container support unit.

Generally, a toner container housing toner is inserted into an image-forming apparatus such as a copier, printer, facsimile device, and multifunction peripheral. That is, the image-forming apparatus includes a container mount having a space inside thereof. The toner container is inserted into the space of the container mount. The toner container is configured to be detachable and attachable, and can be replaced with a new one when toner inside runs out.

The image-forming apparatus further includes a fixed protrusion formed on a back surface of the toner container, and a movable protrusion formed on an inner surface of the internal space of the container mount. A so-called retracting assembly is further included in the image-forming apparatus. The toner container is retracted toward deep inside the internal space of the container mount by the retracting assembly when it is inserted into the container mount. In the retracting assembly, when the toner container is inserted into the container mount, the movable protrusion contacts the fixed protrusion, and the fixed protrusion pushes the movable protrusion so that it can cross over the fixed protrusion. Because the movable protrusion is configured to have a biasing force toward the outer direction, it tries to turn back by the biasing force when crossing over the fixed protrusion. Thus, the end portion of the toner container is drawn back to deep inside the internal space of the container mount.

However, in the above-described image-forming apparatus, there is a problem in that the toner container should incline when it is retracted by the retracting assembly. In detail, the fixed protrusion is disposed on a lower position of the external back-wall surface of the container and the movable protrusion is similarly disposed on a lower position of the internal back-wall surface of the container mount. Thus, the back part of the toner container moves up due to the biasing force applied to the lower part of the container, so the toner container inclines when it is retracted by the retracting assembly.

Generally, a positioning hole for adjusting a position of the toner container and a positioning pin are provided on the back end surface of the toner container and an inner side surface of the internal space of the container mount. However, the position of the positioning hole doesn't match that of the positioning pin if the toner container inclines; therefore, the position-adjustment pin cannot fit into the positioning hole.

SUMMARY

The present invention is therefore made to provide a toner-container support unit capable of preventing an inclination of a toner container when the toner container is retracted by a retracting assembly, and an image-forming apparatus including such a structure.

In order to accomplish the above-described object, the toner-container support unit according to the present embodiments includes: a toner container housing toner; a container mount including an internal space to accommodate the toner container; a toner-container receiver which is provided on an internal end side of the internal space of the container mount, fixing and supporting a back end surface of the toner container inserted into the container mount; a positioning hole formed on the back end surface of the toner container; a positioning pin provided in the toner-container receiver so as to face the positioning hole; a retracting assembly retracting a back end portion of the toner container to a toner-container receiver side when inserting the toner container into the container mount, a position of the toner container being adjusted by fitting the positioning pin into the positioning hole through the retracting assembly retracting the back end portion of the toner container; and an inclination stopper which prevents the inclination of the toner container when the back end portion of the toner container is retracted by the retracting assembly toward the toner-container receiver.

BRIEF DESCRIPTION OF THE DRAWINGS

The accompanying drawings are included to provide further understanding of the invention, and are incorporated in and constitute a part of this specification. The drawings illustrate embodiments of the invention and, together with the specification, serve to explain the principle of the invention.

FIG. 9A is a perspective view illustrating the coupling 522*a* as viewed from the front side (in direction Z). FIG. 9B is a side view of the coupling 522*a* (perpendicular to direction Z). FIG. 9C is a cross-sectional view illustrating the coupling 522*a* along the VI-VI line shown in FIG. 9A.

FIG. 10A schematically illustrates the stirring-drive coupling 301 and the coupling 522*a* as viewed from the perpendicular side to the direction Z. FIG.

10B schematically illustrates a hook protrusion 301*a* of the stirring-drive coupling 301 and a hook protrusion 522*b* of the coupling 522*a* as viewed from a direction indicated with an arrow A9 shown in FIG. 10A. FIG. 10C illustrates a motion of the hook protrusions 301*a* and 522*b* relative to the guiding functions of an inclination surface 301*c* in the hook protrusion 301*a* and an inclination surface 522*d* in the hook protrusion 522*b*. FIG. 10D illustrates an aspect in which the stirring-drive coupling 301 is connected to the coupling 522*a*. FIG. 10E illustrates an inclination 522*f* which is provided on an end portion 522*c* of one of a pair of hook protrusions 522*b*, and an inclination 301*d* which is provided on a protruding end portion 301*b* of one of a pair of hook protrusions 301*a*.

FIG. 15A illustrates a front view of the second shutter 632 as viewed from the top side. FIG. 15B illustrates a perspective view of the second shutter 632 as viewed from the top side and in the opposite direction to the insertion direction (opposite to direction Z). FIG. 15C illustrates a perspective view of the second shutter 632 as viewed from the top side and the forward side of the inserting direction.

FIG. 21A illustrates an aspect while inserting the toner cartridge 502 into the container mount 220. FIG. 21B illustrates an aspect in which the toner cartridge 502 is inserted into the container mount 220.

FIG. 23A illustrates an aspect in which the holding rail 209 faces the holding rail 221 in the direction Z. FIG. 23B illustrates an aspect in which the holding rail 209 contacts the holding rail 221. FIG. 23C illustrates an aspect in which the holding rail 209 overlaps the holding rail 221 in the direction Y.

FIG. 24 includes a cross-sectional view of the toner cartridge 502 similar to FIG. 16 and a front view of the toner-container fixing portion 902 similar to FIG. 19. FIG. 24 further illustrates a pair of pressure portions 212 having an opening. FIG. 24 also illustrates a pressure body portion 212*b*, a protruding end portion 212*c*, and an inclined pressure-surface 212*d* of the pressure portion 212 having contact with a releasing protrusion 812*d* (and inclined releasing surface 812*e* thereof) of a pair of arm sections 812, as a primary incurve-condition of the second shutter 632 of the toner cartridge 502.

FIG. 27 illustrates a release aspect of the fixed toner cartridge 502 released by a pair of releasing claw assemblies 97 when the toner cartridge 502 moves to the opposite side of the direction Z relative to the toner-container fixing portion 902.

FIG. 31 illustrates an aspect in which the toner cartridge 502 inclines when it is inserted into the container mount 220.

FIG. 32A schematically illustrates the inner side of the toner cartridge 502. FIG. 32B schematically illustrates the inner side aspect of a toner cartridge 502' as a comparative example.

DETAILED DESCRIPTION OF THE PREFERRED EMBODIMENT

Embodiment

Hereinafter, an embodiment of a toner-container support unit and an image-forming apparatus according to the present invention will be described with reference to the drawings. Identical or corresponding parts are designated with the same numerals and symbols throughout the drawings, and the descriptions thereof are simplified or omitted arbitrary so as to avoid repetition.

A toner cartridge 502 (502Y, 502C, 502M, 502BK) and an image-forming apparatus 102 capable of accommodating the toner cartridge 502 are described below. Initially, a configuration and operation of the image-forming apparatus 102 are described.

Figure 1:
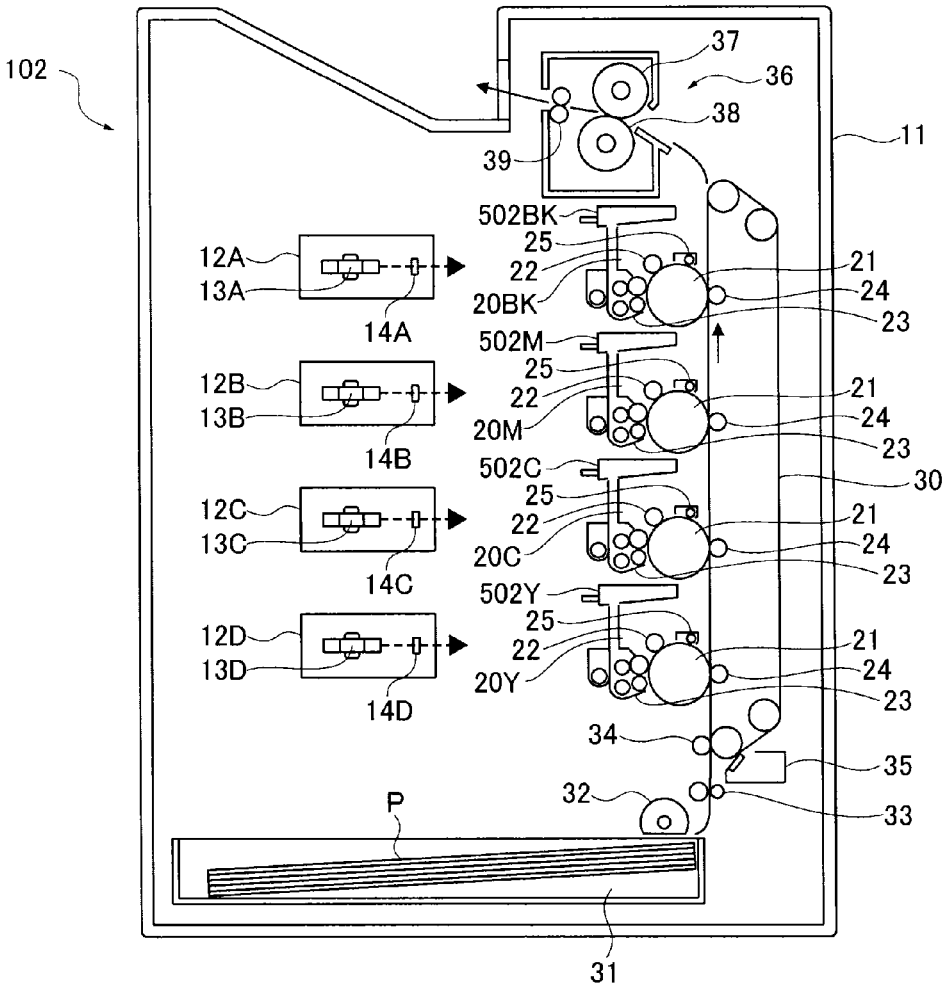
FIG. 1 illustrates an entire configuration of an image-forming apparatus 102 according to an Embodiment of the present invention.

The image-forming apparatus 102 according to the present embodiment is a multicolor printer as shown in FIG. 1 and includes a box-shaped main body 11 as a housing body. The image-forming apparatus 102 includes writing units 12A to 12D to write electrostatic latent images on photoreceptor drums 21 (image bearer) according to image data after a charging process. The writing units 12A to 12D can be optical scanning devices employing polygon mirrors 13A to 13D, optical elements 14A to 14D, and the like. Alternatively, an array of light-emitting diodes (LED) may be used as the writing units. The electrostatic latent images formed by the writing units 12A to 12D are developed and transferred onto a transfer material P as a recording media and stacked in a paper feeder 31.

The transfer material P can be recording paper, overhead projector films (OHP), and the like. Many sheets of these are stacked in the paper feeder 31. In the image formation, the stacked transfer material P is sent out from the top to a transfer belt 30 as a feed roller 32 rotates. The transfer belt 30 has an endless form and transports the transfer material P having an electrostatically-absorbed surface. The transfer belt 30 transfers a toner image formed on the photoreceptor drum 21 to the transfer material P. The transfer belt 30 revolves around a definite path including neither a start-edge nor an end-edge. An absorbing roller 34 and a belt-cleaning device 35 are provided on an outer circumferential surface of the transfer belt 30.

The photoreceptor drum 21 faces a respective transfer roller 24 via the transfer belt 30. Each transfer roller 24 includes a not-shown metal core and a conductive elastic layer covering the metal core. The conductive elastic layer of the transfer roller 24 is constructed of an elastic material such as polyurethane rubber or ethylene-propylene-diene polyethylene (EPDM), and its electrical resistance value (volume resistivity) is adjusted to a medium value with dispersion of a conductive applicator such as carbon black, zinc oxide, tin oxide, or the like. A fixing device 36 is provided above the revolving transfer belt 30 as shown in FIG. 1. The fixing device 36 includes a pressure roller 37 and a heating roller 38 to fix the toner image on the transfer material P with heat and pressure.

In FIG. 1, four process cartridges 20Y, 20C, 20M and 20BK are arranged vertically along the transfer belt 30. The four process cartridges 20 form yellow, cyan, magenta and black toner images. A device to supply carrier (magnetic carrier particles) and each color (yellow, cyan, magenta, and black) of toner (toner particles) to respective developing devices 23 is provided above each process cartridge 20Y, 20C, 20M and 20BK. That is, toner cartridges 502Y, 502C, 502M and 502BK containing carrier or toner are provided on the respective process cartridges 20Y, 20C, 20M and 20BK as the supply device.

The process cartridges 20Y, 20C, 20M, 20BK and the toner cartridges 502Y, 502C, 502M and 502BK can be mounted to the main body 11 and removed therefrom when the transfer belt 30 rotates around a rotation shaft (not shown).

In the Embodiment, the image-forming apparatus 102 performs as a multifunction peripheral such as a copier or printer. When the image-forming apparatus 102 performs as a copier, various types of image processing, such as analog and digital conversion, MTF correction, gradation processing is provided on image data read by a scanner. The image data is converted into image-writing data after such image processings. When the image-forming apparatus 102 performs as a printer, image data in a form of page-description language, bitmap or the like, which is transmitted from a computer and the like, is processed into the image-writing data.

In image formation, the writing units 12A to 12D emit exposure light according to image data of black, magenta, cyan, and yellow toward the respective process cartridges 20BK, 20M, 20C, and 20Y. That is, the exposure light (laser beam) emitted from each light source of the writing units 12A to 12D irradiates the photoreceptor drums 21 through the polygon mirrors 13A to 13D, and the optical elements 14A to 14D. Thereby, a toner image corresponding to each exposure light is formed on the photoreceptor drum 21 (image bearer) of each process cartridge 20Y, 20C, 20M, and 20BK. Then, the toner image is transferred to the transfer material P.

The transfer material P fed from the paper feeder 31 stops temporarily at a position of a registration roller 33 and is forwarded to the transfer belt 30. Specifically, the registration roller 33 rotates coincident with the passage of the transfer material P through the photoreceptor drum 21 (image bearer) where the toner image is formed. The transfer belt 30 absorbs the transfer material P entered by application of a voltage through the absorbing roller 34 disposed on an entry position of the transfer belt 30. Thereby, the transfer material P moves along the rotation of the transfer belt 30 in a direction indicated by an arrow shown in FIG. 1. While the transfer material P passes through each process cartridge 20Y, 20C, 20M, and 20BK sequentially, respective toner image having each color is superimposed thereon.

Thus the transfer material P including the transferred color image is separated from the transfer belt 30 and reaches the fixing device 36. The toner image on the transfer material P is fixed thereon while it is sandwiched and heated between the pressure roller 37 and the heating roller 38. Therefore, the surface of the transfer belt 30 is cleaned by the belt-cleaning device 35 after the transfer material P is separated therefrom.

Descriptions are given below of the process cartridges 20 and toner cartridge 502 in the image-forming apparatus 102. It is to be noted that the process cartridges 20Y, 20C, 20M, and 20BK have nearly the same configuration, and the toner cartridges 502Y, 502C, 502M, and 502BK also have nearly the same configuration. Accordingly, in the following descriptions and in the figures, suffixes Y, C, M, BK showing each color in the process cartridge 20 and toner cartridge 502 are omitted. Similarly, the writing units 12A to 12D have a similar configuration, so the suffixes A to D of reference numerals are omitted for simplicity.

Figure 2:
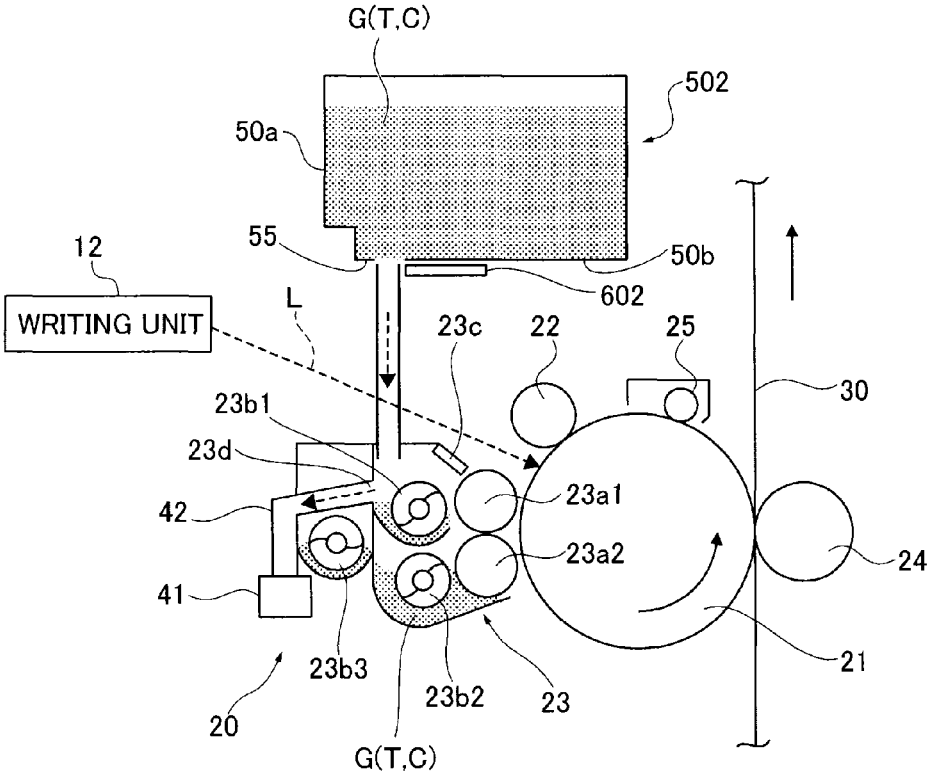
FIG. 2 provides an explanatory view illustrating a configuration of a process cartridge 20 and a toner cartridge 502 according to an Embodiment.

As shown in FIG. 2, each process cartridge 20 includes integrally the photoreceptor drum 21, a charged portion 22, the developing device 23, a cleaning unit 25, and the like. The process cartridge 20 employs a premix developing method in which carrier is supplied and discharged as required.

The photoreceptor drum 21 as the image bearer can be a negatively-charged organic photoreceptor and rotates in a counterclockwise direction by a not-shown driving unit. The charged portion 22 is an elastic charging roller which is formed by covering a metal core with an elastic layer of moderate resistivity, such as a foamed urethane layer that includes carbon black as electroconductive particles, a sulfuration agent, foaming agent, and the like. The material of the elastic layer of moderate resistivity in the charged portion 22 includes rubber such as urethane, ethylene-propylene diene monomer (EPDM), acrylonitrile butadiene rubber (NBR), silicone rubber, and isoprene rubber to which an electroconductive material such as carbon black or metal oxide is added to adjust the resistivity. Alternatively, foamed rubber including these materials may be used. The cleaning unit 25 includes a cleaning blush (or a cleaning blade) which contacts the surface of the photoreceptor drum 21 and scratches the surface. The cleaning unit 25 mechanically removes and collects untransferred toner on the photoreceptor drum 21.

The developing device 23 includes developing rollers 23*a*1 and 23*a*2 as developer bearers. The developing rollers 23*a*1 and 23*a*2 are disposed adjacent to the photoreceptor drums 21. A developing range in which magnetic brushes contact the photoreceptor drum 21 is formed at positions facing the developing rollers 23*a*1 and 23*a*2. The developing device 23 contains developer G (two-component developer) including toner T and carrier C. The developing device 23 develops the latent image formed on the photoreceptor drum 21 (toner image is formed). The detailed description of the configuration and operation of the developing device 23 will be given later.

The developing device 23 in the Embodiment is a premix developing type, and fresh carrier C (developer G) is supplied thereto from the toner cartridge 502 as required. Degraded developer G is discharged to a developer storage 41 disposed outside the developing device 23. The toner cartridge 502 contains premixed developer G including toner T (toner particles) and carrier C (carrier particles) to be supplied to the developing device 23. The toner cartridge 502 contains developer G (toner T and carrier C) inside thereof. Developer G is supplied to the developing device 23. The toner cartridge 502 functions as a supply device to supply fresh toner T to the developing device 23 as well as to supply fresh carrier C to the developing device 23. In the Embodiment, the ratio of toner T relative to carrier C in the developer G which is housed in the toner cartridge 502 (toner consistency) is high.

Next, an image formation operation on the photoreceptor drum 21 is described below.

As the photoreceptor drum 21 rotates counterclockwise, the surface of the photoreceptor drum 21 is charged at the charged portion 22 uniformly. Subsequently, the charged portion 22 of the photoreceptor drum 21 reaches the portion receiving an exposure light L, and an exposure process is carried on by a writing unit 12. Specifically, the surface of the photoreceptor drum 21 is discharged (electrical potential is changed) with the exposure light L selectively according to image data; thus, an electrostatic latent image is formed due to the differences in electrical potential (potential contrast) between the discharged portion and non-image portions that are not irradiated. In the exposure process, an electric charge-generating substance in a photosensitive layer of the photoreceptor drum 21 generates electrical charges upon receiving the light, and holes among them counteract with the charge potential on the surface of the photoreceptor drum 21.

Subsequently, the surface of the photoreceptor drum 21 where the latent image is formed reaches a position facing the developing device 23. The electrostatic latent image on the photoreceptor drum 21 comes into contact with the magnetic brushes formed on the developing rollers 23*a*1 and 23*a*2. The electrostatic latent image is adhered by the negatively-charged toner T in the magnetic brushes, and becomes visible. Specifically, the amount of developer G attracted by the magnetic force of the magnetic pole of the upper developing roller 23*a*1 is adjusted by a doctor blade 23*c*, and the developer G is transported to a developing range facing the photoreceptor drum 21 (facing position of developing rollers 23*a*1, 23*a*2 and photoreceptor drum 21). In the developing range, bristled carrier C scratches the surface of the photoreceptor drum 21. At that time, toner T contained in carrier C is charged negatively by friction with carrier C. On the contrary, carrier C is charged positively. The developing rollers 23*a*1 and 23*a*2 receive a predetermined developing bias from a not-shown power source. Thus, an electrical field is formed between the photoreceptor drum 21 and the developing rollers 23*a*1 and 23*a*2. Toner T is negatively charged and selectively adhered to the image portion (electrostatic latent image) on the photoreceptor drum 21 through the electrical field.

Thus, the toner image formed on the photoreceptor drum 21 reaches the position facing the transfer belt 30 and the transfer roller 24. At that time, the toner image on the photoreceptor drum 21 is transferred to the surface of the transfer material P transported to the position facing the transfer belt 30, timely. Herein, a predetermined voltage is applied to the transfer roller 24.

The transfer material P in which the toner image is transferred passes through the fixing device 36 and is discharged by a discharge roller 39 disposed outside the image-forming apparatus 102. Toner T remaining on the photoreceptor drum 21 (untransferred toner), which is not transferred to the transfer material P during the transfer process, reaches a position facing the cleaning unit 25 adhering to the photoreceptor drum 21. The untransferred toner on the photoreceptor drum 21 is collected and removed by the cleaning unit 25. Subsequently, the surface of the photoreceptor drum 21 passes through a not-shown discharge device and the residual potential thereon is removed.

The configuration and operation of the developing device 23 will be described hereinafter. The developing device 23 includes the developing rollers 23*a*1 and 23*a*2, screw conveyors 23*b*1 to 23*b*3 (auger screw), the doctor blade 23*c*, and the like. The two developing rollers 23*a*1 and 23*a*2 are configured to have a cylindrical sleeve configured by a non-magnetic material such as aluminum, brass, stainless steel, or conductive resin. The cylindrical sleeve can rotate in a clockwise direction through a not-shown driving unit. Inside the sleeve of the developing rollers 23*a*1 and 23*a*2, magnets to cause a magnetic field are attached so that developer G can be bristled on the circumferential surface of the sleeve. Carrier C in developer G bristles in a chain form on the sleeve along the magnetic line in a normal direction generated from the magnet. Electrically charged toner T is adhered to carrier C of the bristled chain, and a magnetic brush is formed thereby. The magnetic brush is transported in the same direction as the sleeves (clockwise direction) by the rotation of the sleeves.

The doctor blade 23*c* is disposed upstream of the developing range and controls the amount of developer G carried on (lift-up magnetically) the developing roller 23*a*1. The doctor blade 23*c* is a plate having a thickness of about 2 mm constructed by non-magnetic metallic material such as SUS316 and XM7. Alternatively, a thin metal sheet having a thickness of about 0.3 mm and constructed by SUS430 as the non-magnetic metallic material can be used on a surface facing the doctor blade 23*c*.

Three screw conveyors 23*b*1 to 23*b*3 are provided on a shaft part of the container as spiral screw portions. The screw conveyors 23*b*1 to 23*b*3 stir and merge developer G contained in the developing device 23 by circulating them in a longitudinal direction (vertically to the plane paper-surface of FIG. 2). The first screw conveyor 23*b*1 is provided in a position facing the developing roller 23*a*1, transports developer G in a horizontal direction (vertically to the plane paper-surface of FIG. 2), and supplies developer G on the developing roller 23*a*1. In other words, the first screw conveyor 23*b*1 faces the developing roller 23*a*1 and supplies developer G to the developing roller 23*a*1 by transporting developer G in the longitudinal direction (vertically to the plane paper-surface of FIG. 2).

The second screw conveyor 23*b*2 is provided at a position facing the developing roller 23*a*2 and on the lower portion of the first screw conveyor 23*b*1. The second screw conveyor

23*b*2 transports developer G which is separated from the developing roller 23*a*2 in a horizontal direction. Developer G is forcibly separated from the developing roller 23*a*2 through a developer-discharging rod after the developing process. In other words, the second screw conveyor 23*b*2 is provided at a position facing the developing roller 23*a*2 and transports developer G which is separated from the developing roller 23*a*2 in the longitudinal direction. The developer-discharging rod is formed by removing the magnetic pole partially from the magnet inside the sleeve, or by using a magnet having an arrangement in which a reactive magnetic field is generated. The first screw conveyor 23*b*1 and the second screw conveyor 23*b*2 are provided so as to keep the rotation axis to be approximately horizontal, similar to the developing rollers 23*a*1 and 23*a*2 or the photoreceptor drum 21.

Although not shown clearly in the FIGS., the third screw conveyor 23*b*3 is provided obliquely to the horizontal direction so as to connect a downstream side of a transporting path corresponding to the second screw conveyor 23*b*2 with an upstream side of the transporting path corresponding to the first screw conveyor 23*b*1 linearly. The third screw conveyor 23*b*3 transports developer G transported by the second screw conveyor 23*b*2 towards the upstream side of the transporting path corresponding to the first screw conveyor 23*b*1. In addition, the third screw conveyor 23*b*3 transports developer G, circulated from the downstream side of the transporting path corresponding to the first screw conveyor 23*b*1 through a drop path, towards the upstream side of the transporting path corresponding to the first screw conveyor 23*b*1.

The transporting paths of the first screw conveyor 23*b*1, the second screw conveyor 23*b*2, and the third screw conveyor 23*b*3 are partitioned by wall sections. Although not shown in the FIGS., the downstream part of the transporting path of the second screw conveyor 23*b*2 and the upstream part of the transporting path of the third screw conveyor 23*b*3 are connected through a first relay portion. The downstream part of the transporting path of the third screw conveyor 23*b*3 and the upstream part of the first screw conveyor 23*b*1 are connected through a second relay portion. The downstream portion of the first screw conveyor 23*b*1 and the upstream portion of the third screw conveyor 23*b*3 are connected through the drop path. By such a configuration, the three screw conveyors 23*b*1 to 23*b*3 can form a circulating path in which developer G circulates in a longitudinal direction.

A discharge outlet 23*d* (discharging device) is provided on a wall section of the transporting path of the first screw conveyor 23*b*1 for discharging a part of developer G contained in the developing device 23 to the outer part (developer storage 41). In detail, when developer G is increased to over the predetermined developer-amount in the developing device 23, and the upper surface of contained developer G exceeds the predetermined height, surplus developer G is discharged from the discharge outlet 23*d* towards the developer storage 41. That is, when the surplus developer G is higher than the height of the lower part of the discharge outlet 23*d*, it is discharged from the discharge outlet 23*d*, passes through a discharge path 42 and is dropped towards the developer storage 41 by gravity. Therefore, the carrier C, which is degraded by the pollution of a base resin of toner T or an external additive, can be discharged automatically from the discharge outlet 23*d* towards the outside of the developing range. The degradation in image quality can be prevented as well as aging degradation. Although not shown in FIG. 2, in the discharge path 42, the discharging rod is provided so as to transport developer which is discharged from the discharge outlet 23*d* to the horizontal direction.

Figure 3:
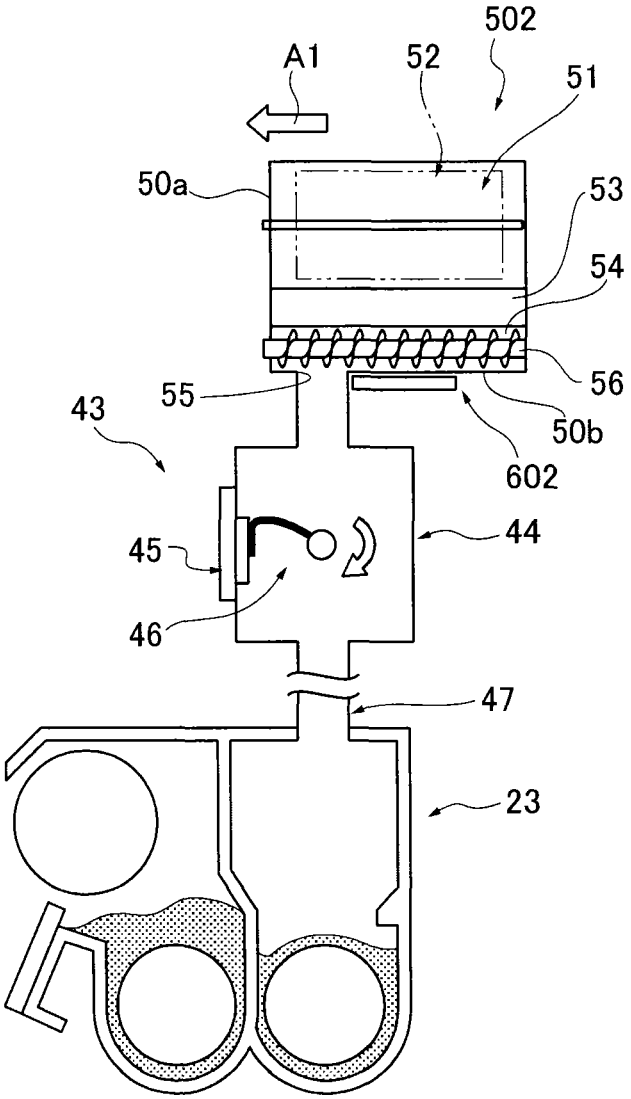
FIG. 3 provides a schematic view illustrating the toner cartridge 502 and a peripheral configuration of the toner cartridge 502 in a case it is inserted into a toner-supply device 43 according to an Embodiment.

Descriptions are given below of the toner-supply device 43 (powder-particle supplier) which supplies fresh carrier C from the toner cartridge 502 to the developing device 23. FIG. 3 schematically illustrates the toner cartridge 502 in the case it is inserted into the toner-supply device 43 and its peripheral configuration.

As shown in FIG. 3, a container portion 51, stirring member 52, tapered portion 53, discharge path 54, discharge outlet 55, screw conveyor 56, and a shutter assembly 602 are included in the toner cartridge 502. The stirring member 52 is disposed to be rotatable on an inner side of the container portion 51. Although not shown in the FIGS., the stirring member 52 stirs developer G housed in the container portion 51 (as shown in FIG. 2) through the appropriate rotation, and transports developer G to the tapered portion 53 by gravity. The tapered portion 53 is provided on the bottom surface side of the container portion 51 (opposite direction to the direction Y). The size of the tapered portion 53 gradually decreases from the inside towards the outside direction of the container portion 51. The discharge path 54 is formed on the fore end side of the tapered portion 53 (lower side of FIG. 3 as viewed from the front side), and placed sequentially to the tapered portion 53 while the bottom surface of the container portion 51 is opened. The discharge outlet 55 is formed on one end of the discharge path 54 and having an aperture to discharge developer G housed in the container portion 51, that is, the toner cartridge 502. The screw conveyor 56 is disposed to be rotatable inside the discharge path 54 (not shown clearly in the FIGS.), and transports developer G in the discharge path 54 towards the discharge outlet 55 side.

The shutter assembly 602 is provided so as to slide the bottom-side outer wall of the container portion 51 (toner cartridge 502). In a default position, the shutter assembly 602 faces and covers the discharge outlet 55 (refer to FIG. 16). The shutter assembly 602 slides the surface of the bottom-side wall section of the container portion 51 (toner cartridge 502), so as to open the discharge outlet 55 (refer to FIG. 3), when the toner cartridge 502 is inserted to the toner-supply device 43. The configuration and operation of the shutter assembly 602 will be described in detail later.

The toner cartridge 502 is inserted into the toner-supply device 43 by a slide-motion from the front side towards the internal side of the image-forming apparatus 102 (refer to arrow A1 in FIG. 3). At this time, the discharge outlet 55 opens through the slide-motion of the shutter assembly 602 on the back end surface of the container portion 51. Herein, although not shown in the FIGS., each stirring member 52 and screw conveyor 56 is connected to a stirring-drive coupling (refer to numeral 301 in FIGS. 10A to 10E, later described) and a transporting-drive coupling provided with the toner-supply device 43. Then, in the container portion 51, developer G housed therein (not shown) is stirred by the stirring member 52 and moves to the tapered portion 53 which is provided on the bottom-surface side, by gravity. Subsequently, developer G is collected in the discharge path 54 adjacent to the tapered portion 53, and transported to the discharge outlet 55 through the rotation of the screw conveyor 56 provided with the discharge path 54. Thereby, developer G is discharged to the outer side through the discharge outlet 55, and reaches the toner-supply device 43.

A temporary toner chamber 44 is included in the toner-supply device 43. The developer G discharged from the discharge outlet 55 of the container portion 51 (toner cartridge 502) drops in the temporary toner chamber 44 by its own weight. A toner-detecting sensor 45 and a rotatable cleaning member 46 are provided with the temporary toner chamber 44. The toner-detecting sensor 45 is configured by a piezoelectric sensor and the like, and detects whether the temporary toner chamber 44 contains developer G or not. Although not clearly shown in the FIGS., the rotatable cleaning member 46 is configured by a flexible cleaning member composed of a PET (polyethylene terephthalate) film and the like with the surface of a rotary shaft member. The rotatable cleaning member 46 cleans developer G which is adhered to a not-shown detecting surface of the toner-detecting sensor 45 via the rotation of the rotary-shaft member through a driver disposed in the toner supply device 43.

A toner transport tube 47 is connected to the bottom surface of the temporary toner chamber 44. Developer G which is delivered to the temporary toner chamber 44 is sent into the toner transport tube 47 by its own weight. The front end portion of toner transport tube 47 is connected to the developing device 23 in a process unit mounted in the printer body. Developer G in the toner transport tube 47 is sent toward the developing device 23 corresponding to a rotation of a not-shown rotatable transporting member such as a screw or an auger screw provided inside the toner transport tube 47. Thereby, developer G discharged from the toner cartridge 502 is supplied to the developing device 23.

A not-shown controller in the image-forming apparatus 102 estimates "toner-end" of the container portion 51 when the toner-detect signal is not sent from the toner-detecting sensor 45, even if the stirring member 52 and the screw conveyor 56 in the toner cartridge 502 are rotating. Herein, "inside the container portion 51" includes "inside the toner cartridge 502", and "toner-end" means a condition in which almost all the contained developer G is used up. Even if the "toner-end" is detected, developer G still remains in the toner transport tube 47 actually, so developer G can be supplied for a while without refilling a new toner cartridge 502. As described, because the toner-end can be detected in the container portion 51 (toner cartridge 502) according to the amount of developer G in the temporary toner chamber 44, the timing of toner-end can be detected appropriately, without providing a toner-detecting sensor with the toner cartridge 502.

Descriptions are given below of the toner cartridge 502 (502Y, 502M, 502C, 502BK), the image-forming apparatus 102 accommodating the toner cartridge 502, and the toner-container fixing portion 902 in the image-forming apparatus 102 with reference to FIGS. 4 to 23.

Figure 4:
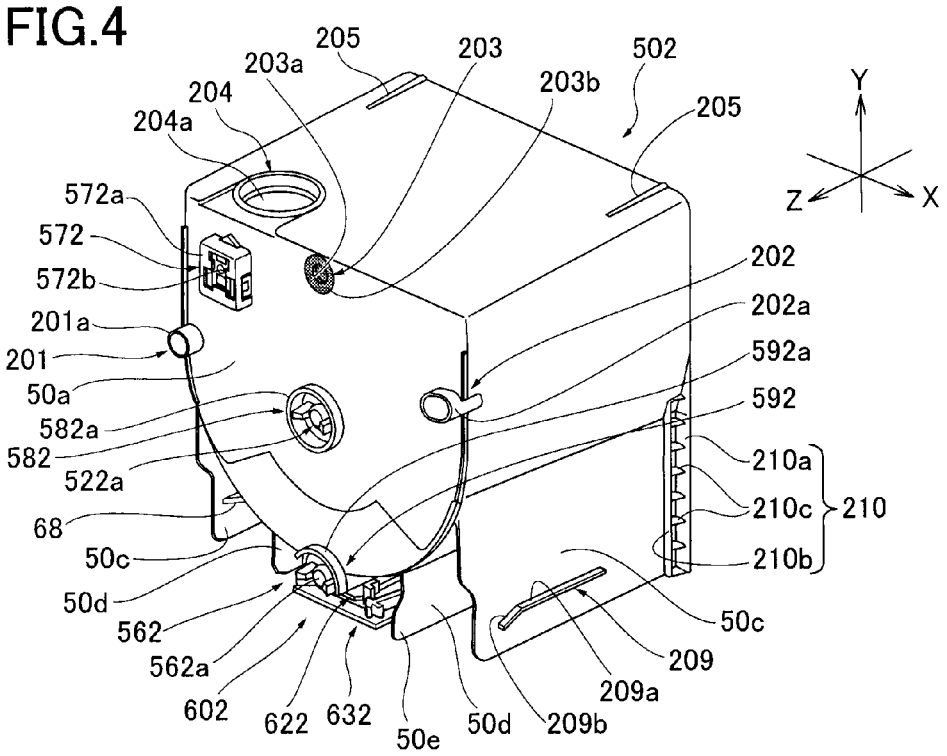
FIG. 4 provides a perspective view of the toner cartridge 502 as viewed from the top front side (in direction Z).
Figure 5:
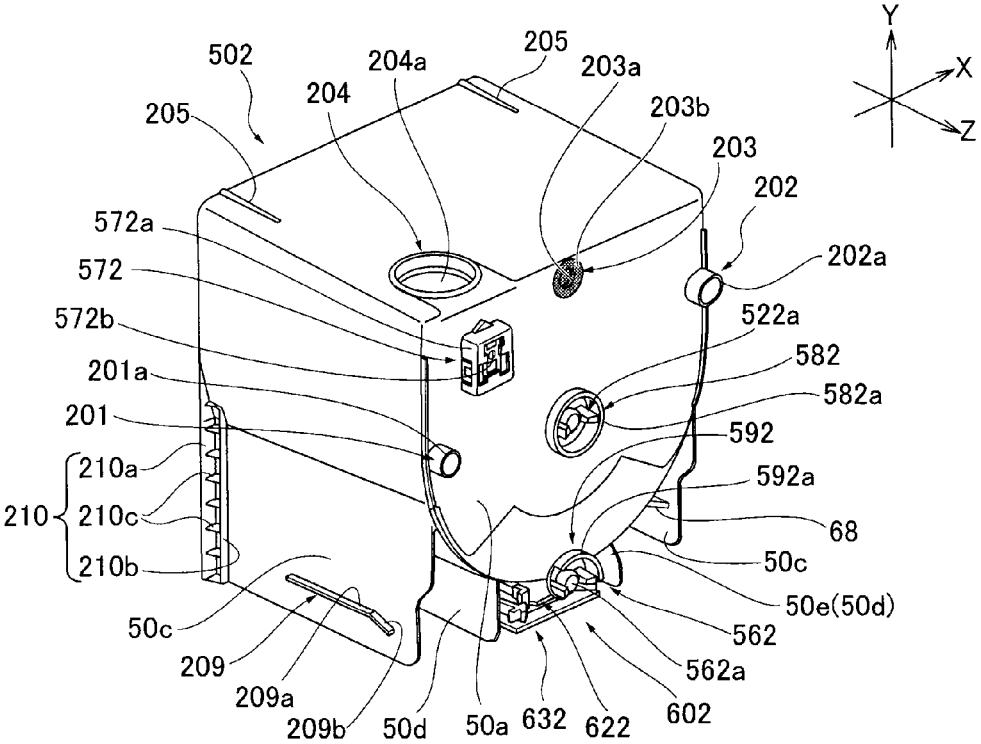
FIG. 5 provides a perspective view of the toner cartridge 502 as viewed from the top front side and in a direction which is different from that of FIG. 4 in the left and right direction.
Figure 6:
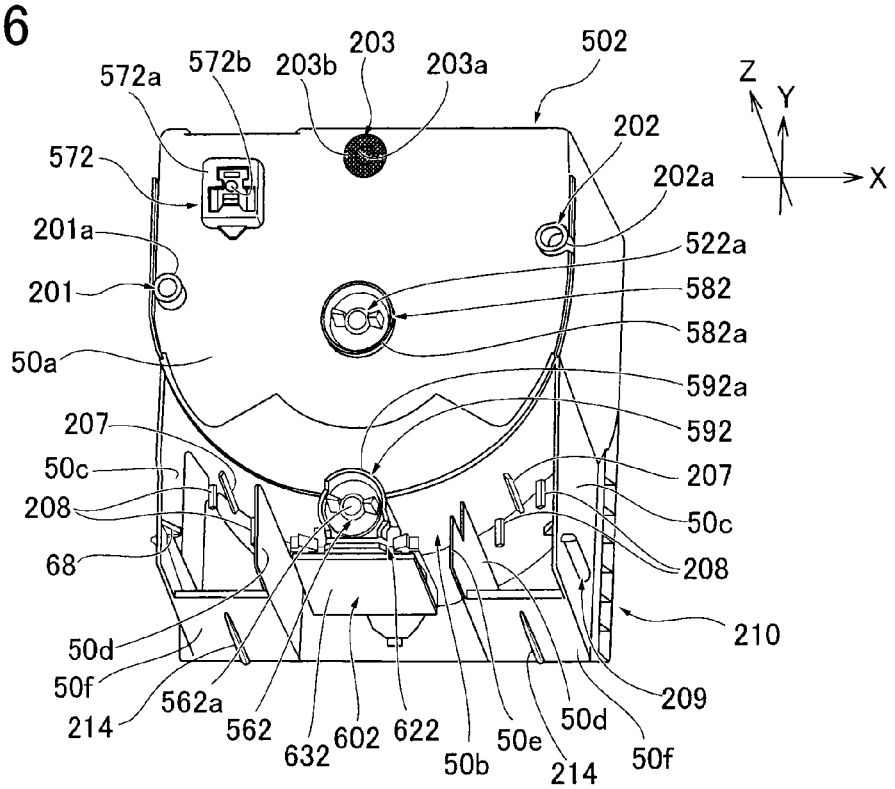
FIG. 6 provides a perspective view of the toner cartridge 502 as viewed from the bottom front side (in direction Z).
Figure 7:
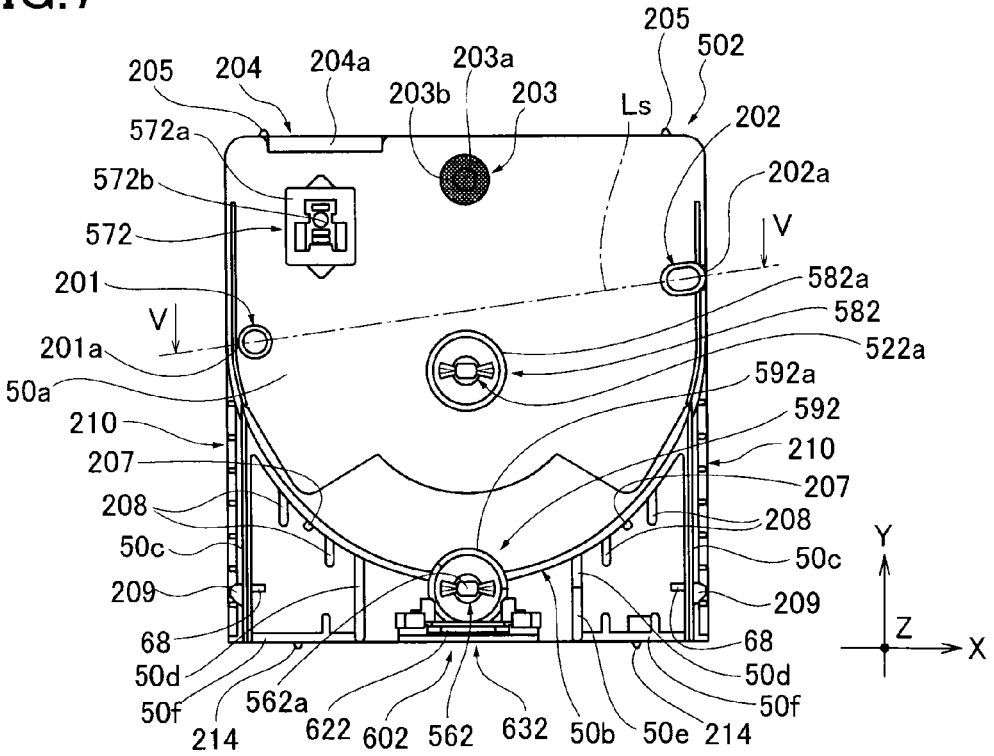
FIG. 7 provides a front view of the toner cartridge 502 as viewed from the front side.
Figure 8:
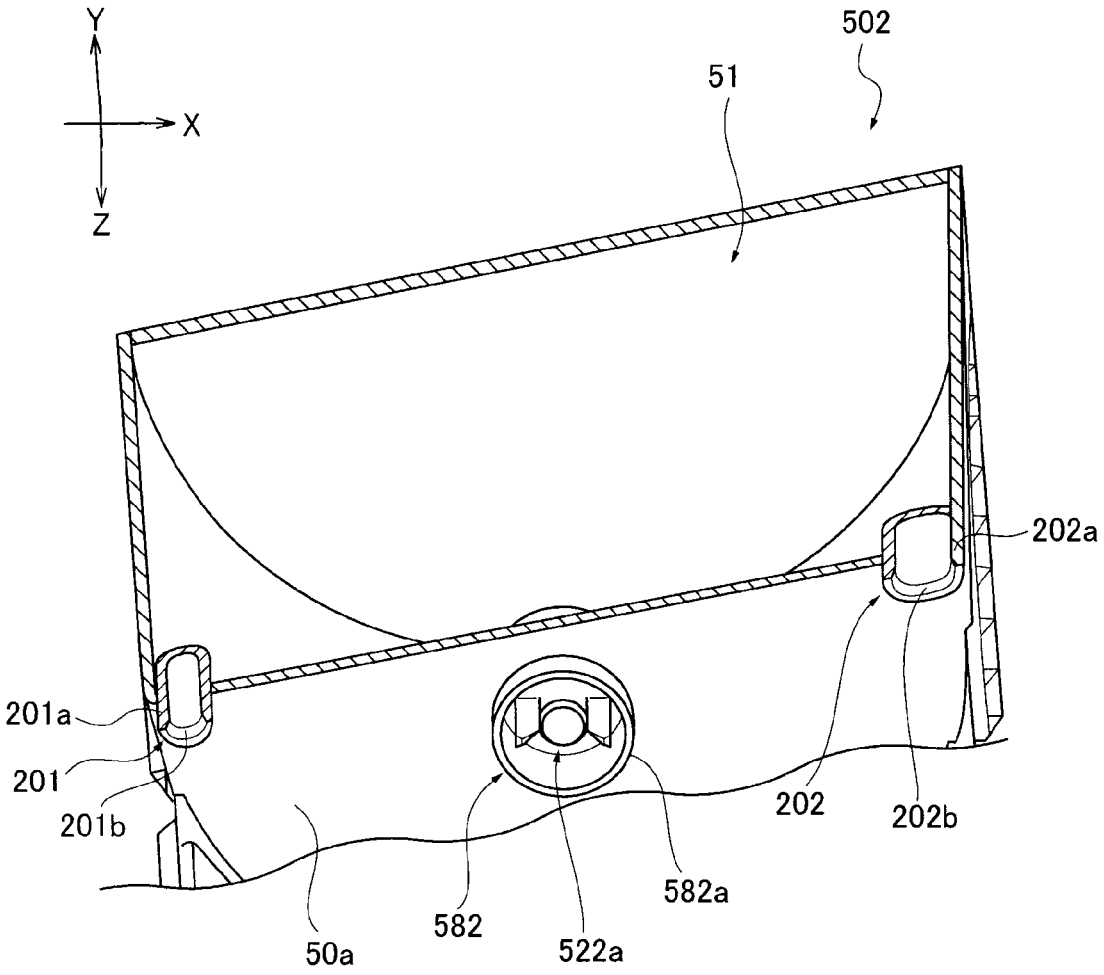
FIG. 8 provides a perspective view of the toner cartridge 502 as viewed from the top front side, illustrating a partial cross-sectional view along the V-V line shown in FIG. 7 (in direction Z including the V-V line section).
Figure 9A:
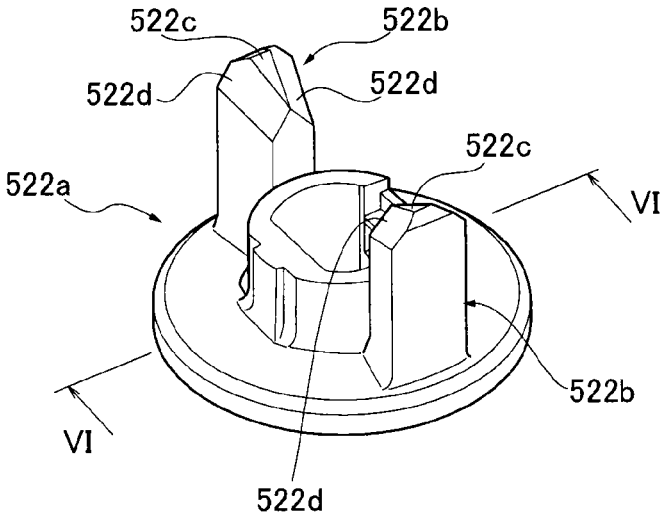
FIGS. 9A to 9C provide explanatory views illustrating a configuration of a coupling 522*a* in a stirring member 52 shown in FIG. 8.
Figure 9B:
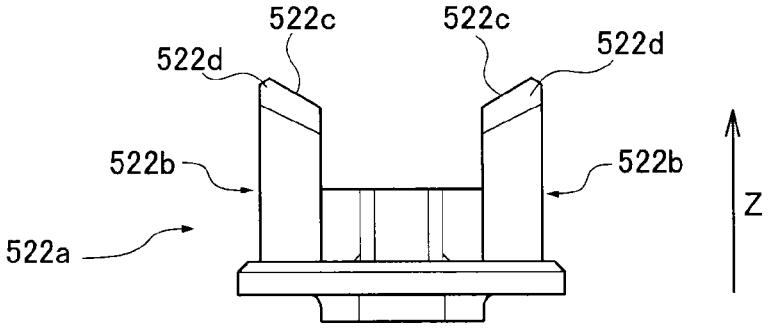
Figure 9C:
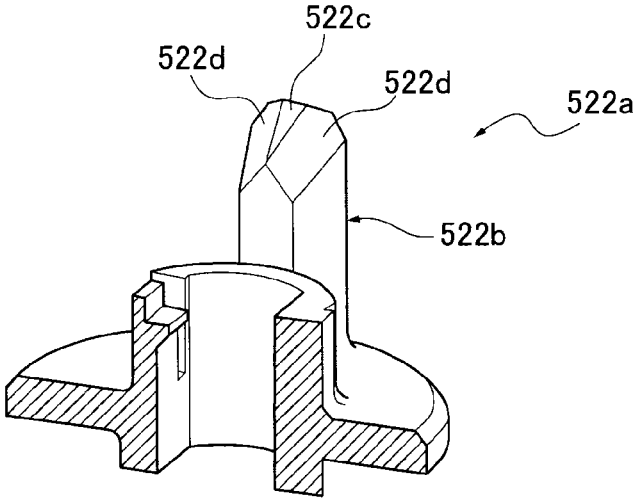

FIG. 4 is a perspective view of the toner cartridge 502 according to the Embodiment as viewed from the top front side (direction Z). FIG. 5 is a perspective view of the toner-cartridge 502 as viewed from the top front side and from a different direction than that of FIG. 4 in the left and right direction. FIG. 6 is a perspective view of the toner cartridge 502 as viewed from the bottom front side (direction Z). FIG. 7 is a front view of the toner cartridge 502 as viewed from the front side. FIG. 8 is a perspective view of the toner cartridge 502 as viewed from the top front side, illustrating a partial cross-sectional view along the V-V line shown in FIG. 7 (direction Z surface including the V-V line section). FIGS. 9A to 9C are explanatory views illustrating a configuration of a coupling 522*a* in the stirring member 52 shown in FIG. 8. FIG. 9A is a perspective view showing the coupling 522*a* as viewed from the front side (direction Z). FIG. 9B is a side view of the coupling 522*a* (opposite to the direction Z). FIG. 9C is a cross-sectional view showing the coupling 522*a* along the VI-VI line shown in FIG. 9A.

Figure 10A:
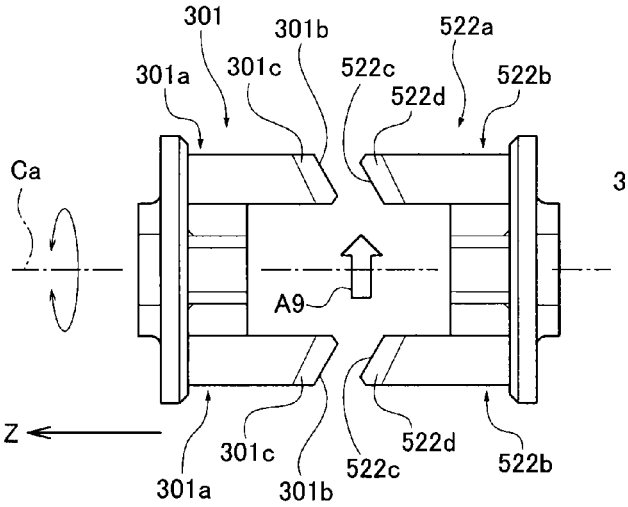
FIGS. 10A to 10E provide explanatory views illustrating the configuration and function of the coupling 522*a* in the stirring member 52, and a stirring-drive coupling 301 of the toner-supply device 43.
Figure 11:
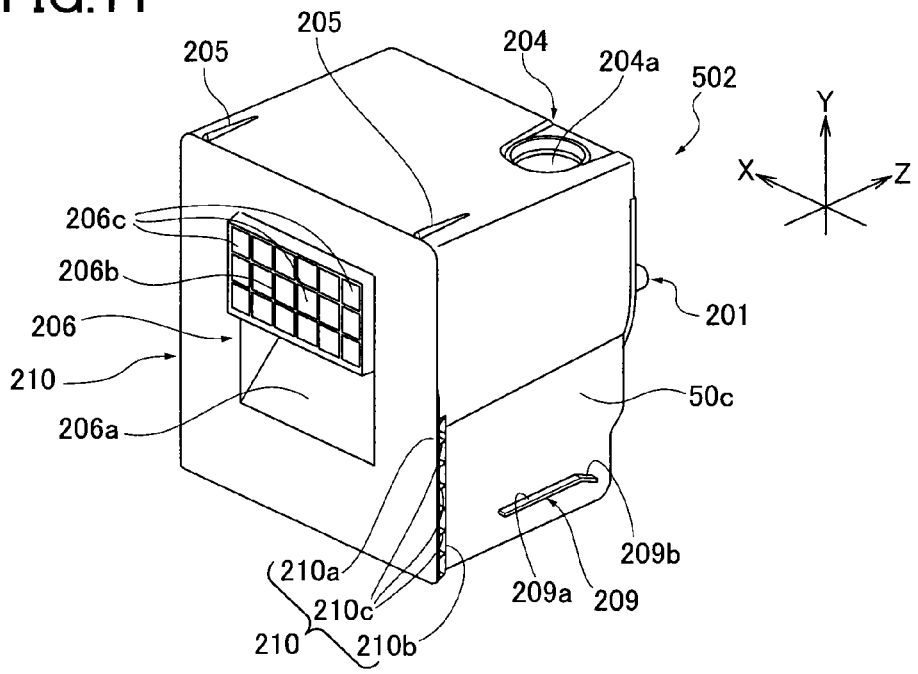
FIG. 11 provides a perspective view illustrating the toner cartridge 502 as viewed from the top rear side (opposite to direction Z).
Figure 12:
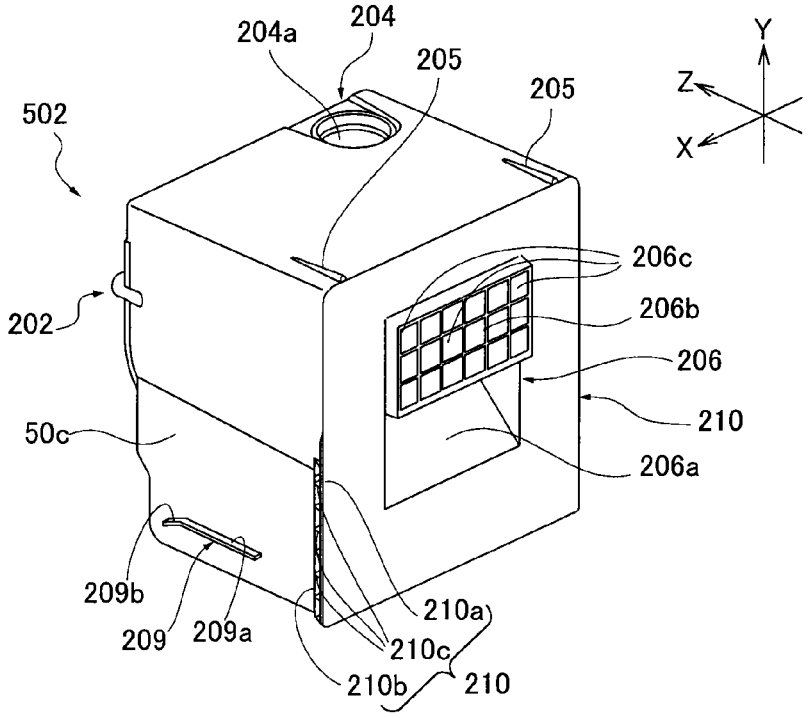
FIG. 12 provides a perpendicular view illustrating the toner cartridge 502 as viewed from the top rear side in a direction different from that of FIG. 11 in the right and left direction.
Figure 13:
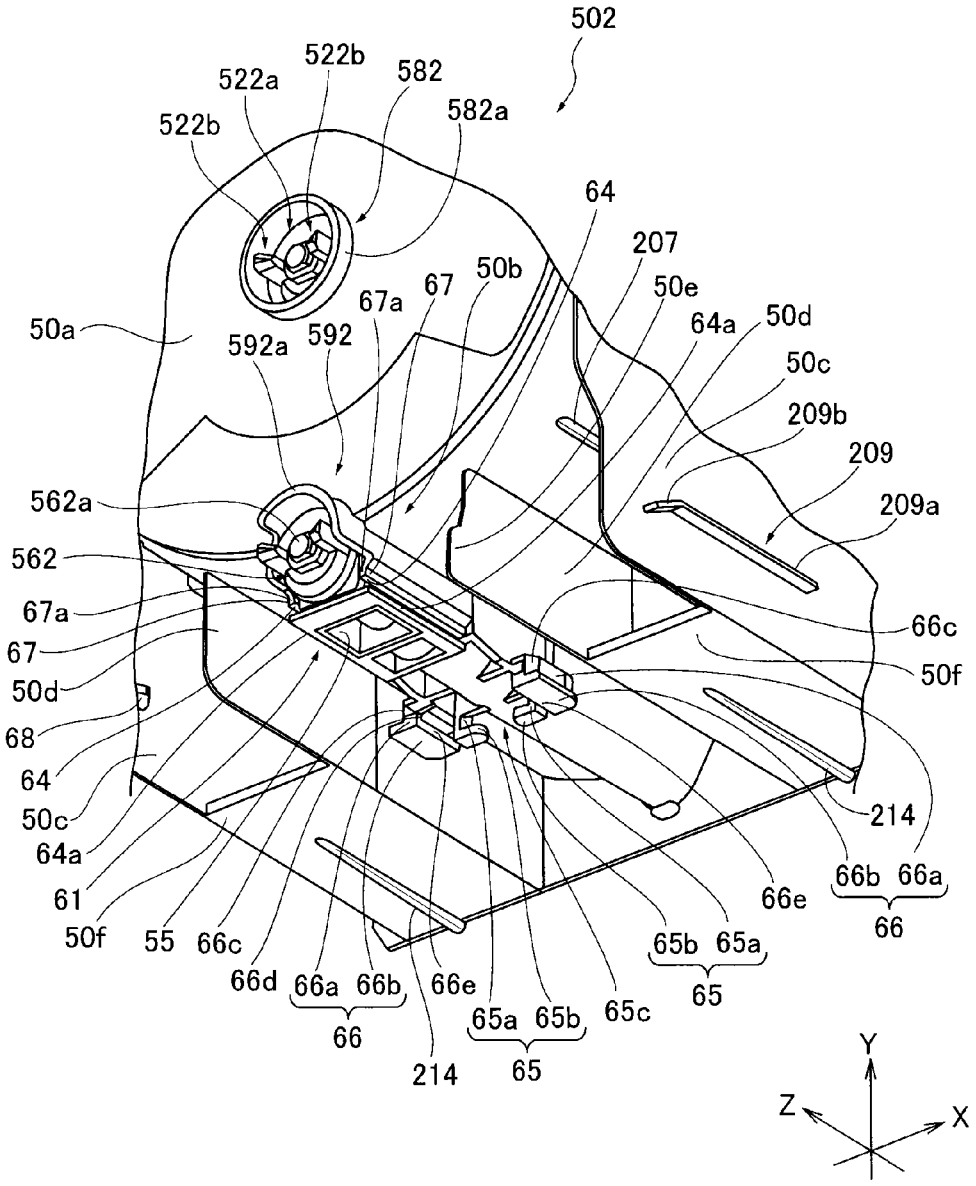
FIG. 13 provides a perspective view illustrating a partially enlarged bottom-aspect of the toner cartridge 502.
Figure 14:
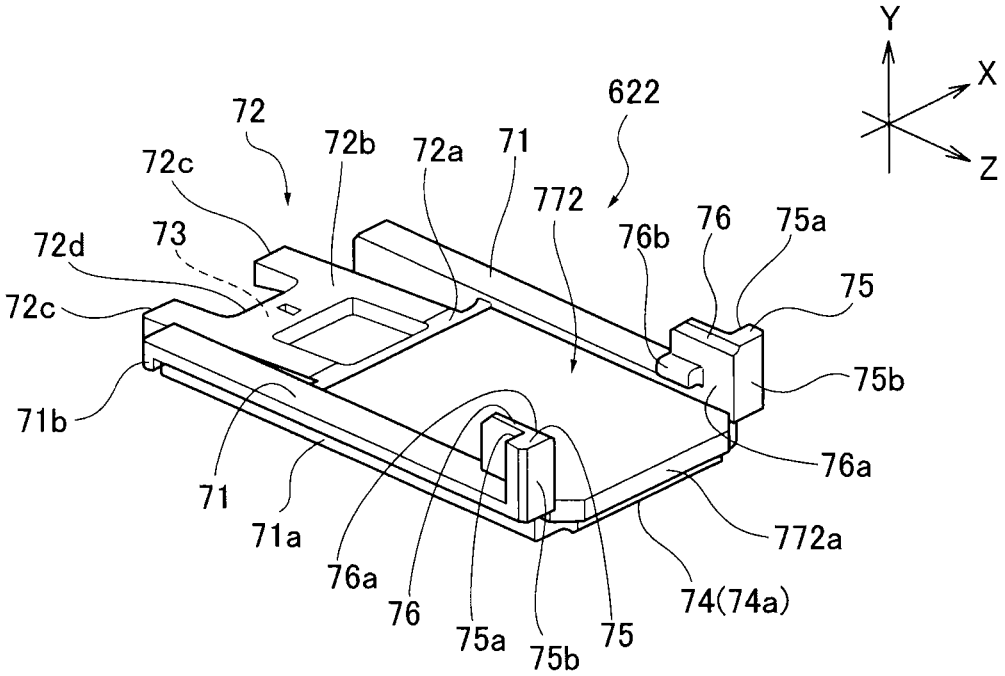
FIG. 14 provides an explanatory view illustrating a configuration of a first shutter 622 provided in a shutter assembly 602 of the toner cartridge 502.
Figure 15B:
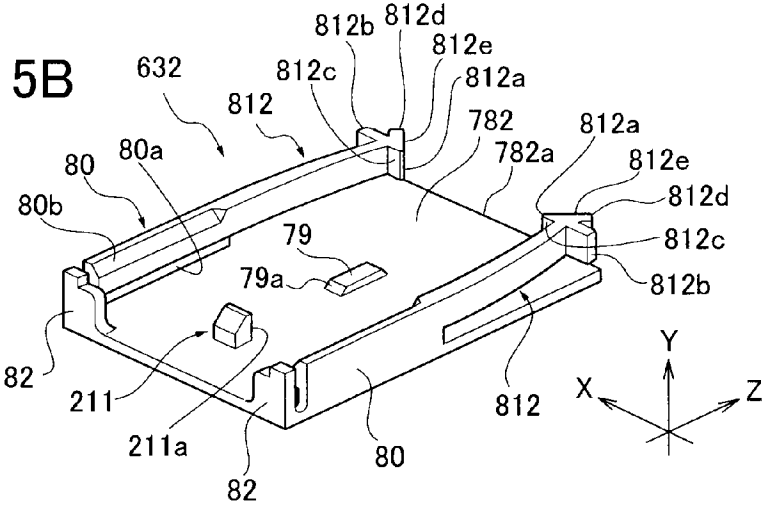
FIGS. 15A to 15C provide explanatory views illustrating a configuration of a second shutter 632 in the shutter assembly 602.
Figure 15C:
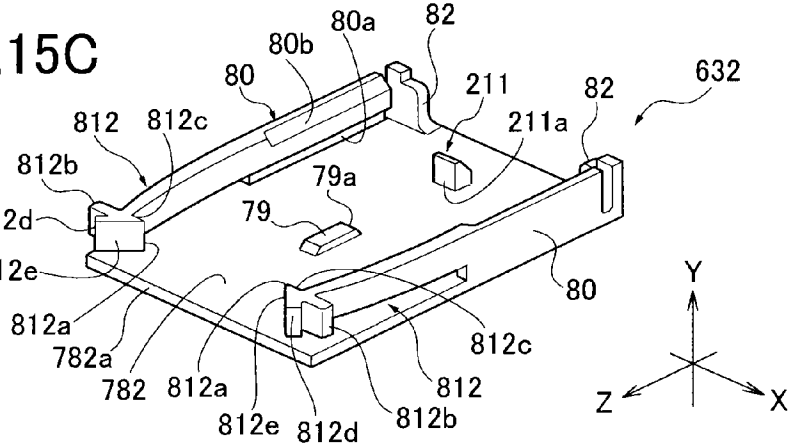
Figure 15A:
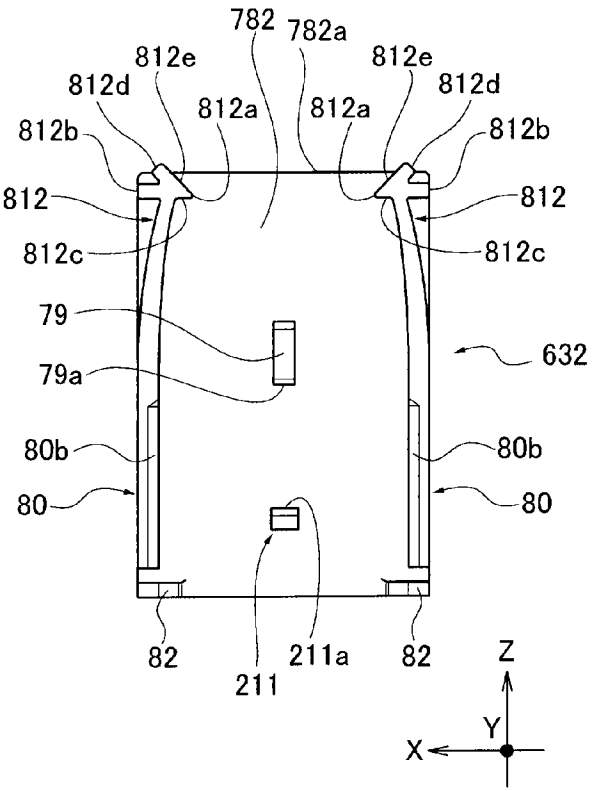

FIG. 10 is an explanatory view illustrating a configuration and operation of the coupling 522*a* of the stirring member 52 and a stirring-drive coupling 301 provided in the toner-supply device 43. FIG. 10A schematically illustrates a state of the stirring-drive coupling 301 and the coupling 522*a* as viewed from an orthogonal direction to the Z axis. FIG. 10B schematically illustrates a state of a hook protrusion 301*a* of the stirring-drive coupling 301 and a hook protrusion 522*b* of the coupling 522*a* as viewed from a direction of an arrow A9 shown in FIG. 10A. FIG. 10C illustrates a state in which the coupling 522*a* and the stirring-drive coupling 301 move relatively by a guide function of an inclination surface 301*c* of the hook protrusion 301*a* and an inclination surface 522*d* of the hook protrusion 522*b*. FIG. 10D illustrates a state in which the stirring-drive coupling 301 and the coupling 522*a* are connected with each other. FIG. 10E illustrates a configuration in which an inclination 522*f* is provided on an end portion 522*c* on a protruding side of a pair of hook protrusions 522*b* and an inclination 301*d* is provided on the protruding end portion 301*b* of a pair of hook protrusions 301*a*. Similar to FIG. 10C, FIG. 10E also shows a state in which the coupling 522*a* and the stirring-drive coupling 301 move relatively. FIG. 11 is a perspective view illustrating a state of the toner cartridge 502 as viewed from an upper rear side (negative direction to the Z-axis). FIG. 12 is a perspective view of the toner cartridge 502 as viewed from the upper rear side and a direction which is different from a crosswise direction of FIG. 11. FIG. 13 is a partially-enlarged perspective view illustrating a bottom surface of the toner cartridge 502. FIG. 14 is an explanatory view illustrating a configuration of a first shutter 622 provided in the shutter assembly 602 of the toner cartridge 502. FIGS. 15A to 15C are explanatory views illustrating a configuration of a second shutter 632 in the shutter assembly 602. FIG. 15A shows a front view of the second shutter 632 as viewed from the top side. FIG. 15B shows a perspective view of the second shutter 632 as viewed from the top side and the backward side of the inserting direction (opposite to the direction Z). FIG. 15C shows a perspective view of the second shutter 632 as viewed from the top side and the forward side of the inserting direction.

Figure 16:
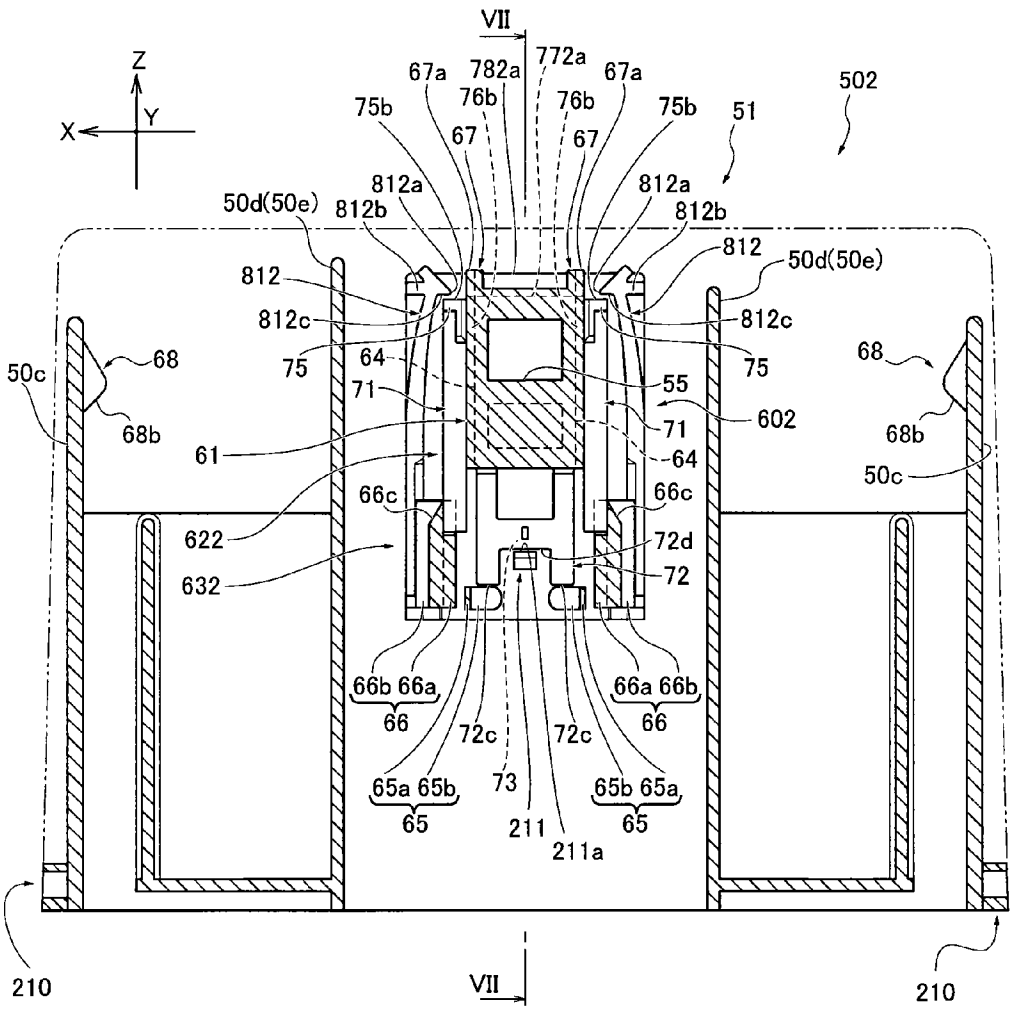
FIG. 16 provides an explanatory view illustrating a configuration of the shutter assembly 602 comprised of the first shutter 622 and the second shutter 632 incorporated with the bottom surface of a container portion 51 (toner cartridge 502).
Figure 17:
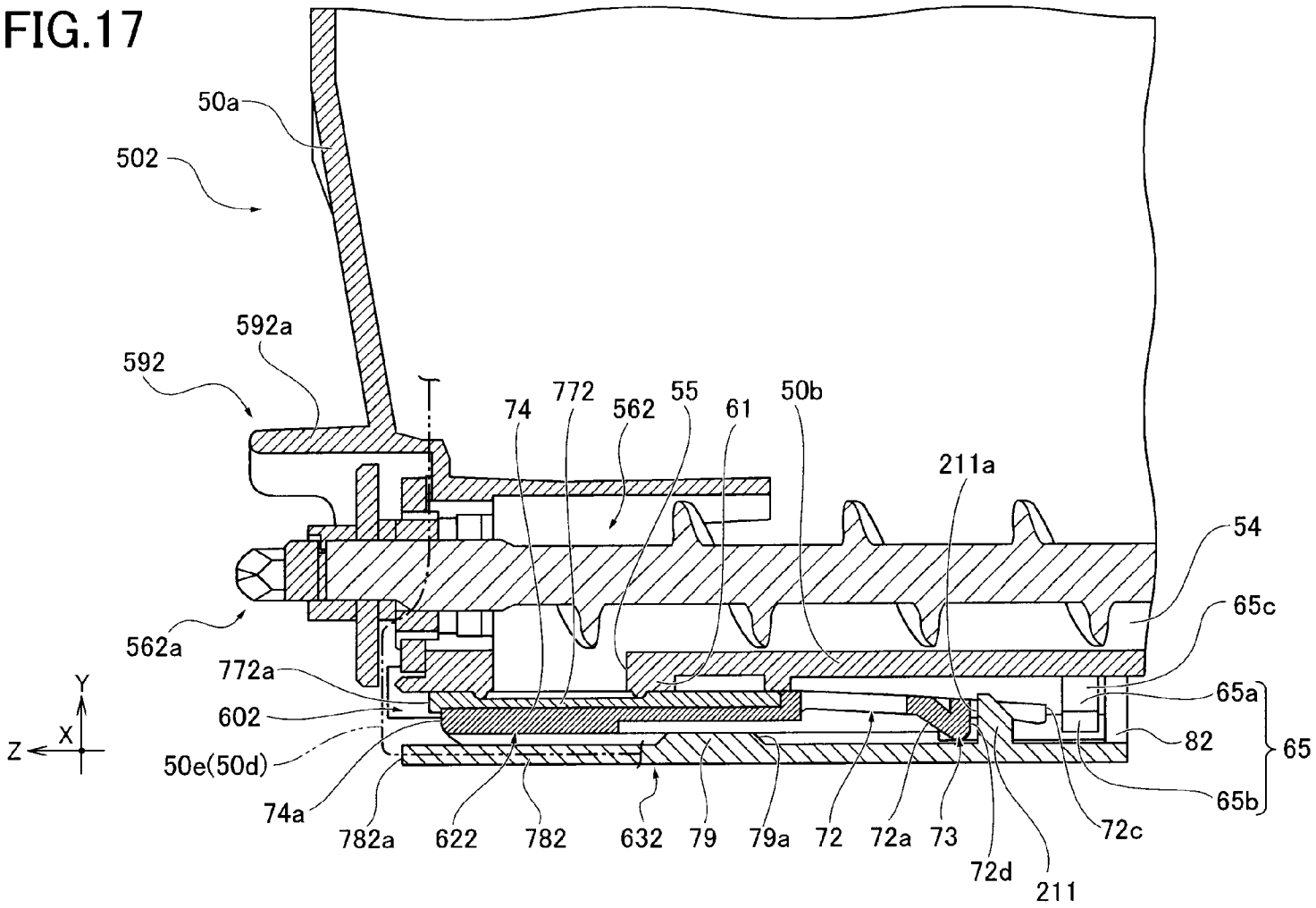
FIG. 17 provides an explanatory view of the container portion 51 shown in FIG. 3, illustrating a cross-sectional view along the VII-VII line (Y-Z plan surface of including VII-VII line section in FIG. 16).
Figure 18:
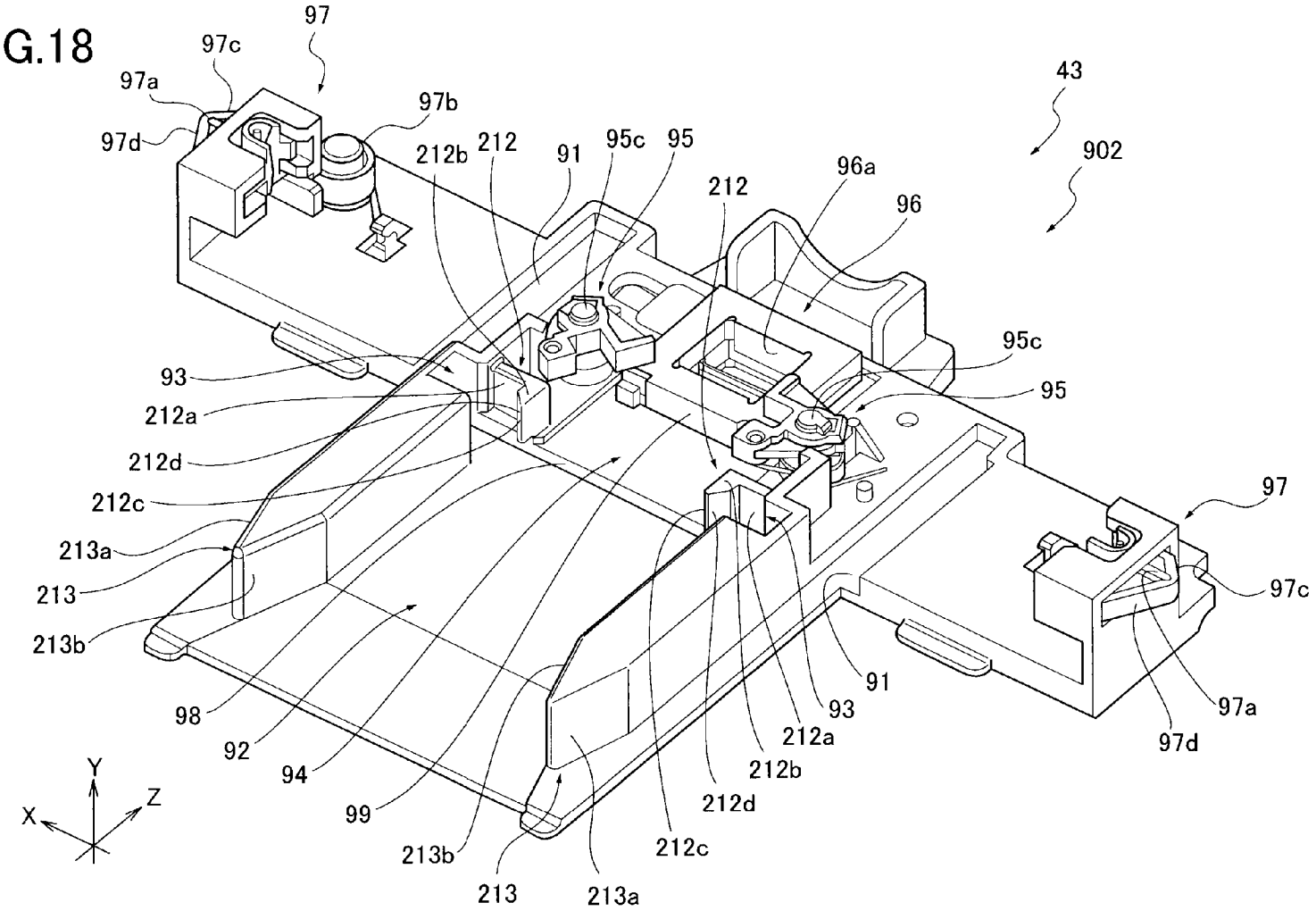
FIG. 18 provides a perspective view of a toner-container fixing portion 902 of the toner-supply device 43.
Figure 19:
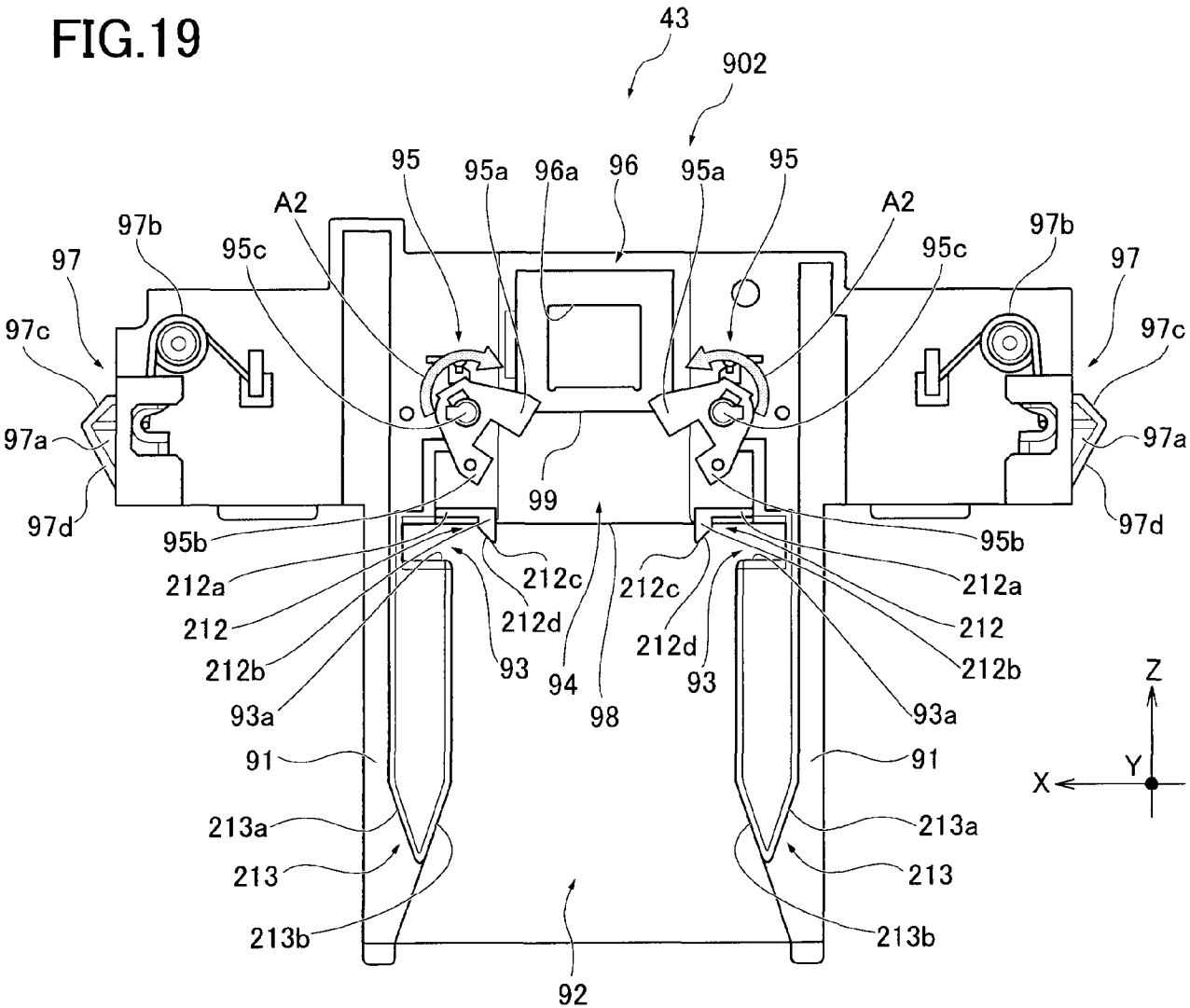
FIG. 19 provides a front view of the toner-container fixing portion 902 as viewed from the top side (direction Y).
Figure 20:
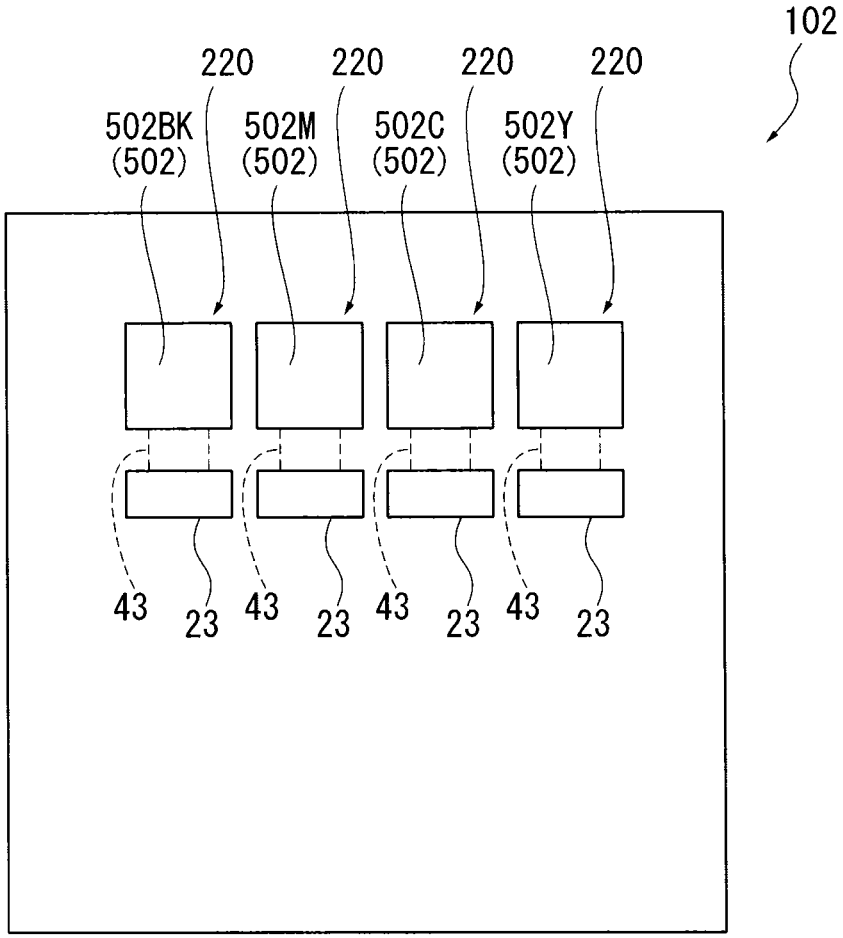
FIG. 20 provides an explanatory view schematically illustrating an image-forming apparatus 102.
Figure 21A:
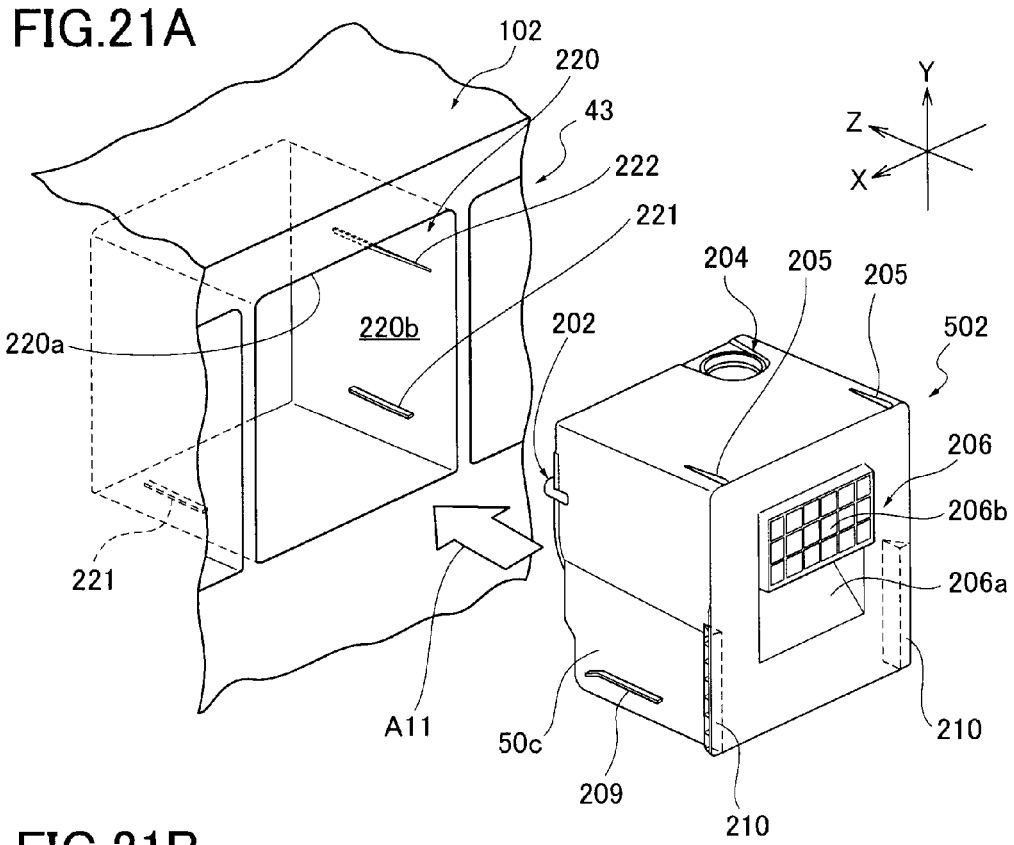
FIGS. 21A to 21B provide explanatory views illustrating a relationship between a container mount 220 (toner-container fixing portion 902) of the image-forming apparatus 102 and the toner cartridge 502.
Figure 21B:
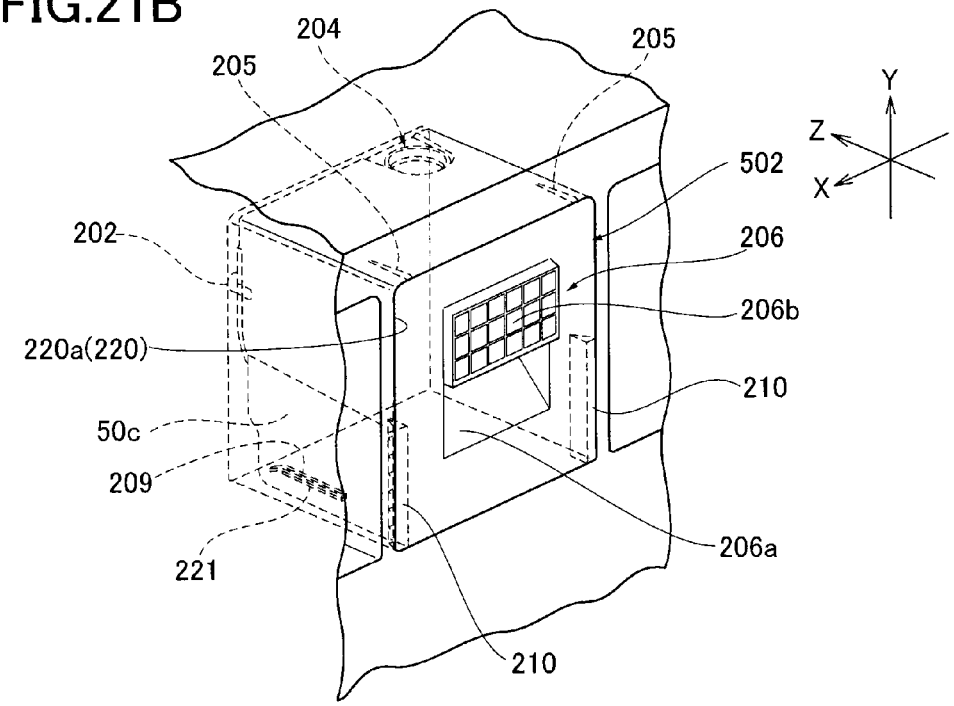
Figure 22:
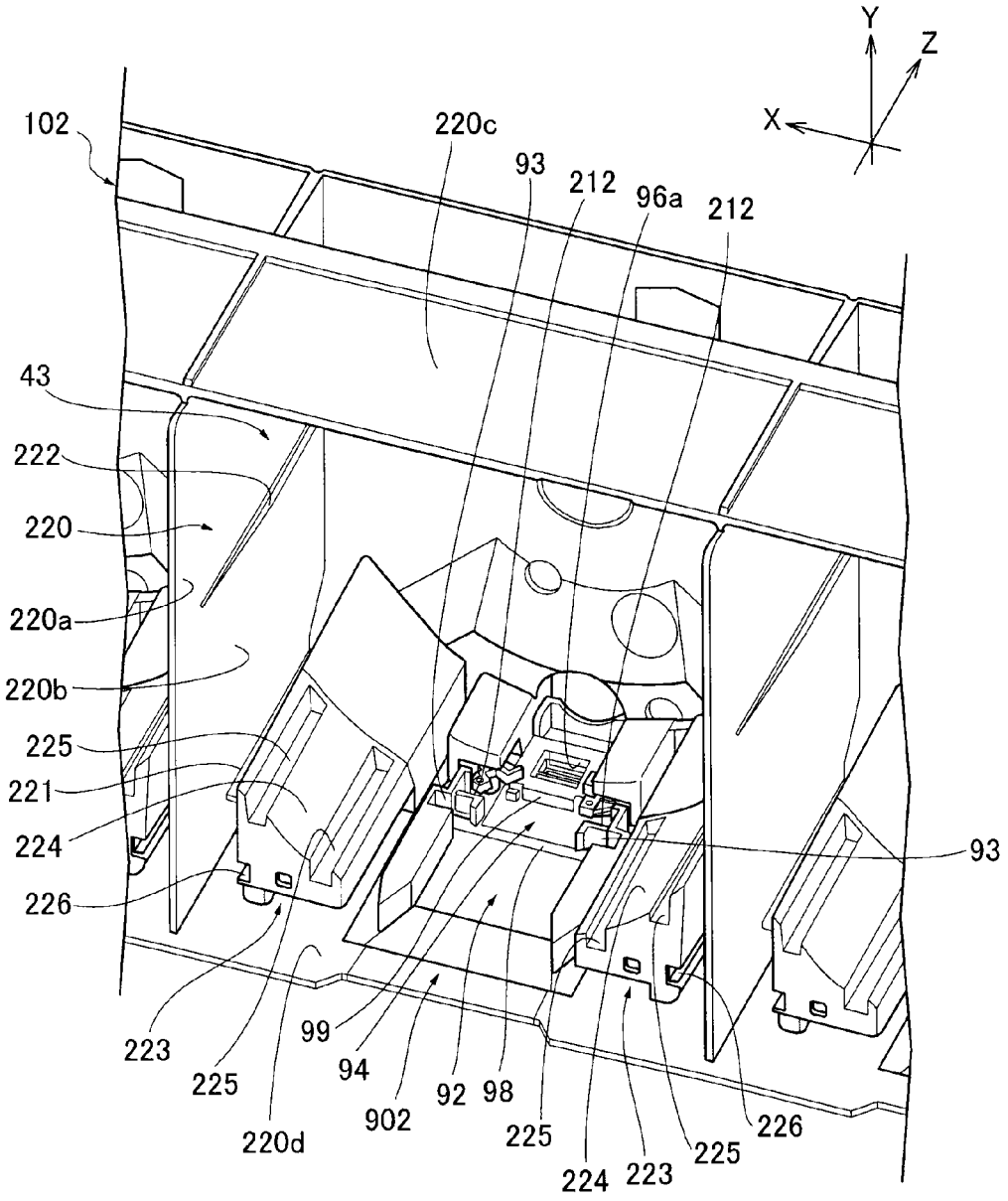
FIG. 22 provides a perspective view illustrating a configuration of the container mount 220 (toner-container fixing portion 902).
Figure 23A:
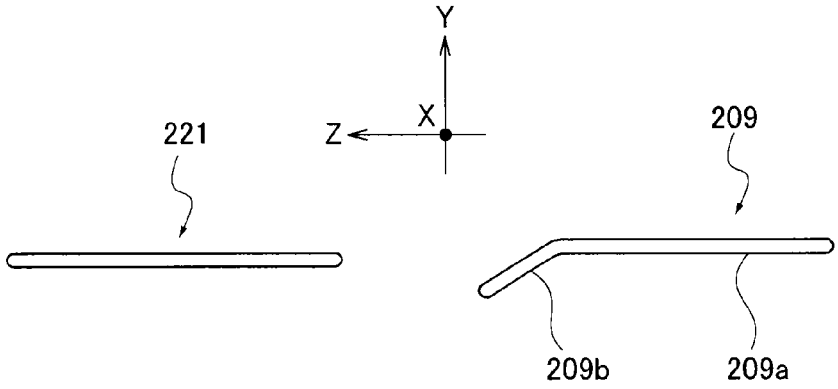
FIGS. 23A to 23C provide explanatory views illustrating functions of a holding rail 209 in a side wall section 50*c* of the toner cartridge 502, and a holding rail 221 of the container mount 220.
Figure 23B:
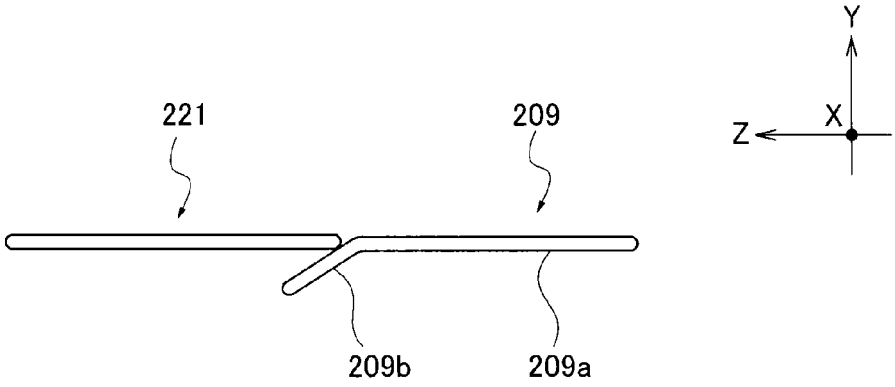
Figure 23C:
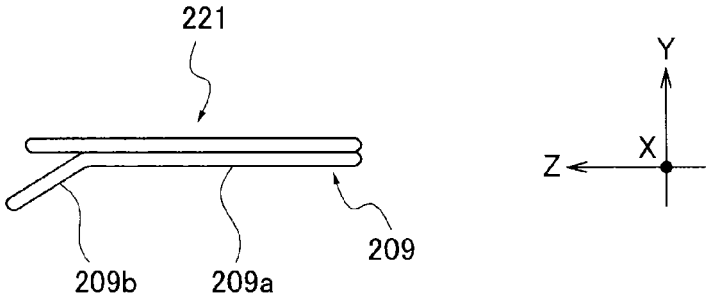

FIG. 16 is an explanatory view illustrating a configuration of the shutter assembly 602 comprised of the first shutter 622 and the second shutter 632 incorporated with the bottom surface of the container portion 51 (toner cartridge 502). FIG. 17 is an explanatory view of the container portion 51 shown in FIG. 3, illustrating a cross-sectional view along the VII-VII line (Y-Z plane including VII-VII line section). FIG. 18 is a perspective view of the toner-container fixing portion 902 of the toner-supply device 43. FIG. 19 is a front view of the toner-container fixing portion 902 as viewed from the top side (direction Y). FIG. 20 is an explanatory view schematically illustrating the image-forming apparatus 102. FIGS. 21A to 21B are explanatory views illustrating a relationship between the container mount 220 (toner-container fixing portion 902) of the image-forming apparatus 102 and the toner cartridge 502. FIG. 21A illustrates an aspect while inserting the toner cartridge 502 in the container mount 220. FIG. 21B illustrates an aspect in which the toner cartridge 502 is inserted into the container mount 220. FIG. 22 provides a perspective view illustrating a configuration of the container mount 220 (toner-container fixing portion 902). FIGS. 23A to 23C are explanatory views illustrating functions of a holding rail 209 in a side wall section 50*c* of the toner cartridge 502, and a holding rail 221 of the container mount 220. FIG. 23A illustrates an aspect in which the holding rail 209 faces the holding rail 221 in the Z-axis direction. FIG. 23B illustrates an aspect in which the holding rail 209 contacts the holding rail 221. FIG. 23C illustrates an aspect in which the holding rail 209 overlaps the holding rail 221 in the Y-axis direction.

In FIG. 8, an inner side configuration of the container portion 51 (toner cartridge 502) and the portions other than the coupling 522*a* in the stirring member 52 are omitted. FIG. 20 illustrates the developing device 23 in the image-forming apparatus 102, the toner-supply device 43, the container mount 220, and each toner cartridge 502 (502Y, 502M, 502C, 502BK) to be inserted in the container mount 220 in a simple manner. Configurations other than the above are omitted. In addition, in FIGS. 21A and 21B, to simplify description, each component in the container mount 220 and the toner-container fixing portion 902 is emphasized at the same time as being simplified, and does not always fit the actual configurations or the other FIGS.

As shown in FIGS. 4 to 8, the toner cartridge 502 has a box shape as a whole. The container portion 51 (refer to FIG. 8) is included in the toner-cartridge 502. In the toner-cartridge 502 (container portion 51, therein), an electronic substrate 572, a coupling aperture 582, a first positioning hole 201 and a second positioning hole 202, and a supply/exhaust port 203 are provided on the front end surface 50*a* (direction Z).

The outer side of the electronic substrate 572 is covered with a substrate cover 572*a*. The electronic substrate 572 can move inside the substrate cover 572*a* along the X-Y plane surface. A position-adjustment hole 572*b* is formed in the center of the electronic substrate 572. A position-adjustment protrusion provided in the later-described container mount 220 (refer to FIG. 22) can fit into the position-adjustment hole 572*b* in the Z-axis direction. The size of the position-adjustment hole 572*b* is arranged so as to fit the position-adjustment protrusion in a direction along the X-Y plane when the position-adjustment protrusion fits into the position-adjustment hole 572*b*. When the position-adjustment protrusion fits into the position-adjustment hole 572*b*, a position of a later-described communication substrate which is disposed in the container mount 220 of the toner-supply device 43 (refer to FIG. 22) locates on an appropriate position in the electronic substrate 572. Such a position is appropriate herein because a contact terminal which is provided with the communication substrate is able to contact appropriately with the electronic substrate 572 (contact terminal provided therein). Similarly, a condition in which a connection (data exchange) between the communication substrate and the electronic substrate 572 can be established appropriately through both contact terminals is appropriate herein. Thus, the information exchange via a connection can be achieved between the electronic substrate 572 and the image-forming apparatus 102 (refer to FIG. 20) including the controller, through the communication substrate disposed in the toner-supply device 43, when the position-adjustment protrusion fits into the position-adjustment hole 572*b*. The position-adjustment protrusion is provided in relation to the position of a first positioning pin 951 (refer to FIG. 29) which is provided corresponding to the position of the first positioning hole 201 as a basic position, in the toner-supply device 43. When the toner cartridge 502 is inserted appropriately into the toner-supply device 43, the electronic substrate 572 locates the appropriate position. Thus, the electronic substrate 572 (and position-adjustment hole 572*b* thereof) is provided with the toner-cartridge 502 (front end surface 50*a* thereof, direction Z) in the position corresponding to the first positioning hole 201 as standard.

The coupling 522*a* of the stirring member 52 provided inside the container portion 51 exteriorizes towards the front side (direction Z) of the container portion 51 through the coupling aperture 582. The configuration of the coupling 522*a* will be described in detail later. A guard wall section 582*a* is provided with the coupling aperture 582 surrounding the aperture in which the coupling 522*a* can be exteriorized. The guard wall section 582*a* is formed so as to protrude from the front surface of the toner cartridge 502 (container portion 51) towards the forward side in the direction Z. The guard wall section 582*a* surrounds the coupling 522*a* which exteriorizes from the coupling aperture 582 in the perpendicular direction to the Z-axis. Thus, the coupling aperture 582 can be prevented from contacting with the coupling 522*a* in the opposite direction to the direction Z by the guard wall section 582*a*. Therefore, the coupling 522*a* can be protected. The coupling aperture 582 (including coupling 522*a* of the stirring member 52) is arranged in the toner cartridge 502 (front end surface 50*a*, direction Z) according to the position of the first positioning hole 201 as the normal position.

The first positioning hole 201 is formed inside a first positioning-wall section 201*a* which has a cylindrical shape which extends in the direction Z in the front surface of the toner cartridge 502 (container portion 51). The first positioning-wall section 201*a* protrudes towards the direction Z from a front wall section which forms the front surface of the toner cartridge 502 (container portion 51), and protrudes from the front wall section (inner side of container portion 51) towards the opposite side of the direction Z, as shown in FIG. 8. The inside space of the first positioning-wall section 201*a* extending in the Z-axis direction is formed in a circle when viewing the cross-sectional surface from the opposite side of the direction Z (refer to FIG. 7). Therefore, the first positioning hole 201 is formed in a circle when viewing its cross-sectional surface from a perpendicular direction of the direction Z. The first positioning hole 201 extends in the direction Z.

The first positioning-wall section 201*a* contacts the internal side surface of the container portion 51 (that is, inside container portion 51 of toner cartridge 502). The overall section in the direction Z of the first positioning-wall section 201*a* which is inside the container portion 51 contacts the internal side surface of the toner cartridge 502 (container portion 51). In addition, an inclination-surface section 201*b* is provided on an end part of the first positioning-wall section 201*a* in the direction Z. The inclination-surface section 201*b* inclines so that the internal space, that is, the inner diameter of the first positioning hole 201 gradually becomes larger towards the direction Z.

The later-described first positioning pin 951 (refer to FIG. 29) provided with the container mount 220 (refer to FIG. 22) in the toner-supply device 43 can fit into the first positioning hole 201 in the direction Z. The first positioning pin 951 has a column shape extending in the direction Z. The size of the first positioning pin 951 is arranged so as to fit into the first positioning hole 201 in the direction along the X-Y plane upon insertion. Thereby, the direction of the toner cartridge 502 can match the direction Z of the toner-supply device 43 (later-described container mount 220 as shown in FIG. 22) by fitting the first positioning pin 951 into the first positioning hole 201. Because the inclination surface section 201*b* is provided on the front end portion of the first positioning hole 201 in the direction Z, it is easy to fit the first positioning pin 951 when the toner cartridge 502 is inserted into the later-described container mount 220 (toner-supply unit 43).

The second positioning hole 202 is formed inside a second positioning-wall section 202*a* which has a column-shape and extending in the direction Z on the front surface of the toner-cartridge 502 (container portion 51), as shown in FIGS. 4 to 8. The second positioning hole 202 is provided on the opposite side to the first positioning wall section 201*a* of the first positioning hole 201 in the left and right direction. As shown in FIG. 8, the second positioning-wall section 202*a* protrudes from the front wall section of the toner cartridge 502 (container portion 51) towards the forward side in the direction Z, and protrudes from the front wall section towards the opposite direction to the direction Z. In the inner space extending to the direction Z on the cross-sectional surface on the opposite side of the direction Z, a direction of the line LS (refer to FIG. 7), which connects the central position thereof and the central position of the first positioning wall section 201*a*, is longer. That is, the second positioning-wall section 202*a* has a semi-circular portion on each side in the direction of the line LS, and the second positioning wall section has a longer hole in the line LS direction. That is, the second positioning hole 202 has a longer hole in the direction of line LS when the cross-sectional surface thereof in the perpendicular direction to the Z-axis is viewed.

The second positioning wall section 202*a* contacts the internal side surface of the container portion 51 (that is, the toner cartridge 502) on the opposite side of the first positioning wall section 201*a* in the left and right direction. In the second positioning wall section 202*a*, the overall section in the direction Z inside the container portion 51 contacts the inside surface of the toner cartridge 502 (container portion 51). In addition, an inclination wall section 202*b* is provided with the second positioning wall section 202*a* on an end portion thereof in the direction Z. The inclination wall section 202*b* is arranged so as to expand the internal space thereof, in other words, an inner diameter of the second positioning hole 202 becomes larger towards the direction Z.

A second position-detecting pin 952 (refer to FIG. 29) which is provided with the later-described container mount 220 (refer to FIG. 22) in the toner supply device 43 can fit into the second positioning hole 202. The second position-detecting pin 952 has a column-shape having longer length in the direction Z. The second position-detecting pin 952 has a size so as to fit into the second positioning hole 202 along the X-Y surface and the perpendicular to the line LS (refer to FIG. 7) when inserting. In other words, the second position-detecting pin 952 is arranged so as to be inserted towards the line LS direction (refer to FIG. 7) in the second positioning hole 202 when fitting into the second positioning hole 202. The second positioning hole 202 can accept the second position-detecting pin 952 by adjusting the differences of the gap between the first positioning hole 201 and the second positioning hole 202 corresponding to the gap between the first positioning pin 951 and the second position-detecting pin 952 in the container mount 220 (refer to FIG. 22). Thereby, the first positioning pin 951 can fit into the first positioning hole 201, and the second position-detecting pin 952 can fit into the second positioning hole 202. From such a configuration, the toner cartridge 502 can keep a predetermined attitude in relation to the toner-supply device 43 (later-described container mount 220 as shown in FIG. 22). The second positioning hole 202 can accept the second position-detecting pin 952 more easily when the toner cartridge 502 is inserted into the later-described container mount 220 (toner-supply device 43) because the inclination surface portion 202*b* is provided on the front end part thereof in the direction Z.

Herein, the configurations of the first positioning hole 201 and the second positioning hole 202 are arranged at least so that the toner cartridge 502 can keep the predetermined attitude to the container mount 220 (toner-supply device 43). That is, the configurations of the first and second positioning holes 201 and 202 can be different to each other, and not always limited to the configuration according to the Embodiment. For example, they can be disposed in the opposite position to each other. The second positioning hole 202 is not necessary to have a long hole.

The supply/exhaust port 203 is provided adjacent to the upper end (end portion in the direction Y) in the front surface of the toner cartridge 502 (container portion 51). The supply/exhaust port 203 includes a supply/exhaust pore 203*a* penetrating through the front wall portion of the toner cartridge 502 (container portion 51) and a filter 203*b* provided on the end portion thereof in the direction Z. The supply/exhaust pore 203*a* is provided with a portion which is not blocked by developer G, in other words, a position not buried in housed (supplied) developer G in the condition that developer G is fully contained in the toner cartridge 502 (shipping condition, for example). The position which is not blocked by developer G is such that the direction Y of the toner cartridge 502 faces the upper side vertical direction. The filter 203*b* accepts transmission of air while preventing developer G housed in the container portion 51 from escaping outside. In this regard, the supply/exhaust port 203 is configured so as to prevent developer G from escaping, and so as to supply air to the container portion 51, and to exhaust the air from the container portion 51. The supply/exhaust pore 203*a* (supply/exhaust port 203) can be provided at various positions as long as it is not blocked by developer G. For example, it can be provided on the upper surface of the toner cartridge 502, or another portion, and it is not limited to the configuration according to the Embodiment.

A sealing/opening portion 592 is provided on the bottom part of the container portion 51 successively to the discharge path 54 (refer to FIG. 3). In the sealing/opening portion 592, a coupling 562*a* in a coupling area 562 of the screw conveyor 56 provided rotatably in the discharge path 54 can be exposed from the front surface of the container portion 51 (front side surface in the Z-axis direction). The upper side of the sealing/opening portion 592 is shielded by a roof portion 592*a*. Herein, one side in the left and right direction of the roof portion 592*a* is cut out. Thereby, due to the roof portion 592*a*, the sealing/opening portion 592 can be prevented from contacting the coupling 562*a* of the screw conveyor 56 on the upper side in the opposite direction of the direction Z and on the other side in left and right direction. Therefore, the coupling 562*a* can be protected. The sealing/opening portion 592 (coupling 562*a* of screw conveyor 56 provided therein) is arranged in the toner cartridge 502 (in front end surface 50*a* indirection Z) at the position corresponding to that of the first positioning hole 201 as a standard.

The coupling 562*a* is configured to be similar to the coupling 522*a* of the stirring member 52. Therefore, hereinafter, only the configuration and operation of the coupling 522*a* are described, and those of the coupling 562*a* are omitted. The coupling 522*a* (coupling 562*a*) includes a pair of hook protrusions 522*b*, as shown in FIGS. 9A to 9C and 10A to 10E. The hook protrusions 522*b* are provided on each side of the shaft line of the stirring member 52 as a center axis. Each of the pair of hook protrusions 522*b* includes an inclination portion provided adjacent to the end portion 522*c*. Such inclinations are formed so as to reduce the length of the hook protrusions 522*b* on the opposite side of direction Z, from the surface of end portion 522*c*. A pair of inclination surfaces 522*d* is provided with the hook protrusions 522*b* on the end portion 522*c* side in a circumferential direction centering the shaft line of the stirring member 52. Both inclination surfaces 522*d* incline so as to reduce the length of the hook protrusions 522*b* (decrease in the opposite direction of direction Z) from the side of the end portion 522*c* towards the outer side.

The coupling 522*a* is connected to the stirring-drive coupling 301 (refer to FIG. 10D) provided in the container mount 220 in the toner-supply device 43. The stirring-drive coupling 301 is disposed in the container mount 220 (toner-supply device 43), and includes a similar configuration to the transporting-drive coupling in which the coupling 562*a* of the screw conveyor 56 is connected. As shown in FIG. 10A and similar to the coupling 522*a*, the stirring-drive coupling 301 includes a pair of hook protrusions 301*a*. The hook protrusions 301*a* are provided on each side of a central axis Ca of the stirring-drive coupling 301 (equivalent to the shaft line of the stirring member 52). The stirring-drive coupling 301 rotates around the central axis Ca in the container mount 220. Thus, the hook protrusions 301*a* are able to rotate around the central axis Ca by receiving the driving force from a rotary-drive unit. When the stirring-drive coupling 301 does not rotate in the container mount 220 (toner-supply unit 43), an allowance area exists within the stirring-drive coupling 301 in the rotational direction centering the axis Ca. Therefore, a slight rotation (transference by rotation of hook protrusions 301*a*) can be permitted through the stirring-drive coupling 301 by receiving an external force.

The hook protrusion 301*a* includes an inclination portion disposed adjacent to the end portion 301*b* on the upper side end of the direction Z. Such inclinations are formed so as to reduce the length of hook protrusions 301*a*, in the opposite direction to the direction Z. Thereby, each end portion 301*b* of a pair of hook protrusions 301*a* can be horizontal to each end portion 522*c* of a pair of hook protrusion 522*b* in a direction of the central axis Ca, when the central axis Ca fits the shaft line of the stirring member 52, and the stirring-drive coupling 301 faces the coupling 522*a*. In the above-described condition, a pair of the end portion 301*b* and the end portion 522*c* contact with each other when the stirring-drive coupling 301 approaches the coupling 522*a*. Herein, a guiding force is generated so as to guide a pair of hook protrusions 301*a* towards the inside of a pair of hook protrusions 522*b* through the guiding function of two pairs of the end portions 301*b* and 522*c*. Therefore, the central axis Ca and the shaft line of the stirring member 52 can be prevented from mismatching between the stirring-drive coupling 301 and the coupling 522*a*, even if both of the hook protrusion 301*a* (end portion 301*b*) and hook protrusion 522*b* (end portion 522*c*) have contact with each other.

Figure 10B:
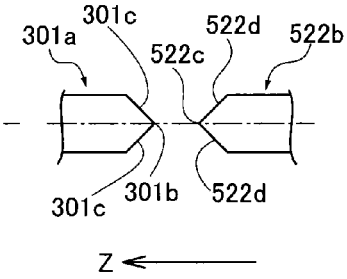
Figure 10C:
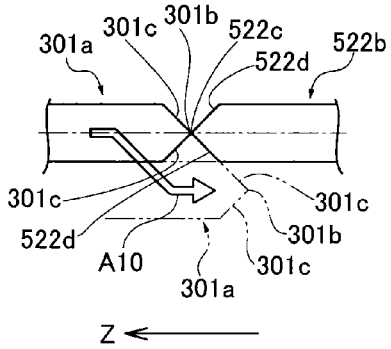
Figure 10D:
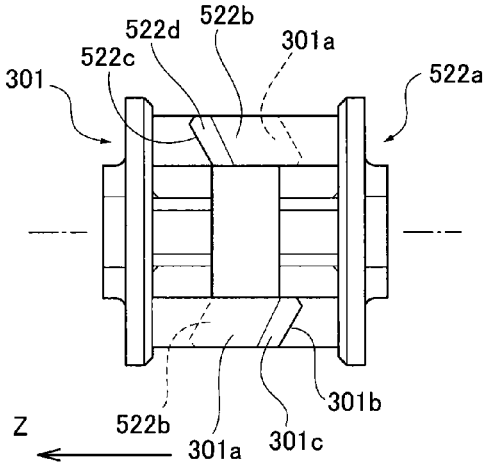
Figure 10E:
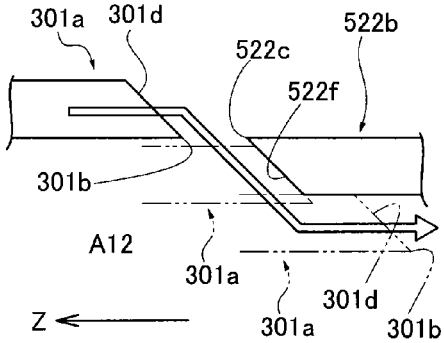

As shown in FIG. 10B, a pair of inclination surfaces 301*c* is provided on both sides centering the central axis Ca in the circumferential direction. A pair of inclination surfaces 301*c* inclines so as to reduce the length of the hook protrusion 301*a* from the end portion 301*b* in the direction Z. In the Embodiment, the inclination angle of the inclination surfaces 301*c* is similar to that of the inclination surfaces 522*d* in the end portion 522*c*. Therefore, as described, when the central axis Ca fits the shaft line of the stirring member 52 and a pair of end portions 301*b* of the stirring-drive coupling 301, and each end portions 522*c* of the coupling 522*a* contact with each other (refer to FIGS. 10A to 10E), one of the inclination surface 301*c* as viewed from the circumferential direction of the end portion 301*b* contacts the other inclination surface 522*d* as viewed from the circumferential direction of the end portion 522*c*. Herein, the stirring-drive coupling 301 can rotate around the central axis Ca, as described. The stirring-drive coupling 301 rotates and moves closer to the coupling 522*a* through the guiding function of the inclination surfaces 301 and 522*d* (refer to arrow A10), and it can prevent knocking between the end portion 301*b* of the stirring-drive coupling and the end portion 522*c* of the coupling 522*a*. As shown in FIG. 10D, the stirring-drive coupling 301 and the coupling 522*a* are provided so that two pairs of hook protrusions 301*a* and 522*b* locate one after the other, as viewed from the circumferential direction (rotation direction) centering the central axis Ca. In this case, when the stirring-drive coupling 301 rotates in the container mount 220 (toner-supply device 43), the stirring member 52 of the toner cartridge 502 rotates through which the hook protrusion 301*a* pushes the corresponding hook protrusions 522*b* in the rotational direction. Therefore, the stirring-drive coupling 301 and coupling 522*a* are connected under the condition that the two pairs of hook protrusions 301*a* and 522*b* locate one after the other, as viewed from the circumferential direction (rotation direction) centering the central axis Ca as described.

As shown in FIGS. 4, 5, 11, and 12, a loading section 204 and a clamping piece 205 are provided on the upper surface of the toner cartridge 502 (positive side surface of the direction Y). The loading section 204 is configured to include a cap 204*a* on a loading port which penetrates the upper wall section defining the upper surface of the toner cartridge 502. The loading port is connected to the container portion 51. Developer G is loaded from the loading port toward the container portion 51 in the loading section 204. The cap 204*a* can prevent developer G from escaping by sealing the loading port of the loading section 204.

The clamping piece 205 is provided in a pair on the upper surface of the toner cartridge 502, adjacent to the rear side (negative direction to the direction Z) and adjacent to the outer side as viewed from the left and right direction (direction X). A pair of clamping pieces 205 protrudes from the upper surface of the toner cartridge 502 towards the positive side of Y-axis direction. The protruding portion in the positive side of Y-axis direction of the clamping piece 205 increases gradually towards the negative side of the Z-axis direction.

As shown in FIGS. 11 and 12, a handle 206 is provided on the rear surface of the toner cartridge 502 (negative side of the direction Z). The handle 206 includes a recess 206*a* and a handle wall section 206*b* covering the upper side of the recess 206*a*. The recess 206*a* is formed by putting a recessed portion partially on the center of a back wall section defining the back wall surface of the toner cartridge 502 so that the center part of the back wall section includes the recess 206*a* having a dent in the direction Y. The handle wall section 206*b* includes a grid-shape rib 206*c* so as to secure rigidity. The handle 206 makes it easier to carry the toner cartridge 502 by grabbing the handle wall section 206*b* with hands inserted in the recess 206*a*.

As shown in FIG. 13, an attachment mount 61 having a rectangle shape and partially protruding toward the negative direction to the direction Y is provided around the discharge outlet 55 in a lower wall section 50*b* of the toner cartridge 502. The shutter assembly 602 is configured by providing the first shutter 622 and the second shutter 632 with the attachment mount 61 so as to slide and move thereon in the direction Z (refer to FIG. 16). A pair of guiding recesses 64 is formed on the attachment mount 61. Each guiding recess 64 is formed by disposing recesses which have a dent in the direction X and extend in the direction Z (refer to FIG. 13) on both end sides of the attachment mount 61 in the direction X. A pair of pieces 64*a* protruding in the direction X relatively from the guiding recess 64 is formed with the arrangement of the guiding recess 64. In other words, the pieces 64*a* are provided so as to define the guiding recess 64 on the attachment mount 61.

A pair of fixing protrusions 65, a pair of support protrusions 66, and a pair of releasing protrusions 67 are provided on the lower wall section 50*b* in which the attachment mount 61 is provided. In addition, a connection plate portion 207 and a discrimination protrusion 208 are provided on the lower wall section 50*b* (refer to FIG. 7). The fixing protrusions 65 include a base end section 65*a* and a pressed portion 65*b*, and define a circulation space 65*c* between the lower wall section 50*b* and the pressed portion 65*b*. The support protrusions 66 include a base end section 66*a* and a flat plate 66*b*. An end portion of a pair of base end sections 66*a* corresponds to an inclination wall surface 66*c*. The support protrusions 66 include a protruding stopper 66*d* which is formed through which the end portion of the flat plate 66*b* in direction Z partially protrudes toward the direction Y. The releasing protrusions 67 are provided on the end portion in the direction Z of the attachment mount 61, and protrude towards the direction Z. Front end surfaces 67*a* of the releasing protrusions 67 in the direction Z are present on an identical plane to the X-Y plane. The releasing protrusions 67 are provided on the upper side of a pair of the guiding recesses 64 (direction Y) in the attachment mount 61.

As shown in FIGS. 6 and 7, the connection plate portion 207 protrudes from the lower wall section 50*b* toward a direction orthogonal to a curved surface defined by the lower wall section 50*b*. The connection plate portion 207 has a rectangle shape extending in the direction Z. The connection plate portion 207 is capable of sliding on an accommodation surface 224 (refer to FIG. 22) of the container mount 220 in the toner-supply device 43. In the case in which the connection plate portion 207 contacts the accommodation surface 224 (sliding state), the connection plate portion 207 has a height (protruding range) such that the lower wall section 50*b* of the toner cartridge 502 can be prevented from contacting the accommodation surface 224.

The discrimination protrusion 208 has a plate-shape which protrudes from the lower wall section 50*b* towards the lower side (opposite to Y direction). The discrimination protrusion 208 is provided in order to prevent the toner cartridge 502 being inserted to the container mount 220 (toner-supply device 43) which corresponds to the different color from that of developer G (toner T) contained in the toner cartridge 502. The position and numbers of the discrimination protrusions 208 are different according to the colors of developer G (toner T) contained in the toner cartridge 502. In an example shown in FIG. 7, two are provided in each left and right side that is, four in total. The position and numbers of the discrimination protrusions 208 corresponds to the position and numbers of later-described discrimination grooves 225 (refer to FIG. 22) provided according to the colors with each container mount 220 in the toner-supply device 43. According to the cooperation between the discrimination protrusion 208 and the discrimination groove 225 (refer to FIG. 22), the toner cartridge 502 (502Y, 502M, 502C, and 502BK) can be inserted to the appropriate container mount 220 (toner-container fixing device 902) corresponding to the same color of developer G (toner T) as its own (contained developer G). Similarly, the toner cartridge 502 can be prevented from being inserted to the container mount 220 (toner-container fixing device 902) corresponding to a different color from its own (that is, mounting-error prevention).

The discrimination protrusion 208 is provided on both ends sandwiching the attachment mount 61 in a right and left direction. The discrimination protrusion 208 is surrounded by a later-described side wall section 50*c*, guide wall section 50*d*, and bottom wall section 50*f*. In other words, when viewing the discrimination protrusion 208 in a direction along the plane X-Y, the lower wall section 50*b* is provided on the upper side, the side wall section 50*c* is provided on the outer side in the right and left direction, the guide wall section 50*d* is provided on the inner side in the right and left direction, and the bottom wall section 50*f* is provided on the bottom side. In addition, a rear wall section defining a rear surface (rear end portion) of the rear-end side (end side in the direction opposite to Z) of the lower wall section 50*b* is provided in the toner cartridge 502. Thereby, the insertion from a different direction than the direction Z is prevented so that the discrimination protrusion 208 is protected more accurately. Therefore, it is possible to prevent the mount-error of the toner cartridge 502 (502Y, 502M, 502C, and 502BK), and achieve an effect through the discrimination protrusion 208 which enables the insertion to the corresponding container mount 220 (toner-container fixing portion 902) more accurately.

As shown in FIGS. 4 and 5, the holding rail 209 is provided on each side wall section 50*c* having a retention-releasing piece 68, in the toner cartridge 502. The holding rail 209 is configured by a plate member which protrudes from the corresponding side wall section 50*c* toward the outside in the right and left direction (direction X). Each holding rail 209 includes a rail body 209*a* and an inclined entry surface 209*b*. The rail body 209*a* extends in the direction Z along the side wall section 50*c*. The inclined entry surface 209*b* connects the end portion of the rail body 209*a* in the direction Z, and inclines toward the direction Y along the direction Z.

In addition, an extending rear section 210 is provided with the toner cartridge 502 on each end side of the side wall sections 50*c* (end sides in the direction opposite to Z). Each extending rear section 210 includes an extending rear wall 210*a*, a vertical rib 210*b*, and a plurality of horizontal ribs 210*c*. The extending rear wall 210*a* is configured by a plate member extending toward the outside in the right and left direction (direction X), and defines the rear end portion of the toner cartridge 502 in a nearly square shape, in relation to the container portion 51 decreasing in the size gradually toward the lower side (inside to outside), as shown in FIGS. 11 and 12. The extending rear wall 210*a* has a size so as to fit into an opening section 220*a* of the container mount 220 (refer to FIGS. 21A, 21B, and 22) without providing a clearance, through the cooperation between the extending rear wall 210*a* and the rear end portion of the toner cartridge 502. The vertical rib 210*b* is provided in parallel to the extending rear wall 210*a* on the front side (direction Z) of the extending rear wall 210*a*. The vertical rib 210*b* is configured by a plate member extending toward the outside in the right and left direction (direction X) from each side wall section 50*c*. The horizontal ribs 210*c* are provided in plural as bridges between the extending rear wall 210*a* and the vertical rib 210*b* in the direction Z. Therefore, in the extending rear section 210, the rigidity of the extending rear wall 210*a* is secured, at the same time as the reduction of the weight and materials can be achieved, by the arrangement of the vertical rib 210*b* and a plurality of horizontal ribs 210*c*.

A pair of guide wall sections 50*d* is provided with the toner cartridge 502. A shutter protector 50*e* is further provided in the front end of the guide wall section 50*d* on the right side in FIG. 13 (forward end portion in direction Z). The front end of the guide wall section 50*d* protrudes partially towards the direction Z and forms the shutter protector 50*e*. As described later, the shutter protector 50*e* is provided in the attachment mount 61 (lower wall portion 50*b* of toner cartridge 502). The shutter protector 50*e* protrudes over the first shutter 622 and the second shutter 632 in the direction Z, in the condition that the first shutter 622 and the second shutter 632 (shutter assembly 602) are provided so as to slide aside in the direction Z (refer to FIG. 17). In the case in which the toner cartridge 502 faces an unintended object when it is inserted in the direction Z, the shutter protector 50*e* contacts the object ahead of the first and second shutters 622 and 632. Thereby, the shutter protector 50*e* can prevent the first and second shutters 622 and 632 from being pushed toward the negative side of the direction Z relatively. Thus the first and second shutters 622 and 632 can be protected through the shutter protector 50*e*, by preventing them from being pushed by an unintended object.

As shown in FIGS. 6, 7, and 13, the bottom wall section 50*f* is provided on each lower end portion in the right and left direction of the attachment mount 61. Each bottom wall section 50*f* is provided as a bridge in the direction X between the side wall section 50*c* and the guide wall section 50*d* on the negative side of the direction Z thereof. A lower supporting piece 214 is provided with each bottom wall section 50*f*. The lower supporting piece 214 is provided in a pair on the bottom wall section 50*f* at an adjacent position to the rear side surface (negative side surface in direction Z). The lower supporting pieces 214 are provided on each outside of the bottom wall section 50*f* in the right and left direction (direction X). Both of the lower supporting pieces 214 protrude from the bottom wall section 50*f* toward the opposite direction to the direction Y. The protruding range thereof increases gradually toward the opposite direction to the direction Y. The first shutter 622 is provided with the lower wall section 50*b* of the toner cartridge 502 including those configurations as described.

As shown in FIG. 14, the first shutter 622 is formed to be plate-like as a whole, and includes a pair of side wall sections 71, a fixing piece 72, a releasing protrusion 73, a mount 74, a pair of engaging sections 75, and a pair of guide wall sections 76. A cutout portion 71*a* is formed on each side wall section 71. The end side of the direction Z of the side wall section 71 is unclosed with the cutout portions 71*a*. The length of the cutout portion 71*a* is determined at the extent in which the opposite side end portion in the direction Z does not open. In order to meet the above, a protruding stopper 71*b* protruding towards the negative side of the direction Y is provided in relation to the cutout portion 71*a*.

The fixing piece 72 includes a base end 72*a* and a body 72*b*. The protruding edge of the body 72*b* configures a pressure leg portion 72*c*. The releasing protrusion 73 is provided with the body 72*b*. The releasing protrusion 73 releases the fixing of the first shutter 622 on the sealing position by being pressed toward the direction Y.

The mount 74 is surrounded by the fixing piece 72 (including base end 72*a*) and the side wall sections 71, and includes a shutter seal 772 as a sealing member. The shutter seal 772 is fixed so as to be engaged to the mount 74. The shutter seal 772 seals the discharge outlet 55 (in order to seal passage of developer G), by being pressed by the attachment mount 61, around the discharge outlet 55 provided on the lower wall section 50*b* of the toner cartridge 502 (refer to FIG. 17). The front end portion 772*a* of the shutter seal 772 in the direction Z protrudes more than a front end surface 74*a* of the mount 74. The shutter seal 772 is composed of an elastic member such as a sponge so that it can adhere tightly around the discharge outlet 55 by its elastic deformation when it is pressed by the attachment mount 61 around the discharge outlet 55. As described, the sealing through the shutter seal 772 can be achieved (refer to FIG. 17).

A pair of engaging sections 75 includes hook surfaces 75*a* which are parallel to the X-Y plane on the opposite side of the direction Z. The engaging section 75 further includes a pressure surface 75*b* which is parallel to the X-Y plane in the direction Z.

A pair of guide wall sections 76 includes a guiding surface 76*a* which is parallel to the Y-Z plane. Each guiding surface 76*a* includes a guiding protrusion 76*b*. The guiding protrusion 76*b* can be engaged to the guiding recess 64 (refer to FIG. 13) provided with the attachment mount 61 of the lower wall section 50*b* of the toner cartridge 502. The guiding protrusion 76*b* is provided to be movable therein. The guiding recess 64 is defined by a piece 64*a* (refer to FIG. 13). The piece 64*a* can be held between the guiding protrusion 76*b* and the shutter seal 772 (refer to FIG. 14) provided with the mount 74 in the direction Y when the guiding protrusion 76*b* is inserted to the guiding recess 64 (refer to FIG. 13).

As shown in FIGS. 15A to 15C, the second shutter 632 is provided so as to cover the first shutter 622 and configured by a flat plate as a whole. The second shutter 632 includes a flat plate 782, a releasing protrusion 79, a pair of side wall sections 80, a pair of arm sections 812, and a pair of stoppers 82. The second shutter 632 further includes a supporting protrusion 211. The flat plate 782 is configured by a thin plate parallel to the X-Z surface, having a rectangular shape as a whole in the direction Z (on X-Z plane surface). An end portion 782*a* on the opposite side of the direction Z of the flat plate 782 is configured to be flat and extends in parallel to the X-Y surface in the direction X.

The releasing protrusion 79 is provided on the flat plate 782. The end portion on the opposite side of the direction Z of the releasing protrusion 79 forms an inclination surface 79*a*. The flat plate 782 further includes the pair of side wall sections 80. An insertion recess 80*a* and an inclination surface 80*b* are provided with each of the side wall sections 80.

The pair of arm sections 812 protrudes from the end portion in the direction Z of the side wall sections 80 toward the direction Z. The arm sections 812 are configured by a bar-like member extending toward the direction Z. A distance between the arm sections 812 decreases gradually toward the direction Z. Each flat plate 66*b* of the support protrusion 66, provided on the lower wall section 50*b* of the toner cartridge 502, can be inserted between each arm section 812 and the flat plate 782, in which the arm sections 812 are movable. In addition, a pair of insertion recesses 80*a* which are provided adjacent to the arm sections 812 similarly accept the flat plate 66*b* of the support protrusion 66. Thereby, the second shutter 632 can be attached to the toner cartridge 502 (on lower wall section 50*b* thereof) so as to move in the direction Z. The first shutter 622 can be kept in between both arm sections 812. As described later, in the case in which the first and second shutters 622 and 632 are attached appropriately to the lower wall section 50*b* of the toner cartridge 502 (refer to FIG. 16), when the first shutter 622 moves toward the direction Z in relation to the second shutter 632, the side wall section 71 of the first shutter 622 contacts (is interfered by) the arm sections 812 (refer to FIG. 25).

An end portion 812*a* of each arm section 812 protrudes in the direction Z, and sharpens its end portion as viewed from the direction Y. The pointed end of each end portion 812*a* faces each other in the direction X. The interval between the end portions 812*a* is shorter than the width of the first shutter 622 (clearance between each side surfaces of side wall sections of first shutter 622 in direction X). Each arm section 812 includes a hook piece 812*b* adjacent to the protruding end portion 812*a*. Each hook piece 812*b* protrudes outward in the direction X from each arm section 812 (adjacent to protruding end portion 812*a*). The protruding edge thereof (outer end in direction X) is arranged on an identical plane to the outer surface of the side wall section 80 (outer wall surface in direction X). The above state is regarded as an initial curve-state of the arm sections 812. The arm section 812 is elastic and deformed in the direction X when a force to the direction X is applied. Then, the arm section 812 reverts to the initial curve-state when the force is released.

In the arm section 812, the surface on the negative side of the direction Z, around the protruding end portion 812*a* configures a plane surface 812*c* which is in parallel to the X-Y plane, in the initial curve-state. Therefore, when the arm section 812 has the above-described configuration (refer to FIG. 16), and the first shutter 622 moves in the direction Z in relation to the second shutter 632, the plane surface 812*c* contacts the front ends of each side wall section 71 of the first shutter 622. Herein, the plane surface 812*c* is in parallel to the X-Y plane and provided adjacent to each protruding end portion 812*a*. The front ends of each side wall section 71 of the first shutter 622 correspond to the pressure surface 75*b* of the engaging section 75 which is in parallel to the X-Y plane.

Each arm section 812 of the second shutter 632 includes a releasing protrusion 812*d* in the direction Z of the hook piece 812*b*. The releasing protrusion 812*d* protrudes from an adjacent position to the protruding end portion 812*a* of the arm section 812 towards the outer side of the direction X and in the direction Z, and configures an inclined releasing surface 812*e* on the direction Z thereof. The inclined releasing surface 812*e* inclines gradually toward the direction Z along an outer side in the direction X. The flat plate 782 which includes the arm section 812 further includes the pair of stoppers 82.

The supporting protrusion 211 is provided adjacent to the center of the flat plate 782 and at the position opposite to the direction Z over the releasing protrusion 79. The supporting protrusion 211 protrudes from the flat plate 782 toward the direction Y. The front surface of the supporting protrusion 211 in the direction Z is configured by a flat surface 211*a* which is in parallel to the X-Y plane. As described later, the supporting protrusion 211 is configured to have a size so that a bridge portion in the direction X (refer to 72*d* in FIG. 14) in the first shutter 622 can contact the flat surface 211*a* in the direction Z, when the first and second shutters 622 and 632 are provided appropriately on the lower-wall section 50*b* of the toner cartridge 502 (refer to FIG. 17). The bridge portion is provided with the body 72*b* in the fixing piece 72, having a shape like character H.

As shown in FIGS. 16 and 17, the first and second shutters 622 and 632 in the shutter assembly 602 can be provided on the lower wall section 50*b* of the toner cartridge 502. The first shutter 622 is attached to the attachment mount 61 through each guiding protrusion 76*b* in a pair of guide wall sections 76 which are inserted into a pair of guiding recess 64 provided with the attachment mount 61 on the lower wall section 50*b* of the toner cartridge 502. Thereby, the first shutter 622 can slide in the direction Z between the sealing position and the releasing position on the lower wall section 50*b* of the toner cartridge 502, due to the guiding function of the guiding recesses 64 and the guiding protrusion 76*b* inserted therein. In this state, the flat plate 66*b* of a pair of support protrusions 66 on the lower wall section 50*b* (inside portion 66*e* thereof as viewed from direction X as shown in FIG. 13) is inserted into the cutout portion 71*a* on both side-wall sections 71 in the first shutter 622. The protruding stopper 71*b* (refer to FIG. 14) provided on the end portion of the cutout portion 71*a* in the negative side of the direction Z interferes with the protruding stopper 66*d* provided on the end portion of the flat plate 66*b* in the direction Z. Thereby, the first shutter 622 is prevented from dropping out from the lower wall section 50*b* (that is, attachment mount 61) by moving toward the direction Z on the lower wall section 50*b*.

The second shutter 632 is attached through the flat plate 66*b* of the support protrusions 66 on the lower wall section 50*b* of the toner cartridge 502. The flat plate 66*b* is inserted into the insertion recess 80*a* in each side wall section 80. The second shutter 632 can slide in the direction Z between the covered position and the releasing position via the releasing position of the first shutter 622, through the guiding function of the insertion recesses 80*a* and a pair of support protrusions 66 being inserted thereto. The supporting protrusion 211 in the second shutter 632 can mate with the body 72*b* (bridge 72*d* in direction X, in particular) when the second shutter 632 moves toward the direction Z in relation to the first shutter 622. Accordingly, relative to the movement of the second shutter 632 further to the direction Z, the first shutter 622 can move from the releasing position toward the sealing position in the direction Z. Therefore, in the toner cartridge 502, the discharge outlet 55 can be sealed by the shutter seal 772, through the movement of the second shutter 632 in the direction Z so as to move the first shutter 622 to the sealing position.

The toner cartridge 502 provided with the shutter assembly 602 is inserted into the toner-supply device 43. The toner-supply device 43 includes the toner-container fixing portion 902 corresponding to the configuration of the shutter assembly 602. As shown in FIGS. 18 and 19, the toner-container fixing member 902 includes a guiding recess 91, a second insertion recess 92, a fixing groove 93, a first insertion recess 94, a fixing claw assembly 95, a supply port 96, and a releasing claw assembly 97. In addition, the toner-container fixing member 902 further includes a pressure portion 212 pushing the releasing protrusion 812*d* and an assistance guide portion 213.

The guiding recess 91 is provided in a pair in the direction X. The guide wall sections 50*d* of the toner cartridge 502 can be inserted into the guiding recess 91 (refer to FIG. 24). The second shutter 632 in the shutter assembly 602 can be inserted into the second insertion recess 92 so that it is engaged thereto and movable in the direction Z (refer to FIG. 24). The fixing groove 93 is defined by a fixing wall section 93*a* in parallel to the X-Y plane on the opposite side of the direction Z. The fixing groove 93 is configured to have a size so that the hook piece 812*b* in the arm section 812 in the second shutter 632 (refer to FIGS. 15A-15C) can be inserted thereto. The first insertion recess 94 is provided adjacent to the second insertion recess 92 in the direction Z. The first shutter 622 of the shutter assembly 602 in the toner cartridge 502 can be inserted movably into the first insertion recess 94 in the direction Z (refer to FIG. 26). Herein, the first shutter 622 is engaged to the first insertion recess 94. The first insertion recess 94 configures a second step portion 98 in between the second insertion recess 92.

The fixing claw assembly 95 includes a protrusion 95*a* on one side and a protrusion 95*b* on another side thereof. A surface of one end of the protrusion 95*a* fixes up the both side-wall sections of the attachment mount 61 of the toner cartridge 502. The protrusion 95*b* on another side can be arranged on the backward surface of the engaging section 75 (opposite side surface of hook surface 75*a* thereof) on both side wall sections 71 of the first shutter 622 in the toner cartridge 502 (refer to FIG. 26). The fixing claw assembly 95 is provided to be rotatable around a rotational axis 95*c* and a rotation force is added so as to take an initial curve-state (refer to an arrow A2 in FIG. 19). In addition, in the initial rotation state, each fixing protrusion 95*a* in the fixing claw assembly 95 can contact with the front end surface 67*a* of each releasing protrusion 67 in the attachment mount 61 of the toner cartridge 502 in the direction Z, when the toner cartridge 502 is mounted appropriately.

The supply port 96 is adjacent to the first insertion recess 94 in the direction Z. The central portion of the supply port 96 is provided with an aperture for a toner supply port 96*a* which is connected to the temporary toner chamber 44 (refer to FIG. 3) The supply port 96 forms a first step portion 99 in between the first insertion recess 94. The position of the upper end surface of the supply port 96 is arranged so as to contact with the lower end surface of the attachment mount 61 on surface to surface, in the condition that the toner cartridge 502 is inserted appropriately. The upper surface of the supply port 96 has an aperture for providing the toner supply port 96*a* in the direction Y. The lower end surface of the attachment mount 61 has an aperture for providing the discharge outlet 55 on the opposite side of the direction Y. In this configuration, the discharge outlet 55 and the toner-supply port 96*a* are connected so as to face each other in the direction Y.

The releasing claw assembly 97 adds a force to a releasing claw 97*a* so that an elastic pressure member 97*b* can take the initial-protruding position as shown in FIGS. 18 and 19. The releasing claw 97*a* includes a front side inclination 97*c* and a backward inclination 97*d*. In the releasing claw assembly 97, the position of the releasing claw 97*a* is regarded as the initial protruding position when it does not receive any force. The front end portion of the releasing claw 97*a* can be pushed into the toner-container fixing portion 902 against the elastic pressure member 97*b*.

The pressure portion 212 pressing the releasing protrusion 812*d* is provided so as to shift the arm section 812 of the second shutter 632 toward the outside in the direction X corresponding to the insertion of the second shutter 632 into the second insertion recess 92. The pressure portion 212 is provided in a pair in the direction X so as to correspond to each arm section 812. Each pressure portion 212 includes a base member 212*a* which protrudes toward the inside of the end portion in the direction X of the fixing groove 93, as viewed from the right and left direction (direction X), and a pressure-body portion 212*b* which protrudes from the protruding end of the pressure-body portion 212*b* toward the opposite side of the direction Z. As described later, a size and position of the base member 212*a* are arranged so as not to prevent the hook piece 812*b* in the arm section 812 from entering into the fixing groove 93 (refer to FIGS. 24-26). The front end portion of the pressure body portion 212*b* on the opposite side of the direction Z (hereinafter, referred to as simply protruding end portion 212*c*) is provided so as to protrude toward the second insertion recess 92. Sequentially to the protruding end portion 212*c*, an inclined pressure surface 212*d* is provided. The inclined pressure surface 212*d* inclines toward the direction Z, from inside to outside in the direction X.

In each pressure portion 212 pressing the releasing protrusion 812*d*, the pressure body portion 212*b* (protruding end portion 212*c* and inclined pressure surface 212*d*) is designed to have an even height to that of the corresponding arm section 812 (releasing protrusion 812*d* and inclined releasing surface 812*e*, in particular) of the second shutter 632 which is inserted to the second insertion recess 92. In each pressure portion 212, the protruding end portion 212*c* and the inclined pressure surface 212*d* of the pressure body portion 212*b* are provided at a position facing the inclined releasing surface 812*e* of the releasing protrusion 812*d* of the arm section 812 in the direction Z (refer to FIG. 24). The position of each pressure portion 212 is designed so that the protruding end 212*c* and the inclined pressure surface 212*d* of the pressure body portion 212*b* contact the inclined releasing surface 812*e* (the releasing protrusion 812*d*) of the arm section 812 before the second shutter 632 moves to the limit line defined by the second step portion 98 (refer to FIG. 24).

Figure 24:
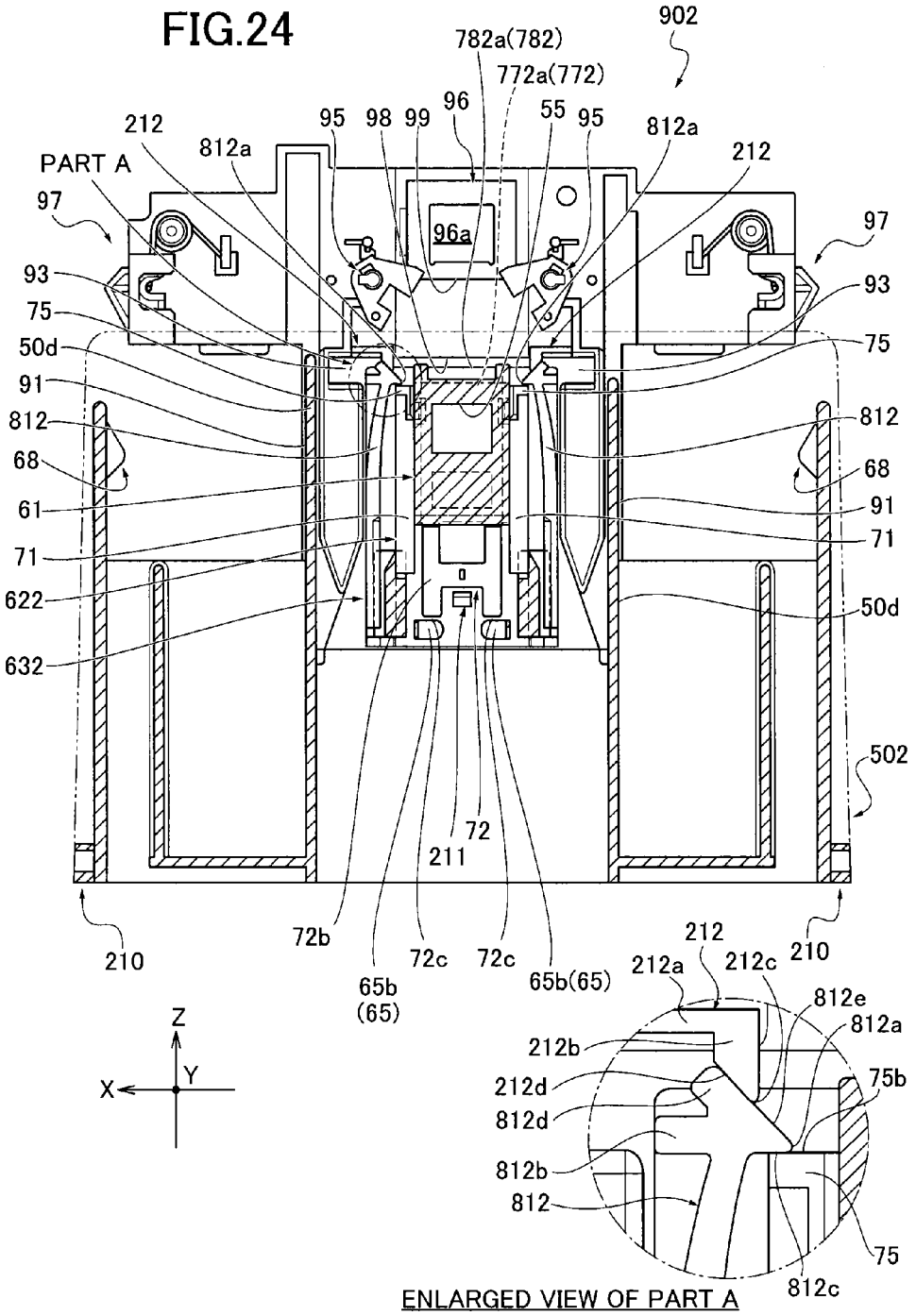
FIG. 24 provides an explanatory view illustrating an aspect in which the toner cartridge 502 is inserted to the toner-container fixing portion 902.

Therefore, in each pressure portion 212, the pressure body portion 212*b* contacts the releasing protrusion 812*d* of each arm section 812 in the initial-protruding state, when the second shutter 632 enters the second insertion recess 92 (refer to FIG. 24). As the second shutter 632 moves further in the direction Z, due to the interaction between the inclined releasing surface 812*e* of the releasing protrusion 812*d* and the protruding end portion 212*c* and the inclined pressure surface 212*d* of the pressure body portion 212*b*, the pressure portion 212 shifts the hook piece 812*b* (outer end in direction X) of the arm section 812 to the position outside the side wall section 80 (its outer end). Thereby, the hook piece 812*b* enters into the fixing groove 93 (refer to FIG. 25).

The assistance guide portion 213 is provided on the end portion in the negative direction of the direction Z of a wall section between the guiding recess 91 and the second insertion recess 92. The assistance guide portion 213 includes an outside inclination surface 213*a* on the outside thereof as viewed from the right and left direction (direction X), and an inner side inclination surface 213*b* inside. The outside inclination surface 213*a* guides a pair of guide wall sections 50*d* toward the guiding recess 91 so that each guide wall section 50*d* can enter the guiding recess 91 smoothly. The inner side inclination surface 213*b* guides the second shutter 632 provided with the second insertion recess 92 so that each guide wall section 50*d* can enter the second insertion recess 92 smoothly.

The toner-container fixing portion 902 is provided on the inner side of the container mount 220 of the image-forming apparatus 102 (refer to FIG. 20), as shown in FIG. 22. As shown in FIG. 20, the developing devices 23 are provided in parallel, in the horizontal direction (direction along X-Z plane). Corresponding to those, the photoreceptor drum 21, the transfer belt 30, the toner-supply device 43, and the like are provided in parallel in the horizontal direction (only toner-supply device 43 is shown in FIG. 20, though). In order to accommodate the toner cartridge 502, the image-forming apparatus 102 includes four container mounts 220 corresponding to yellow, cyan, magenta, and black. Each one corresponds to each color. The container mounts 220 are disposed in parallel in the horizontal direction corresponding to the developing devices 23 (toner-supply device 43) which are provided in parallel in the horizontal direction. Each container mount 220 accepts each one-color toner cartridge 502 (502Y, 502M, 502C, 502BK). Each of the container mounts 220 have nearly the same configuration, similar to the toner cartridge 502 and the toner-container fixing device 902, except that a setting of each discrimination groove 225 is different from each other as later described. Thus, a configuration of only one container mount 220 is shown in the description and FIGS. 21A, 21B, and 22, and those of the other container mounts 220 are omitted herein.

As shown in FIGS. 21A, 21B, and 22, the container mount 220 is accommodated with the image-forming device 102 through an opening section 220*a* of the outer wall section of the image-forming device 102. The container mount 220 has a rectangular-parallelepiped shape space into which the toner-container fixing portion 902 can be inserted. The opening section 220*a* is an almost rectangle shape and has a size to which the end side portion similarly having an almost rectangle shape of the toner cartridge 502 can be inserted (refer to FIG. 21B) with no or almost no clearance allowed in between.

The container mount 220 includes a holding rail 221. The holding rail 221 is provided on each inner surface 220*b* of the container mount 220 in the right and left direction (direction X). Each holding rail 221 is configured by a flat plate member protruding from the inside of the corresponding inner surface 220*b* toward the right and left direction (direction X). As shown in FIG. 23B, when the toner cartridge 502 is inserted into the container mount 220, the holding rail 221 contacts the upper surface (surface in direction Y) of an inclined entry surface 209*b* of the holding rail 209 provided with the side wall section 50*c* of the toner cartridge 502. As shown in FIGS. 23B to 23C, when the toner cartridge 502 further moves to the direction Z, the holding rail 221 relatively moves to the upper side (direction Y) of a rail body 209*a* of the holding rail 209 and contacts the same from the upper side. Therefore, the toner cartridge 502 can be prevented from moving to the upper side (direction Y) and the attitude thereof is defined through the holding rail 221, in the container mount 220.

As shown in FIGS. 21A, 21B, and 22, a holding piece 222 is provided with each inner surface 220*b* of the container mount 220 on the upper side (direction Y) of the holding rail 221. The holding piece 222 protrudes from the corresponding inner side surface 220*b* toward the inside of the right and left direction (direction X). The protruding range thereof in the right and left direction increases gradually along the direction Z. The holding piece 222 has a size so as to sandwich the toner cartridge 502 (both sides) in the right and left direction (direction X), at least at a position in which the protrusion range is at the maximum.

As shown in FIG. 22, a pair of mount bases 223 is provided with the container mount 220 so as to cover both side portions in the right and left direction (direction X) of the toner-container fixing portion 902. The upper side surface of the mount base 223 is an accommodation surface 224 formed in a curve corresponding to the curved surface defined by the lower wall section 50*b*, in order to prevent interference which may occur in the lower wall section 50*b* (refer to FIG. 6) upon entering. When the toner cartridge 502 moves to the direction Z in the container mount 220, the connection plate portion 207 in the lower wall section 50*b* of the toner cartridge 502 (refer to FIG. 6) can be contact contacted with and slide the accommodation surface 224. When the accommodation surface 224 contacts the connection plate portion 207, the accommodation surface 224 can be prevented from contacting the lower wall section 50*b* of the toner cartridge 502 due to the above-described configuration of the connection plate portion 207.

A discrimination groove 225 and an insertion groove 226 are provided with the mount base 223. The discrimination groove 225 prevents the toner cartridge 502 from being mounted to the container mount 220 (toner-container fixing portion 902) in relation to the color (yellow, cyan, magenta, and black) which is different from that of developer G (toner T) contained in itself. The discrimination groove 225 is recessed from the accommodation surface 224 to the negative side of the direction Y and extends in the direction Y. The size of the discrimination groove 225 is determined so as to accommodate the discrimination protrusion 208 (refer to FIG. 6) provided with the toner-container fixing portion 902. The number and the arrangement of the discrimination groove 225 are different according to the color of developer G contained in the corresponding toner cartridge 502. In the illustrated example, two discrimination grooves 225 are formed on either side, that is, four in total. With this configuration, the discrimination groove 225 allows the toner cartridge 502 to be inserted into only the container mount 220 corresponding to the same color.

The insertion groove 226 is positioned on the lateral outer side (direction X) in a lower portion of the mount base 223. The insertion groove 226 is recessed inward and extends in the direction Z. The insertion groove 226 can accept a retention-releasing piece 68 (refer to FIG. 16) provided with the toner cartridge 502 and allow the retention-releasing piece 68 to move in the direction Z to the releasing claw assembly 97 (releasing claw 97*a* shown in FIG. 18).

Figure 25:
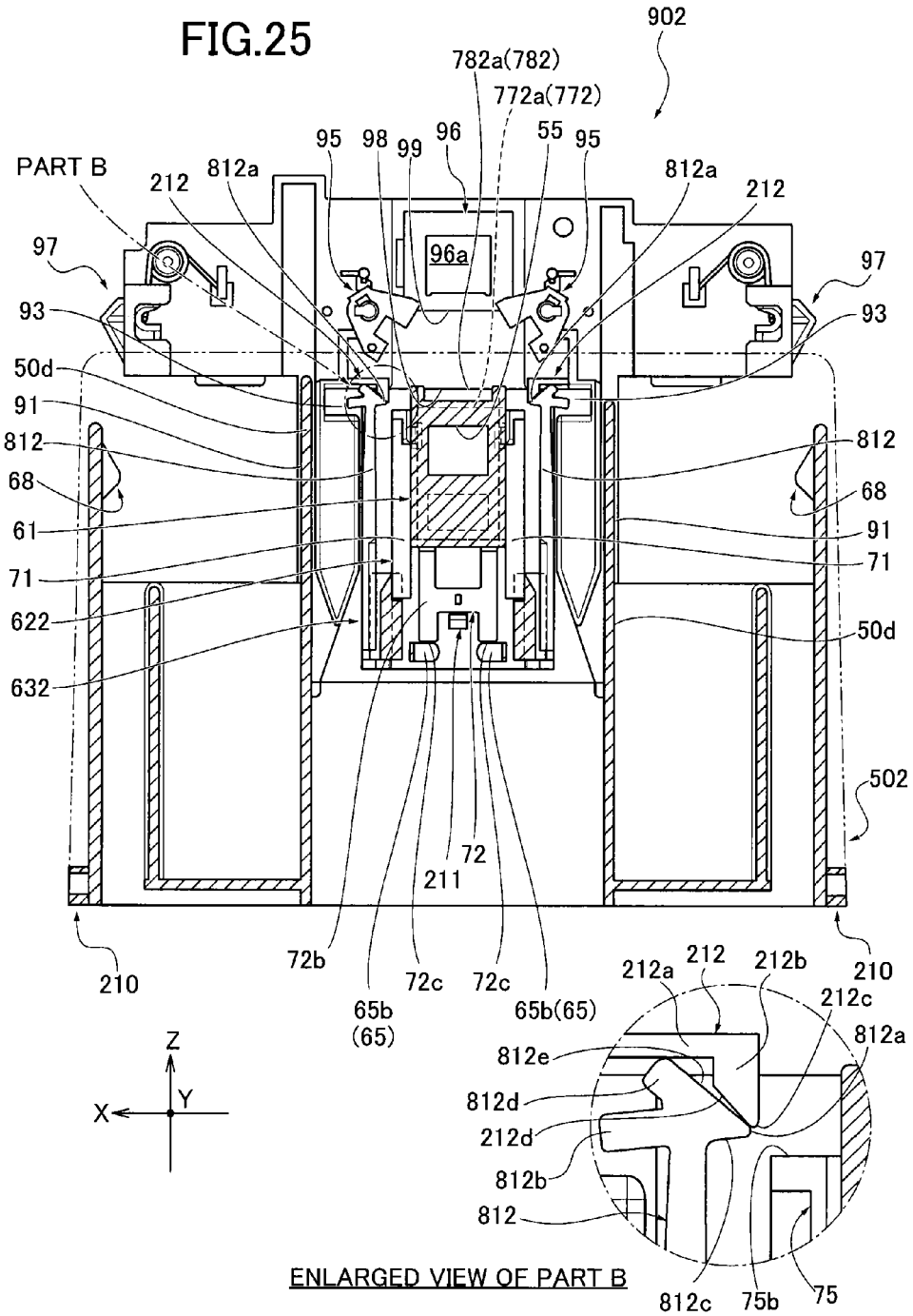
FIG. 25 provides an explanatory view similar to FIG. 24, and illustrates the second shutter 632 of the toner cartridge 502 having contact with a second step portion 98 of the toner-container fixing portion 902.
Figure 26:
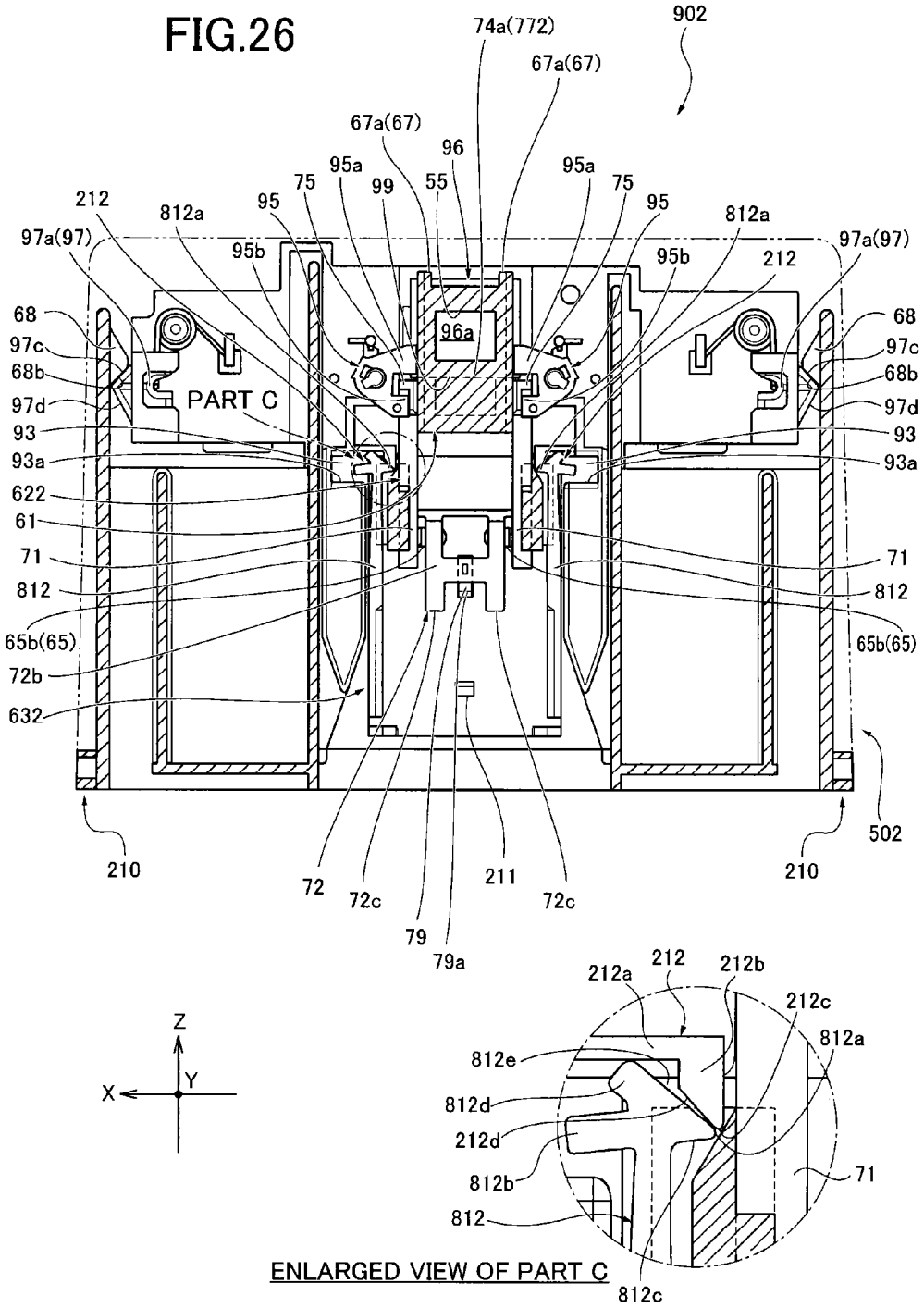
FIG. 26 provides an explanatory view similar to FIG. 24, and illustrates a discharge outlet 55 of the toner cartridge 502 in connection with a toner-supply port 96*a* of the toner-container fixing portion 902 (toner-supply device 43).

Descriptions are given below of operations of the shutter assembly 602 and the toner-container fixing portion 902 while inserting the toner cartridge 502 into the container mount 220 with reference to FIGS. 24 to 26. FIG. 24 is an explanatory view illustrating an aspect in which the toner cartridge 502 is inserted to the toner-container fixing portion 902. FIG. 24 includes a cross-sectional view of the toner cartridge 502 similar to FIG. 16 and a front view of the toner-container fixing portion 902 similar to FIG. 19. FIG. 24 further illustrates a pair of pressure portions 212 having a protrusion and opening. FIG. 24 also illustrates the pressure body portion 212*b*, protruding end portion 212*c*, and inclined pressure surface 212*d* of the pressure portions 212 having contact with the releasing protrusion 812*d* (and inclined releasing surface 812*e* thereof) of a pair of arm sections 812, as the initial-curve state of the second shutter 632 of the toner cartridge 502. FIG. 25 is an explanatory view similar to FIG. 24, and illustrates the second shutter 632 of the toner cartridge 502 having contact with the second step portion 98 of the toner-container fixing portion 902. FIG. 26 is an explanatory view similar to FIG. 24, and illustrates the discharge outlet 55 of the toner cartridge 502 in connection with the toner-supply port 96*a* of the toner-container fixing portion 902 (toner-supply device 43).

Initially, the toner cartridge 502 is held by grabbing the handle 206 (refer to FIGS. 21A and 21B) and moving it (including toner-container fixing portion 902) toward the insertion direction (direction Z) to the container mount 220, as indicated with the arrow A11 shown in FIG. 21A. At that time, a part of guide wall sections 50*d* (refer to FIG. 16) is inserted into a pair of guiding recesses 91 of the toner-container fixing portion 902 (refer to FIGS. 19 and 20), then, the connection plate portion 207 (refer to FIG. 6) provided with the lower wall section 50*b* of the toner cartridge 502 is mounted on each accommodation surface 224 (refer to FIG. 22) provided with the container mount 220. Thereby, the holding rail 221 in the container mount 220 contacts the corresponding holding rail 209 provided on a pair of side wall sections 50*c* of the toner cartridge 502 (refer to FIGS. 23A-23C) from the lower side. Each holding piece 222 sandwiches the toner cartridge 502 (side surfaces thereof) in the right and left direction (direction X). Thereby, the movement direction of the toner cartridge 502 corresponding to the toner-container fixing portion 902 is defined to the insertion direction (direction Z), as shown in FIG. 24).

As shown in FIGS. 16 to 17, the first shutter 622 is at the sealing position in the shutter assembly 602, and the shutter seal 772 is pressed on the attachment mount 61 around the discharge outlet 55 so as to seal the discharge outlet 55. The second shutter 632 is at the covering position in the shutter assembly 602, so the first shutter 622 including the releasing protrusion 73 is covered by the second shutter 632. Additionally, in the first shutter 622, the pressure-leg portion 72*c* in the body portion 72*b* of the fixing piece 72 contacts the pressed surface 65*b* of the fixing protrusion 65 in the direction Z. The pressure leg portion 72*c* can be prevented from moving from the pressed position toward the attachment mount 61 (toner cartridge 502) on the opposite side of the direction Z. Subsequently, in the second shutter 632, the plane surface 812*c* which is in parallel to the X-Y plane adjacent to the protruding-end portion 812*a* of the arm section 812 contacts the front end portion of the side wall sections 71 of the first shutter 622, that is, the pressure surface 75*b* which is in parallel to the X-Y plane of the engaging section 75. Thus, the second shutter 632 can be prevented from moving toward the opposite side of the direction X corresponding to the attachment mount 61 (toner cartridge 502) as shown in FIG. 16.

As the toner cartridge 502 moves toward the direction Z, the second shutter 632 of the shutter assembly 602 enters into the second insertion recess 92 of the toner-container fixing device 902. In the initial curve-state, the releasing protrusion 812*d* of the arm section 812 in the second shutter 632 (inclined releasing surface 812*e*, especially) contacts the pressure body portion 212*b* of the pressure portion 212 in the toner-container fixing portion 902 (protruding end portion 212*c*, that is, inclined pressure surface 212*d*) as shown in FIG. 24. When the toner cartridge 502 further moves toward the direction Z, due to the guiding function of the protruding end portion 212*c* of the pressure body portion 212*b*, the inclined pressure surface 212*d*, and the inclined releasing surface 812*e* of the releasing protrusion 812*d*, the arm section 812 changes its position (protrudes) toward the outer side as viewed from the direction X. Therefore, the hook piece 812*b* can enter into the fixing groove 93 which is connected to the second insertion recess 92 (refer to FIG. 25). In this condition, the second shutter 632 contacts the second step portion 98 of the toner-container fixing portion 902 (refer to FIG. 25). Therefore, the second shutter 632 is controlled so as not to move toward the direction Z relative to the toner-container fixing portion 902.

As shown in FIG. 26, along with the movement of the toner cartridge 502 in the direction Z, the lower end surface of the attachment mount 61 (negative side surface in direction Y) and the upper end surface of the supply port 96 (positive side surface in direction Y) contact each other by surface to surface contact. At the same time, the discharge outlet 55 of the attachment mount 61 faces the toner supply port 96*a* of the supply port 96 in the direction Y and being connected to the same. In this condition, the other end side protrusion 95*b* in the fixing-claw assembly 95 enters into the backward side of the engaging section 75 in the side wall section 71 of the first shutter 622 (front end portion 772*a* of shutter seal 772) as the releasing position on the control position defined by a first step portion 99. The front end surface 74*a* of the mount 74 in the first shutter 622 is determined as the control position defined by the first step portion 99.

In this case, in the first shutter 622, the front end portion 772*a* of the shutter seal 772 protrudes more than the front end surface 74*a* of the mount 74 in the direction Z (refer to FIG. 14). Accordingly, the protruding portion of the shutter seal 772 including the front end portion 772*a* is compressed on the first step portion 99. Thus, in the condition that the discharge outlet 55 and the toner-supply port 96*a* are connected, the first step portion 99, that is, the interval between the port 96 and the first shutter 622, can be sealed at the compressed position in the shutter seal 772. Similarly, in addition, the hook piece 812*b* of the arm section 812 in the second shutter 632 enters into the fixing groove 93. The hook piece 812*b* is at the releasing position in the control position by the second step portion 98. Herein, in the arm section 812 of the second shutter 632, it is configured so that the releasing protrusion 812*d* contacts the pressure body portion 212*b* of the pressure portion 212, or the protruding end portion 812*a* contacts the side wall section 71 of the first shutter 622. Thereby, the arm section 812 keeps the deformed state so that the protruding end portion 812*a* extends along the direction Z at the same time as shifting towards the direction X. In the retention releasing piece 68 of the side wall section 50*c* of the toner cartridge 502, the lateral side of the inclination portion 68*b* faces the front side inclination 97*c* of the releasing claw 97*a* of the releasing claw assembly 97 in the direction Z. Thereby, the toner cartridge 502 is fixed to the toner-container fixing portion 902 releasably.

When the discharge outlet 55 and the toner supply port 96*a* are connected, the first positioning pin 951 provided with the container mount 220 (refer to FIG. 29) can be inserted into the first positioning hole 201 (refer to FIG. 4). The second positioning pin 952 (refer to FIG. 2) which is provided with the container mount 220 is inserted into the second positioning hole 202. Thereby, the toner cartridge 502 can keep the predetermined attitude corresponding to the container mount 220. Herein, the positioning protrusion provided with the container mount 220 is inserted into the position-adjustment hole 572*b* (refer to FIG. 4) on the electronic substrate 572 so that the electronic substrate 572 can be presented in the appropriate position.

In addition, while the toner cartridge 502 is moved in the direction Z so that the discharge outlet 55 and the toner supply port 96*a* are in a connected state, the clamping piece 205 (refer to FIG. 4) which is provided on the upper surface of the toner cartridge 502 contacts an upper wall section 220*c* (refer to FIG. 22) of the container mount 220 so as to prevent the end portion side of the toner cartridge 502 from moving upward (refer to FIG. 21B). In addition, while the toner cartridge 502 is moved in the direction Z so that the discharge outlet 55 and the toner supply port 96*a* are in a connected state, the lower supporting piece 214 provided with the bottom wall section 50*f* of the toner cartridge 502 (refer to FIG. 6) contacts a lower wall section 220*d* (refer to FIG. 22) of the container mount 220 so as to prevent the back end side of the toner cartridge 502 from moving toward the lower side. Then, in condition that the discharge outlet 55 and the toner supply port 96*a* are connected, as shown in FIG. 21B, the opening section 220*a* of the container mount 220 is filled up with the back end portion of the toner cartridge 502. Thereby, the stirring drive coupling 301 provided with the container mount 220 is connected with the coupling 522*a* of the stirring member 52 (refer to FIG. 10D), and the transporting drive coupling provided with the container mount 220 is connected with the coupling 562*a* of the screw conveyor 56 (refer to FIG. 4).

From such a configuration, the toner cartridge 502 is inserted appropriately into the toner-container fixing portion 902, and the insertion operation of the toner cartridge 502 into the container mount 220 is completed. Therefore, when the toner cartridge 502 is inserted appropriately into the toner-supply device 43 (container mount 220), the stirring member 52 can rotate accordingly by the rotational drive force of the stirring-drive coupling, and the screw conveyor 56 can rotate appropriately receiving the drive force from the transporting-drive coupling. Thus, developer G which is discharged from the discharge outlet 55 of the toner cartridge 502 toward the outside can be reliably transported to the inner side (temporary toner chamber 44) from the toner supply port 96*a* of the toner-container fixing device (refer to FIG. 3). Therefore, developer G discharged from the toner cartridge 502 is supplied to the developing device 23 (refer to FIG. 3).

Figure 27:
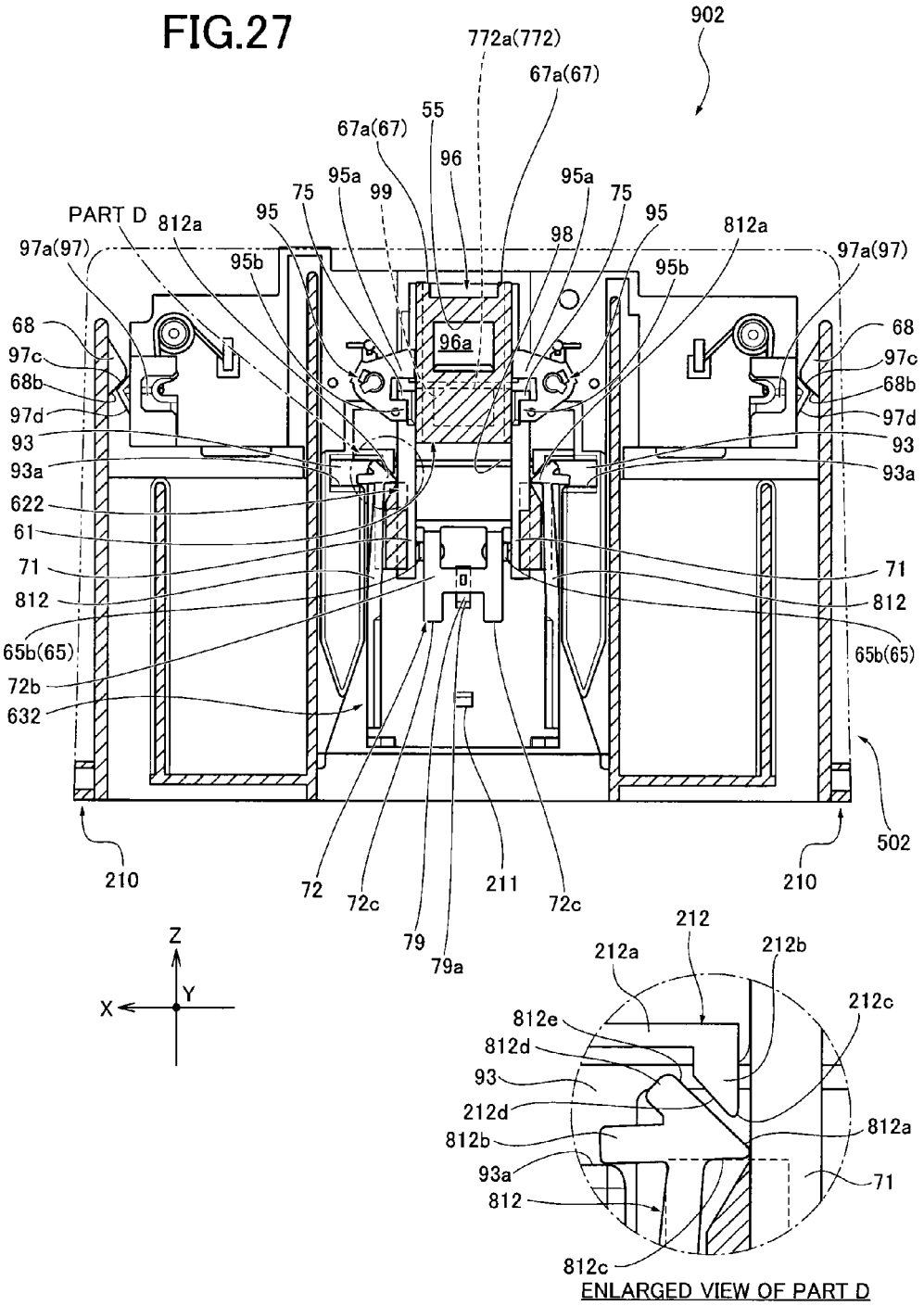
FIG. 27 provides an explanatory view similar to FIG. 24, illustrating an aspect in which the toner cartridge 502 is discharged.
Figure 28:
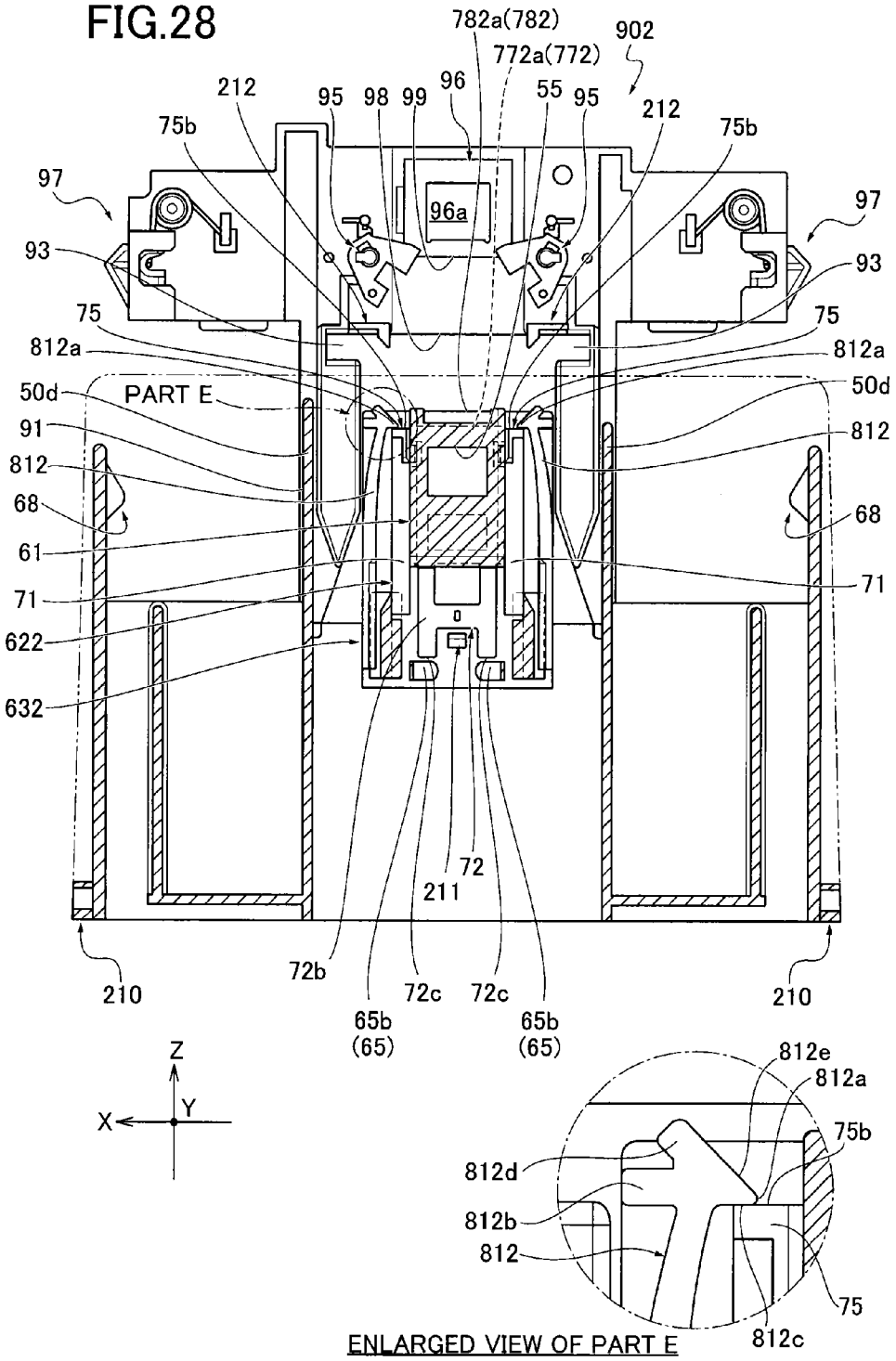
FIG. 28 provides an explanatory view similar to FIG. 24, and illustrates an aspect in which the second shutter 632 which is fixed by each hook piece 812*b* and fixing grooves 93 is released, through which the toner cartridge 502 moves to the direction opposite to the Z-axis relative to the toner-container fixing portion 902.

Descriptions are given below of operations of the shutter assembly 602 and the toner-container fixing portion 902 during releasing of the toner cartridge 502 from the container mount 220 with reference to FIGS. 27 and 28. FIG. 27 is an explanatory view similar to FIG. 24, illustrating an aspect in which the toner cartridge 502 is discharged. FIG. 27 illustrates a release aspect of the fixed toner cartridge 502 released by a pair of releasing claw assemblies 97 when the toner cartridge 502 moves to the opposite side of the direction Z relative to the toner-container fixing portion 902. FIG. 28 is an explanatory view similar to FIG. 24, and illustrates an aspect in which the second shutter 632, which is fixed by each hook piece 812*b* and fixing grooves 93, is released through the toner cartridge 502 moving toward the direction opposite to the direction Z relative to the toner-container fixing portion 902.

In the toner-container fixing portion 902, in order to eject the toner cartridge 502, the toner cartridge 502 is moved to the opposite direction to the insertion direction, that is, the opposite side of the direction Z. In short, the release direction faces opposite to the direction Z. Herein, at first, the toner cartridge 502 is held by grabbing the handle 206 (refer to FIG. 21B) and moving the toner cartridge 502 from the container mount 220, that is, the toner-container fixing portion 902 is moved toward the release direction (opposite side of direction Z). Then, the fixed state through the retention releasing piece 68 on the side wall section 50*c* of the toner cartridge 502 and releasing claw assembly 97 is released (refer to FIG. 27). FIG. 27 illustrates the motion of the releasing claw assembly 97 (releasing claw 97*a*) of the toner-container fixing portion 902 being pushed inside thereof for the releasing operation. The attachment mount 61 of the toner cartridge 502 moves to the opposite side of the direction Z, and the condition in which the discharge outlet 55 faces the toner supply port 96*a* of the toner-container fixing portion 902 in the direction Y is released. Herein, in the shutter assembly 602, another end side protrusion 95*b* of the fixing claw assembly 95 in the toner-container fixing portion 902 enters into the backward side of the engaging section 75 (opposite side of direction Z of hook surface 75*a* thereof). Therethrough, the first shutter 622 is controlled so as not to move toward the opposite side of the direction Z in relation to the toner-container fixing portion 902 because the end side protrusion 95*b* contacts the hook surface 75*a* of the engaging section 75 in the direction Z. In the shutter assembly 602, the protruding end portion 812*a* of the arm section 812 in the second shutter 632 contacts the side wall section 71 of the first shutter 622 and the hook piece 812*b* enters inside the fixing groove 93 of the toner-container fixing portion 902. The hook piece 812*b* contacts (interferes) with the fixing wall section 93*a* of the fixing groove 93 in the direction Z. Thereby, the second shutter 632 is controlled so as not to move toward the opposite side of the direction Z. Herein, the second shutter 632 is moved slightly on the opposite side of the direction Z from the controlled position defined by the second step portion 98; however, it is still kept in the releasing position. When the arm section 812 in which the hook piece 812*b* is inserted into the fixing groove 93 recovers to the initial curve-state, through which there is slight movement toward the opposite side of the direction Z in the second shutter 632, the releasing protrusion 812*d* (inclined releasing surface 812*e* thereof) is prevented from interference between the pressure body 212*b* (protruding end portion 212*c*, and inclined pressure surface 212*d* thereof) provided with the releasing protrusion 812*d* of the toner-container fixing portion 902 (refer to FIG. 28). Therefore, in the toner cartridge 502, the first and second shutters 622 and 632 are prevented from moving toward the opposite side of the direction Z along with the attachment mount 61 (toner cartridge 502). That is, the first and second shutters 622 and 632 can keep the releasing position and move toward the direction Z.

When the toner cartridge 502 is moved toward the releasing direction (opposite side of the direction Z), the first shutter 622 is fixed on the controlled position defined by the first step portion 99 through the fixing claw assembly 95 until the first shutter 622 comes up to the position in which the shutter seal 772 (refer to FIG. 17) seals the discharge outlet 55. In such a position, the first shutter 622 moves to the sealing position of the toner cartridge 502. Subsequently, when the toner cartridge 502 is moved in the releasing direction (opposite side of direction Z), and the shutter seal 772 of the first shutter 622 is pushed and contacts with the discharge outlet 55 of the attachment mount 61 of the toner cartridge 502, the first shutter 622 moves to the sealing position, and therefore, the discharge outlet 55 is sealed by the shutter seal 772 thereof. At that time, in the shutter assembly 602, the releasing protrusion 67 (front end surface 67*a* thereof) of the attachment mount 61 of the toner cartridge 502 moves to the opposite side of the direction Z over the one end protrusion 95*a* of the fixing claw assembly 95 of the toner-container fixing portion 902. Thereby, the condition in which the attachment mount 61 (releasing protrusion 67) pushes the one end protrusion 95*a* toward the direction Z is released. Therefore, the fixing claw assembly 95 takes the initial rotation state by rotating around the rotational axis 95*c*. The condition in which another end side protrusion 95*b* of the fixing claw assembly 95 in the toner-container fixing portion 902 enters into the backward side (opposite side of the direction Z of the hook surface 75*a* thereof) of the engaging section 75 in the side wall section 71 of the first shutter 622 is released. The first shutter 622 can move toward the opposite side of the direction Z in relation to the toner-container fixing portion 902. Therefore, when the toner cartridge 502 is moved toward the opposite side of the direction Z in relation to the toner-container fixing portion 902, the first shutter 622 moves accurately to the sealing position, and the discharge outlet 55 of the attachment mount 61 can be reliably sealed by the shutter seal 772 of the first shutter 622.

Subsequently, when the toner cartridge 502 is further moved toward the releasing direction (opposite side of direction Z), the first shutter 622 of the shutter assembly 602 moves along with the toner cartridge 502 on the opposite side of the direction Z, and the second shutter 632 stops adjacent to the controlled position defined by the second step portion 98. That is, the second shutter 632 moves toward the direction Z while the first shutter 622 keeps the sealing position, in the toner cartridge 502. Then, the first and second shutters 622 and 632 relatively move in the direction Z. The releasing position in which the releasing protrusion 73 of the first shutter 622 faces the releasing protrusion 79 of the second shutter 632 in the direction Y is released so that the first shutter 622 is prevented from moving toward the opposite direction Z in relation to the toner cartridge 502 in the sealing position of the shutter seal 772 sealing the discharge outlet 55.

Subsequently, the toner cartridge 502 is moved in the releasing direction (opposite side of the direction Z), and the first shutter 622 of the shutter assembly 602 enters between the arm sections 812 provided with the second shutter 632. The condition of the arm section 812 in which the protruding end portion 812*a* contacts the side wall section 71 of the first shutter 622 is released (refer to FIG. 28). Therefore, the arm section 812 of the second shutter 632 takes the initial curved state so that the hook piece 812*b* is released from the condition entering into the fixing groove 93 of the toner-container fixing portion 902. The second shutter 632 can move toward the opposite side of the direction Z in relation to the toner-container fixing portion 902 (refer to FIG. 28). Herein, as described, since the second shutter 632 is prevented from interference between the pressure body portion 212*b* (protruding end portion 212*c* and inclined pressure surface 212*d* thereof) provided with the pressure portion 212 of the toner-container fixing portion 902, the arm section 812 in which the hook piece 812*b* is inserted into the fixing groove 93 can be securely returned to the initial curved state. At this time, the second shutter 632 moves to the covering position for preventing the releasing protrusion 73 of the first shutter 622 from being exposed toward the outside of the toner cartridge 502 (lower wall section 50*b* thereof) as shown in FIG. 28.

Subsequently, the toner cartridge 502 can be released from the toner-container fixing portion 902 (container mount 220) by being moved in the release direction (opposite side of direction Z). Herein, as shown in FIGS. 16, 17, and 28, in the shutter assembly 602, the first shutter 622 is at the sealing position. The shutter seal 772 pushes the attachment mount 61 around the discharge outlet 55 so as to seal the same. The second shutter 632 is at the covering position and covers the first shutter 622 including the releasing protrusion 73. Therefore, the toner cartridge 502 can be in a similar condition to that before it is inserted into the toner-container fixing portion 902 (container mount 220, and toner supply device 43), in which the shutter assembly 602 seals the discharge outlet 55. As described, the releasing operation of the toner cartridge 502 is completed.

Descriptions are given below of the features of the toner cartridge 502 (502Y, 502M, 502C, and 502BK) of an Embodiment, with reference to FIGS. 29 to 31.

Figure 29:
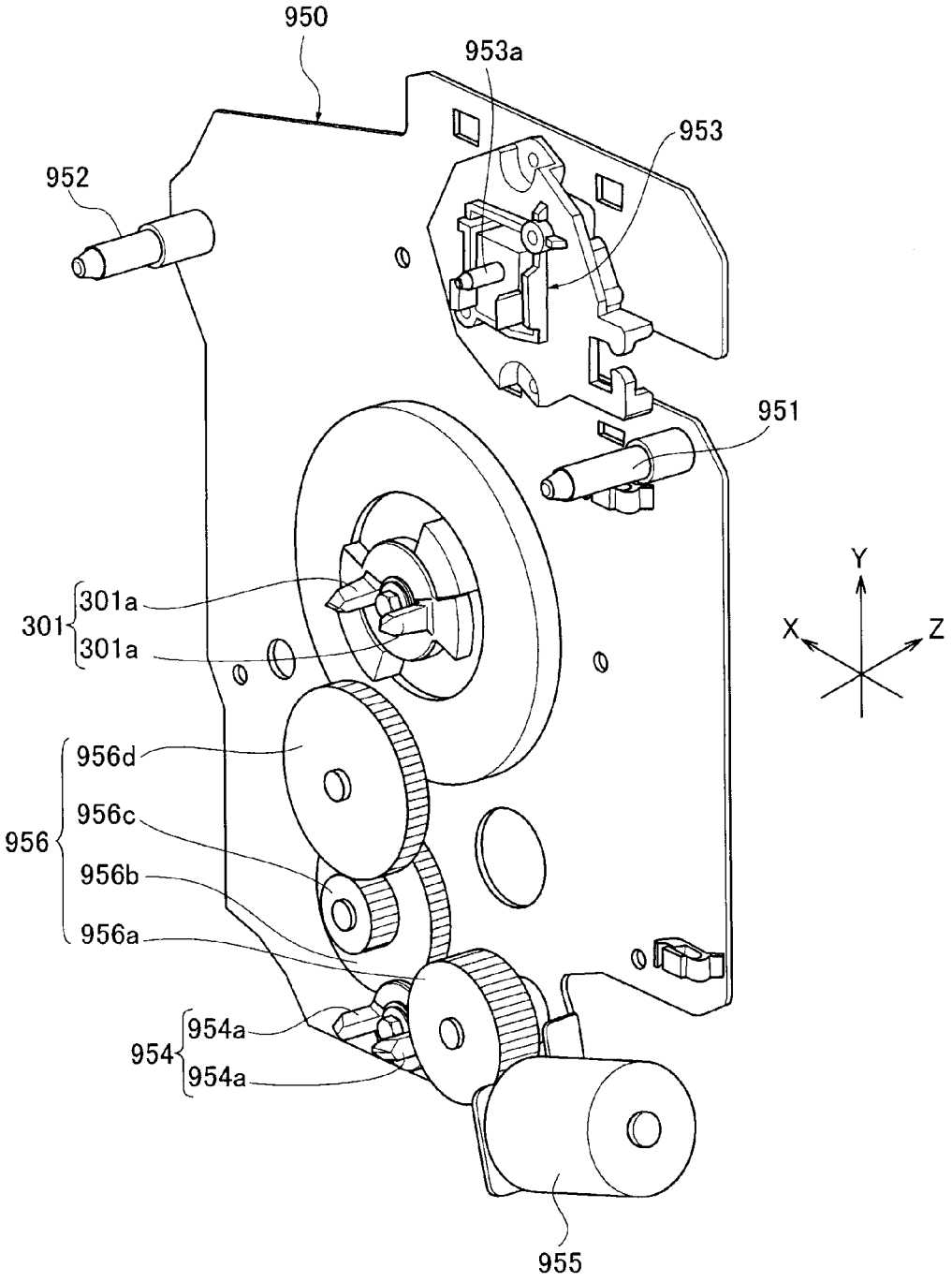
FIG. 29 provides a perspective view of a receiver 950 of the toner cartridge 502.

FIG. 29 is a perspective view of a cartridge receiver 950. The cartridge receiver 950 is provided on the internal side of the space included in the container mount 220 (refer to FIGS. 21A, 21B and 22) in the image-forming apparatus 102. In the cartridge receiver 950, a first positioning pin 951 and a second positioning pin 952 are provided on the right and left side ends, respectively. The first positioning pin 951 is provided on the opposite side of the direction X, and the second positioning pin 952 is provided on the direction X side. Both of the first and second positioning pins 951 and 952 protrude toward the opposite side of the direction Z.

The first positioning pin 951 faces a first positioning hole 201 (refer to FIG.) which is provided on the front end surface 50*a* of the toner cartridge 502. The second positioning pin 952 faces a second positioning hole 202 (refer to FIG. 4) provided on the same front end surface 50*a*. The cross-section of the first positioning pin 951 is formed in a circle so as to fit the shape of a first positioning wall section 201*a* (refer to FIG. 4) provided in front of the first positioning hole 201. The outer diameter of the cross-section of the first positioning pin 951 is formed slightly smaller than the inner diameter of the first positioning wall section 201*a*. The cross-section of the second positioning pin 952 is formed in an ellipse so as to fit the form of a second positioning wall section 202*a*. The outer diameter (both longest and shortest diameter sides) of the second positioning wall section 202*a* is formed slightly smaller than the inner diameter (both longest and shortest diameter sides) of the second positioning wall section 202*a*.

An electronic-substrate connector 953 is further provided with the cartridge receiver 950. The electronic-substrate connector 953 is connected with the electronic substrate 572 (refer to FIG. 4). Herein, a sub-positioning pin 953*a* is provided in the center part of the electronic-substrate connector 953. The sub-positioning pin 953*a* is provided so as to face the position-adjustment hole 572*b* (refer to FIG. 4) in the electronic substrate 572.

The cartridge receiver 950 further includes the stirring-drive coupling 301 (refer to FIG. 10) and a transport-drive coupling 954. The stirring-drive coupling 301 faces the coupling 522*a* (refer to FIGS. 4 and 10) of the stirring member 52, and the transport-drive coupling 954 faces the coupling 562*a* (refer to FIG. 4) of the screw conveyor 56. The stirring-drive coupling 301 includes two protruding hooks 301*a* protruding on the opposite side of the direction Z. The transport-drive coupling 954 also includes two protruding hooks 954*a*. Herein, in FIG. 29, numeral 955 represents a motor, and numeral 956 represents a gear line configured of a gear 956*a*, 956*b*, 956*c*, and 956*d*. The rotational force from the motor 955 is delivered via the gear line 956 toward the transport-drive coupling 954 and the stirring-drive coupling 301.

As described, the retention releasing piece 68 is provided on the side wall section 50*c* of the toner cartridge 502 (refer to FIG. 16). On the other hand, the releasing claw assembly 97 is provided with the toner-cartridge fixing portion 902 (container mount 220), as shown in FIG. 18). The releasing claw assembly 97 includes the front side inclination 97*c* and the backward inclination 97*d* and has a force toward the outside via the elastic pressure member 97*b*. Herein, the retention releasing piece 68 corresponds to the fixing protrusion, and the releasing claw assembly 97 corresponds to the movable protrusion, and both of these configure the retracting assembly.

Figure 31:
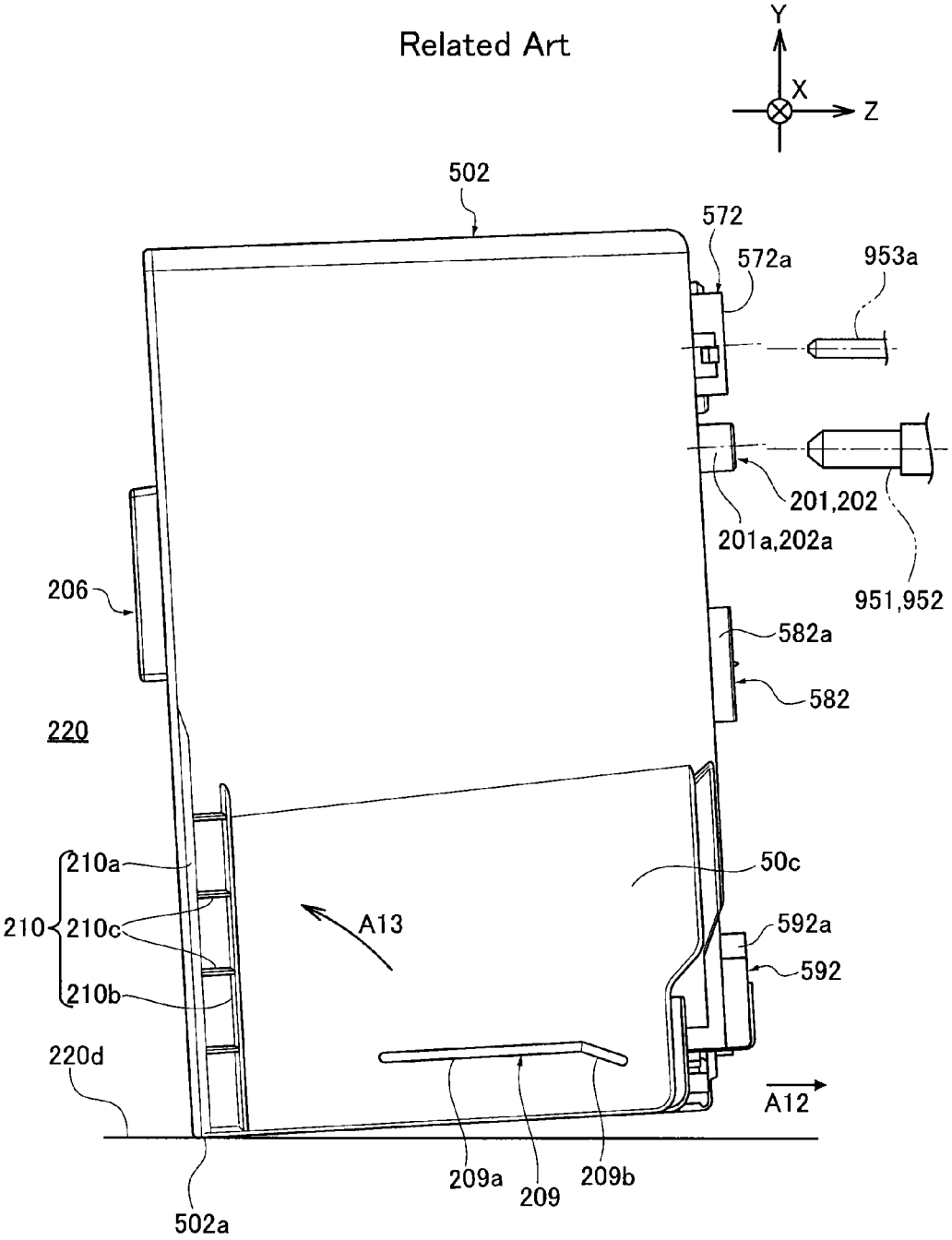
FIG.31 Related Art
FIG. 31 shows a configuration of a conventional art.

In order to insert the toner cartridge 502 into the container mount 220 of the image-forming apparatus 102, the toner cartridge 502 is pushed toward the container mount 220 in the direction indicated by an arrow A12 shown in FIG. 31. Thereby, the first positioning pin 951 fits to the first positioning hole 201 on the front end surface 50*a* of the toner cartridge 502, and the second positioning pin 952 fits into the second positioning hole 202 on the front end surface 50*a* of the toner cartridge 502. The sub-positioning pin 953*a* fits into the position-adjustment hole 572*b* of the electronic substrate 572. At the same time, the stirring-drive coupling 301 is connected with the coupling 522*a* of the stirring member 52, and the transport-drive coupling 954 is connected with the coupling 562*a* of the screw conveyor 56.

In the Embodiment, as shown in FIGS. 4, 11, 21A and 21B, the clamping pieces 205 are provided on both right and left sides of the upper surface of the toner cartridge 502 along the direction opposite to the direction Z. As shown in FIG. 13, on the lower side surface of the toner cartridge 502, the lower supporting pieces 214 are provided on both right and left sides in the direction opposite to the direction Z. Herein, the lower supporting pieces 214 configure the inclining-prevention portion.

Figure 30:
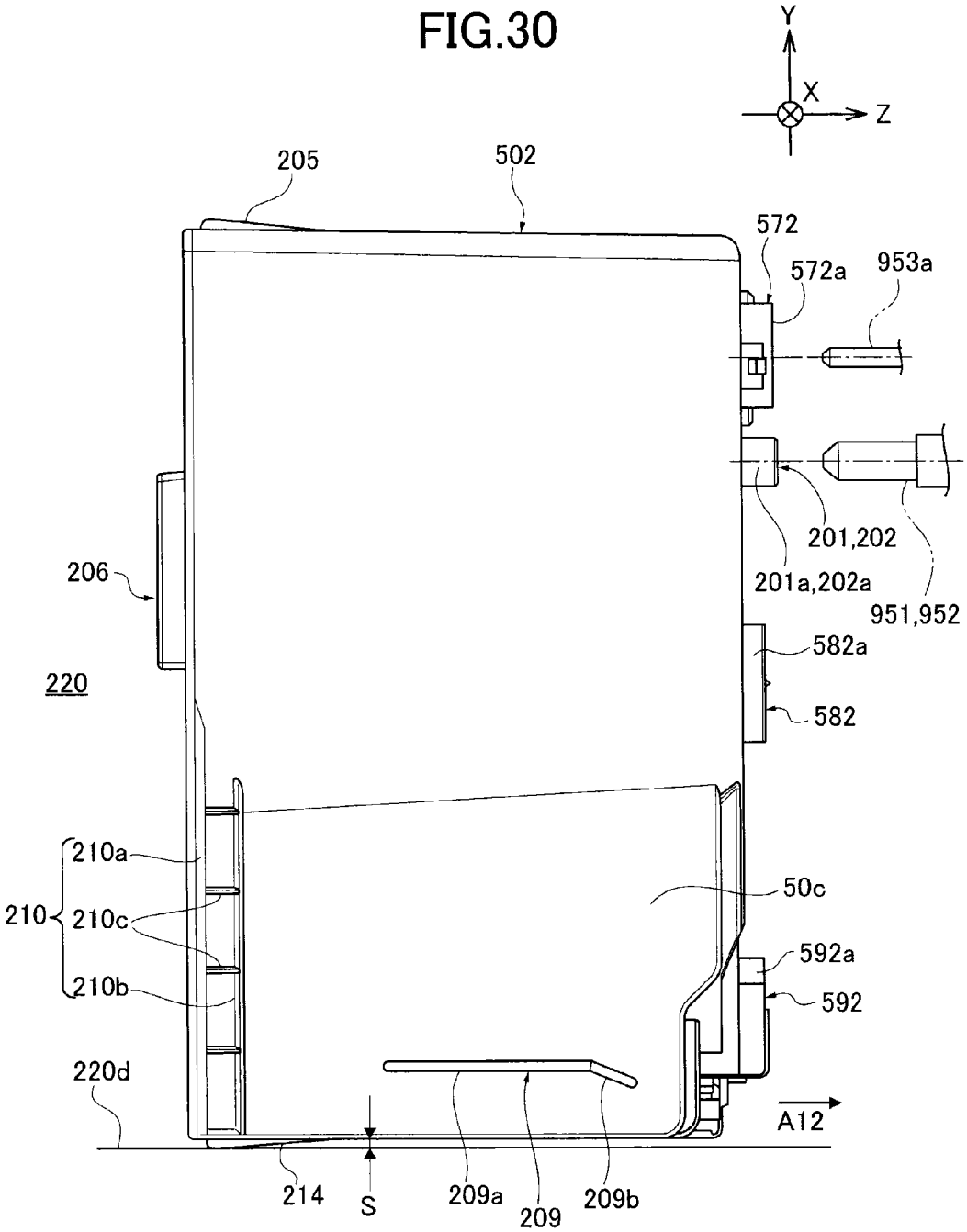
FIG. 30 shows a configuration according to an Embodiment, illustrating an aspect in which the toner cartridge 502 can be kept horizontal when it is inserted into the toner-container mount 220 of the image-forming apparatus 102.

In particular, due to the arrangement of the lower supporting pieces 214 as shown in FIG. 30, the toner cartridge 502 can be kept in parallel to the lower wall section 220*d* of the container mount 220 of the toner cartridge 502, when it is inserted into the container mount 220. That is, even when the lower end of the toner cartridge 502 is retracted to the direction Z indicated by the arrow A12 by the retracting assembly, it does not incline upon being inserted into the container mount 220. In other words, the toner cartridge 502 is kept in parallel with the lower wall section 220*d* of the container mount 220. Therefore, it is configured to fit the first positioning hole 201 of the toner cartridge 502 to the first positioning pin 951 of the cartridge receiver 950 easily. Similarly, the second positioning hole 202 of the toner cartridge 502 can be fitted to the second positioning pin 952 of the cartridge receiver 950 easily. The position-adjustment hole 572*b* of the electronic substrate 572 can be fitted to the sub-positioning pin 953*a* of the cartridge receiver 950 easily.

Herein, a description of a function of the retracting assembly is given below. As described, the retracting assembly includes the retention releasing piece 68 and the releasing claw assembly 97. When the toner cartridge 502 is inserted into the container mount 220, the releasing claw assembly 97 contacts the retention releasing piece 68. In detail, the releasing claw assembly 97 includes the front side inclination 97*c* and the backward inclination 97*d*, and the backward inclination 97*d* of the releasing claw assembly 97 contacts the retention releasing piece 68 at first as shown in FIGS. 24-27. When the releasing claw assembly 97 which has the biasing force toward the outside moves further to the direction of A12, the front end surface (contact portion of front side inclination 97*c* and backward inclination 97*d*) contacts the retention releasing piece 68. In this condition, the releasing claw assembly 97 is pushed by the retention releasing piece 68.

When the releasing claw assembly 97 further moves in the direction A12, the front side inclination 97*c* of the releasing claw assembly 97 contacts the retention releasing piece 68. At this time, the releasing claw assembly 97 and the retention releasing piece 68 define a triangular-shape. A force toward the direction Z generated from the releasing claw assembly 97 has an effect on the retention releasing piece 68 because the releasing claw assembly 97 includes the biasing force toward the outside. As a result, the toner cartridge 502 is retracted by the retracting assembly.

On the other hand, in FIG. 31, the bottom surface of the toner cartridge 502 does not include any clamping piece 205 as shown in FIG. 30. Thereby, when the toner cartridge 502 is inserted into the container mount 220 of the image-forming apparatus 102, it inclines slightly toward the lower wall section 220*d* of the container mount 220. That is, when the lower front end of the toner cartridge 502 is pulled to the direction Z side as indicated by the arrow A12 in the insertion operation, the toner cartridge 502 rotates toward the arrow A13 direction around the bottom surface end 502*a* in the center, and rotates slightly as a whole. As a result, the first positioning hole 201 of the toner cartridge 502 cannot be fitted to the first positioning pin 951 of the cartridge receiver 950. Similarly, the second positioning hole 202 of the toner cartridge 502 cannot be fitted to the second positioning pin 952. Additionally, the position-adjustment hole 572*b* of the electronic substrate 572 cannot be fitted to the sub-positioning pin 953*a* of the cartridge receiver 950.

As described, in the Embodiment, the lower supporting piece 214 is provided on the bottom surface of the toner cartridge 502. Therefore, the toner cartridge 502 can keep its parallel attitude stably when it is retracted by the retracting assembly so as to be inserted into the container mount 220. Thus, the first positioning hole 201 can be fitted to the first positioning pin 951, and the second positioning hole 202 can be fitted to the second positioning pin 952 easily. The sub-positioning pin 953*a* of the electronic substrate connector 953 can be fitted easily to the position-adjustment hole 572*b* of the electronic substrate 572. As a result, the backward side end portion of the toner cartridge 502 can be fixed and held by the cartridge receiver 950 so that the toner cartridge 502 can be held stable in the container mount 220.

In addition, in the Embodiment, the sub-positioning pin 953*a* of the electronic substrate connector 953 can be easily fitted to the position-adjustment hole 572*b* of the electronic substrate 572, so the electronic substrate connector 953 and the electronic substrate 572 can be reliably connected to each other. As a result, the information exchange between the electronic substrate connector 953 and the electronic substrate 572 can be performed accurately.

As shown in FIG. 30, it is arranged to have a slight clearance S between the bottom surface of the toner cartridge 502 and the lower wall section 220*d* of the container mount 220. By such a configuration, since at least the lower supporting piece 214 (protruding range, in particular) is manufactured with a high degree of accuracy, there is no need to arrange the whole bottom surface of the toner cartridge 502 to have a high degree of accuracy. Therefore, manufacturing cost reduction can be achieved.

In the toner cartridge 502 (502Y, 502M, 502C, and 502BK), the clamping piece 205 is provided on the upper surface thereof. Thus, it can prevent the back end side of the toner cartridge 502 from moving upward when the toner cartridge 502 contacts the upper wall section 220*c* (refer to FIG. 22) of the container mount 220. Therefore, such a configuration enables: the first positioning pin 951 (refer to FIG. 29) of the container mount 220 to fit into the first positioning hole 201 (refer to FIG. 4) appropriately; the second positioning pin 952 (refer to FIG. 29) of the container mount 220 to fit into the second positioning hole 202 (refer to FIG. 4) appropriately; the positioning protrusion of the container mount 220 to fit into the position-adjustment hole 572*b* (refer to FIG. 4) appropriately; the stirring-drive coupling 301 (refer to FIG. 10) to be connected to the coupling 522*a* of the stirring member 52 appropriately; and the transport-drive coupling 954 to be connected to the coupling 562*a* (refer to FIG. 4) of the stirring member 52. Such a configuration is remarkably effective because the handle portion 206 is provided on the rear surface (opposite side surface to direction Y) so as to carry the toner cartridge 502 easily by grabbing the handle wall section 206*b* with a hand inserted in the recess 206*a*.

In the toner cartridge 502 (502Y, 502M, 502C, and 502BK), the lower supporting piece 214 is provided on the bottom wall section 50*f*. Thus, it can prevent the back end side of the toner cartridge 502 from moving downward through contact with the lower wall section 220*d* (refer to FIG. 22) of the container mount 220. Therefore, the above-described appropriate engagement, insertion, or connection of each member can be achieved. In addition, the communication between the electronic substrate 572 and the communication substrate provided with the container mount 220 (toner-supply device 43) can be prevented from becoming difficult due to the back end portion of the toner cartridge 502 inclining to the lower direction while being inserted to the container mount 220. This is remarkably effective because the back end portion of the toner cartridge 502 is easily inclined by moving to the lower direction by its own weight (weight amount of developer G housed in container portion 51).

In the toner cartridge 502 (502Y, 502M, 502C, and 502BK), the clamping piece 205 on the upper surface contacts the upper wall section 220*c*, and the lower supporting piece 214 on the bottom wall section 50*f* contacts the lower wall section 220*d* so that an appropriate position can be taken as viewed from the up and down direction of the back end portion. Therefore, the above-described appropriate engagement, insertion, or connection of each member can be achieved. In addition, the clamping piece 205 and the lower supporting piece 214 protrude gradually to the direction Y along the opposite side of the direction Z. Thus, the toner cartridge 502 can be inserted into the container mount 220 (toner-supply device 43) smoothly at the same time as achieving the above-described effects.

Figure 32A:
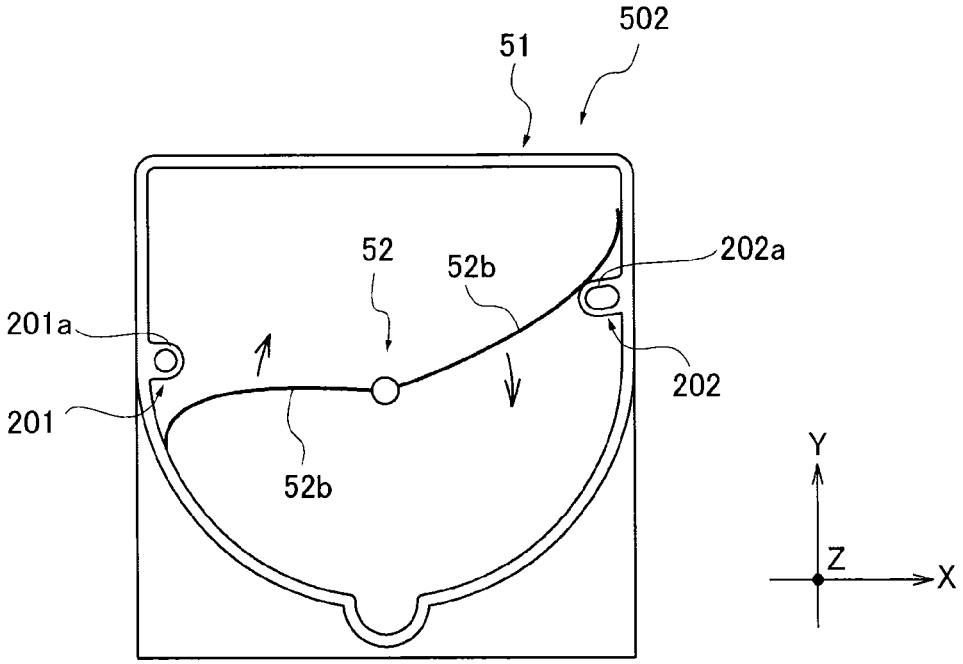
FIGS. 32A and 32B provide explanatory views to illustrate an effect of the positions of the first positioning hole 201 and the second positioning hole 202.
Figure 32B:
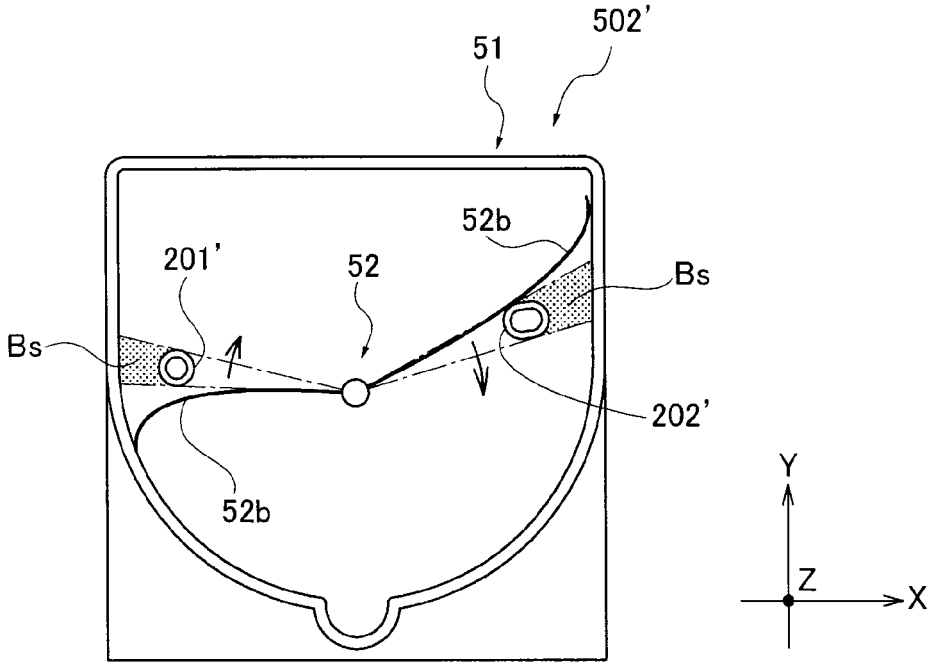

In the toner cartridge 502 (502Y, 502M, 502C, and 502BK), the first positioning wall 201*a* of the first positioning hole 201 and the second positioning wall section 202*a* of the second positioning hole 202 are connected to the container portion 51, that is, the internal surface of the toner cartridge 502. Thereby, the effect of stirring of the developer G housed in the container portion 51 through a stirring wing 52*b* (refer to FIG. 32A) of the stirring member 52 is enhanced furthermore. This can be described as follows: for example, in the toner cartridge 502' as shown in FIG. 32B, the first positioning hole 201' and the second positioning hole 202' are not connected to the container portion 51, that is, a blind area Bs is formed by the inner surface of the toner cartridge 502', the first positioning hole 201' and the second positioning hole 202', between the container portion 51 and the inner wall section, when viewed from the shaft line of the stirring member 52; herein, the stirring wing 52*b* is provided so as to extend in a radial fashion from the shaft line; therefore, if the blind area Bs is formed, it becomes difficult to stir the developer G existing in the blind area Bs by the stirring wing 52*b* even if the stirring member 52 rotates. On the other hand, in the toner cartridge 502 of the Embodiment, as shown in FIG. 32A, because the first positioning wall section 201*a* and the second positioning wall section 202*a* are connected to the inside surface thereof, developer G housed in the container portion 51 can be stirred by the stirring wing 52*b* evenly without such a blind area Bs. Therefore, the stirring effect of the developer G contained in the container portion 51 by the stirring wing 52*b* of the stirring member 52 can be enhanced.

In this regard, for simplicity of description, although the inner side of the container portion 51 and the stirring wing 52*b* of the stirring member 52 are simplified, the difference in the stirring wing 52*b* is emphasized in FIG. 32A. However, this does not illustrate the actual configuration, and is not the same in the other figures.

Figure 33:
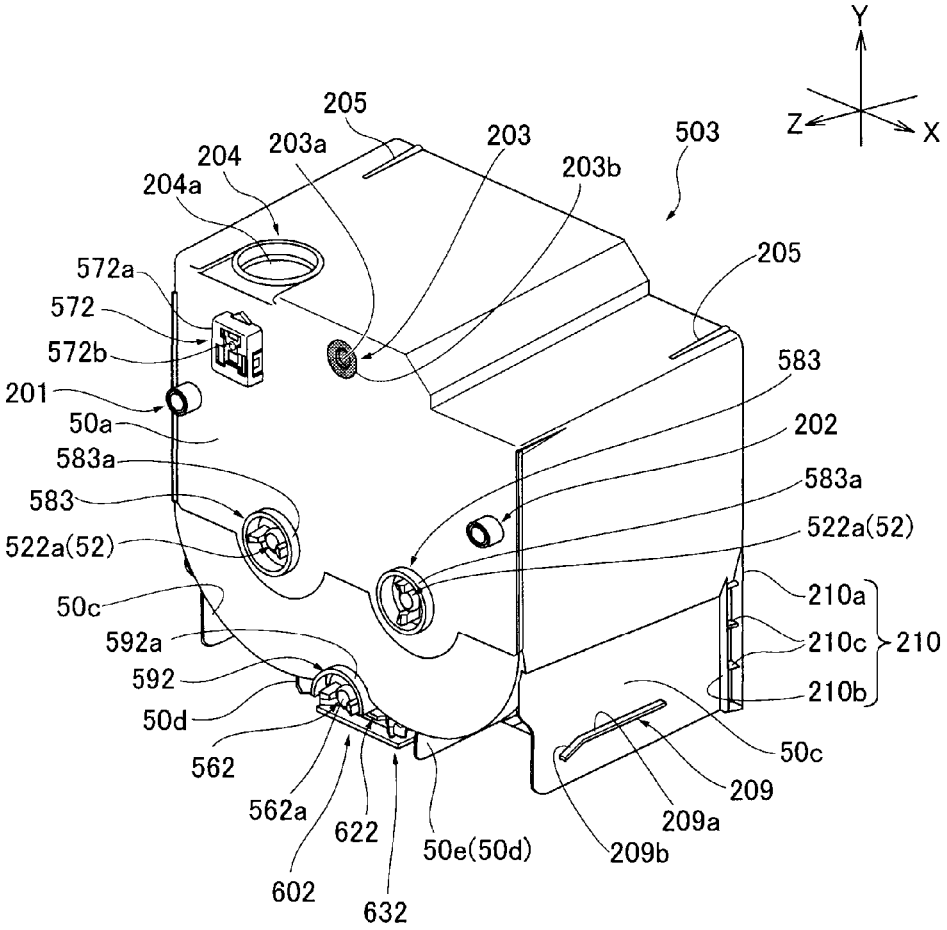
FIG. 33 is a perspective view of a toner cartridge 503 having a different configuration from the toner cartridge 502, as viewed from the top front side (direction Z).

In the above-described Embodiment, although the toner cartridge 502 includes a single stirring member 52, it can be replaced with a toner cartridge 503 including two stirring members 52 as shown in FIG. 33, and it is not limited to the described embodiment. The toner cartridge 503 includes two connecting apertures 583 so as to expose the couplings 522*a* of the corresponding stirring members 52. The connecting apertures 583 have a similar configuration to the connecting aperture 58 or 582 and include a raised circumference 583*a*. The configuration of the toner cartridge 503 is similar to the toner cartridge 502 in the Embodiment except for the two stirring members 52. The stirring force to developer G housed in the container portion 51 is advanced because it includes two stirring members 52.

Although the toner-container support unit according to the present invention has been described above in accordance with the Embodiment, the detailed configuration is not limited thereto. It should be appreciated that variations may be made in the embodiments described by persons skilled in the art without departing from the scope of the present invention. The numbers, positions, forms, and the like of the described members are not limited to the Embodiment, and they can be arranged appropriately with the operation of the present invention.

For example, in the Embodiment, although the toner-supply unit 43 (toner-container fixing portion 902) is provided with the image-forming apparatus 102 as a color printer, it can also be provided with an image-forming apparatus forming a single color image. It is not limited to the Embodiment.

According to the Embodiment of the present invention, the toner container can be prevented from inclining when it is retracted by the retracting assembly because the inclination stopper portion is provided therein.

What is claimed is:

1. A toner-container support unit, comprising:

a toner container housing toner;

a container mount including an internal space to accommodate the toner container;

a toner-container receiver which is provided on an internal end side of the internal space of the container mount, fixing and supporting a back end surface of the toner container inserted into the container mount;

a positioning hole formed on the back end surface of the toner container;

a positioning pin provided in the toner-container receiver so as to face the positioning hole;

a retracting assembly retracting a back end portion of the toner container to a toner-container receiver side when inserting the toner container into the container mount, a position of the toner container being adjusted by fitting the positioning pin into the positioning hole through the retracting assembly retracting the back end portion of the toner container; and an inclination stopper which prevents the inclination of the toner container when the back end portion of the toner container is retracted by the retracting assembly toward the toner-container receiver.

2. The toner-container support unit according to claim 1, further comprising:

an electronic substrate disposed on the back end surface of the toner container; and a connector disposed in the toner-container receiver, which is connected to the electronic substrate, wherein a sub-positioning pin which is different from the positioning pin is disposed in the connector, and a positioning hole into which the sub-positioning pin is fitted is formed on the electronic substrate.

3. The toner-container support unit according to claim 1, further comprising:

a lower-support piece as the inclination stopper which is disposed on a front side of a bottom surface of the toner container, wherein the lower-support piece is disposed on each right and left side along an insertion direction of the toner container and protrudes toward a lower side, and a protruding portion of the lower support piece increases at most on the front side and gradually decreases towards a back end side.

4. The toner-container support unit according to claim 1, wherein the retracting assembly includes a fixed protrusion which is disposed on the back end portion of the toner container, and a movable protrusion which is disposed on the internal end side of the internal space of the container mount and has a biasing force toward the outside, wherein when inserting the toner container into the container mount, the movable protrusion contacts the fixed protrusion and moves over the fixed protrusion while being pushed by the fixed protrusion, then the movable protrusion goes back by the biasing force so that the retracting assembly retracts the back end portion of the toner container to the toner-container receiver side.

5. The toner-container support unit according to claim 4, wherein the fixed protrusion is disposed on a lower side of the back end portion of the toner container, and the movable protrusion is disposed on a lower side of the internal end side of the internal space of the container mount.

6. An image-forming apparatus comprising the toner-container support unit according to claim 1.

* * * * *